US010538827B2

(12) United States Patent
Oishi et al.

(10) Patent No.: US 10,538,827 B2
(45) Date of Patent: Jan. 21, 2020

(54) FREE-CUTTING COPPER ALLOY CASTING, AND METHOD FOR PRODUCING FREE-CUTTING COPPER ALLOY CASTING

(71) Applicant: Mitsubishi Shindoh Co., Ltd., Tokyo (JP)

(72) Inventors: Keiichiro Oishi, Osaka (JP); Kouichi Suzaki, Osaka (JP); Shinji Tanaka, Osaka (JP); Yoshiyuki Goto, Osaka (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 16/323,112

(22) PCT Filed: Aug. 15, 2017

(86) PCT No.: PCT/JP2017/029374
§ 371 (c)(1),
(2) Date: Feb. 4, 2019

(87) PCT Pub. No.: WO2018/034283
PCT Pub. Date: Feb. 22, 2018

(65) Prior Publication Data

US 2019/0256960 A1 Aug. 22, 2019

(30) Foreign Application Priority Data

Aug. 15, 2016 (JP) ..... 2016-159238

(51) Int. Cl.
*C22C 9/04* (2006.01)
*C22F 1/00* (2006.01)
*C22F 1/08* (2006.01)

(52) U.S. Cl.
CPC ..... *C22C 9/04* (2013.01); *C22F 1/002* (2013.01); *C22F 1/08* (2013.01)

(58) Field of Classification Search
CPC ..... C22C 9/04
See application file for complete search history.

(56) References Cited

U.S. PATENT DOCUMENTS 4,055,445 A 10/1977 Pops
5,865,910 A 2/1999 Bhargava
8,956,474 B2 * 2/2015 Oishi ..... B23K 1/0012 148/528
2007/0062615 A1 3/2007 Oishi
(Continued)

FOREIGN PATENT DOCUMENTS

CA 2 582 972 A1 4/2006
EP 1 045 041 A1 10/2000
(Continued)

OTHER PUBLICATIONS

Mima, Genjiro, et al., Journal of the Japan Copper and Brass Research Association, 2 (1963) p. 62-77, with partial translation.
(Continued)

*Primary Examiner* — Anthony J Zimmer
*Assistant Examiner* — Ricardo D Morales
(74) *Attorney, Agent, or Firm* — Merchant & Gould, P.C.

(57) ABSTRACT

This free-cutting copper alloy casting contains 75.0-78.5% Cu, 2.95-3.55% Si, 0.07-0.28% Sn, 0.06-0.14% P, 0.022-0.20% Pb, with the remainder being made up of Zn and unavoidable impurities. The composition satisfies the following relations: $76.2 \leq f1 = Cu + 0.8 \times Si - 8.5 \times Sn + P + 0.5 \times Pb \leq 80.3$, $61.2 \leq f2 = Cu - 4.4 \times Si - 0.8 \times Sn - P + 0.5 \times Pb \leq 62.8$. The area ratios (%) of the constituent phases satisfy the following relations: $2.5 \leq \kappa 65$, $0 \leq \gamma \leq 2.0$, $0 \leq \beta \leq 0.3$, $0 \leq \mu \leq 2.0$, $96.5 \leq f3 = \alpha + \kappa$, $99.2 \leq f4 = \alpha + \kappa + \gamma + \mu$, $0 \leq f6 = \gamma + \mu \leq 3.0$, $29 \leq f6 = \kappa + 6 \times \gamma^{1/2} + 0.5 \times \mu \leq 66$. The long side of the γ phase does not exceed 50 μm, the long side of the μ phase does not exceed 25 μm, and the κ phase is present within the α phase.

18 Claims, 3 Drawing Sheets

(56) References Cited

U.S. PATENT DOCUMENTS

| | | | | |
|---|---|---|---|---|
| 2007/0169854 | A1 | 7/2007 | Oishi | |
| 2007/0169855 | A1 | 7/2007 | Oishi | |
| 2009/0297390 | A1 | 12/2009 | Hidenobu et al. | |
| 2014/0251488 | A1 | 9/2014 | Oishi et al. | |
| 2016/0068931 | A1* | 3/2016 | Xu | C22F 1/08 420/471 |
| 2017/0211169 | A1 | 7/2017 | Hanaoka et al. | |

FOREIGN PATENT DOCUMENTS

| | | | |
|---|---|---|---|
| EP | 2 634 275 | A1 | 9/2013 |
| JP | 7-508560 | A | 9/1995 |
| JP | 2000-119774 | A | 4/2000 |
| JP | 2000-119775 | A | 4/2000 |
| JP | 2004-263301 | A | 9/2004 |
| JP | 2008-516081 | A | 5/2008 |
| JP | 2008-214760 | A | 9/2008 |
| JP | 2009-509031 | A | 3/2009 |
| JP | 2013-104071 | A | 5/2013 |
| JP | 2016-511792 | A | 4/2016 |
| WO | 94/01591 | A1 | 1/1994 |
| WO | 2006/016442 | A1 | 2/2006 |
| WO | 2006/016624 | A1 | 2/2006 |
| WO | 2007/034571 | A1 | 3/2007 |
| WO | 2008/081947 | A1 | 7/2008 |
| WO | 2012/057055 | A1 | 5/2012 |
| WO | 2013/065830 | A1 | 5/2013 |
| WO | 2015/166998 | A1 | 11/2015 |
| WO | 2018/034280 | A1 | 2/2018 |
| WO | 2018/034281 | A1 | 2/2018 |
| WO | 2018/034282 | A1 | 2/2018 |
| WO | 2018/034284 | A1 | 2/2018 |
| WO | 2019/035224 | A1 | 2/2019 |
| WO | 2019/035225 | A1 | 2/2019 |
| WO | 2019/035226 | A1 | 2/2019 |

OTHER PUBLICATIONS

International Search Report issued in corresponding application PCT/JP2017/029374, completed Oct. 30, 2017 and dated Nov. 7, 2017.

Office Action issued in Japanese application No. 2017-567262 dated Mar. 26, 2018, with machine translation.

International Search Report issued in application PCT/JP2017/029369, completed Oct. 30, 2017 and dated Nov. 7, 2017.

International Search Report issued in application PCT/JP2017/029376, completed Oct. 30, 2017 and dated Nov. 7, 2017.

Office Action issued in Japanese application No. 2017-567267 dated Mar. 26, 2018, with machine translation.

International Search Report issued in application PCT/JP2017/029371, completed Oct. 30, 2017 and dated Nov. 7, 2017.

Office Action issued in Japanese application No. 2017-567265 dated Mar. 26, 2018, with machine translation.

International Search Report issued in application PCT/JP2017/029373, completed Oct. 30, 2017 and dated Nov. 7, 2017.

International Search Report issued in application PCT/JP2018/006203, completed Apr. 26, 2018 and dated May 15, 2018.

International Search Report issued in application PCT/JP2018/006218, completed Apr. 26, 2018 and dated May 15, 2018.

International Search Report issued in application PCT/JP2018/006245, completed Apr. 26, 2018 and dated May 15, 2018.

Opposition issued in co-pending Japanese application 2017-567267 dated Mar. 5, 2019 with computer translation.

Opposition issued in co-pending Japanese application 2017-567265 dated Mar. 27, 2019 with computer translation.

Opposition issued in co-pending Japanese application 2017-567266 dated Mar. 27, 2019 with computer translation.

JCBAT204 : Sep. 12, 2005 "Lead-less free-cutting brass bar", Japan Copper and Brass Association technical standard, with computer translation.

Office Action issued in co-pending Japanese application 2018-530923, dated Aug. 7, 2018, with Machine translation obtained by Global Dossier on May 8, 2019.

Opposition issued in co-pending Japanese application 2017-567267 dated May 5, 2019 with computer translation.

Opposition issued in co-pending Japanese application 2017-567265 dated May 27, 2019 with computer translation.

Opposition issued in co-pending Japanese application 2017-567266 dated May 27, 2019 with computer translation.

Office Action issued in co-pending U.S. Appl. No. 16/274,622 dated Aug. 26, 2019.

* cited by examiner

CROSS-SECTION OF TEST No.T401
AFTER USE IN HARSH WATER ENVIRONMENT FOR 8 YEARS (a)

CROSS-SECTION OF TEST No.T402
AFTER DEZINCIFICATION CORROSION TEST 1

(b)

CROSS-SECTION OF TEST No.T03
AFTER DEZINCIFICATION CORROSION TEST 1

(c)

FREE-CUTTING COPPER ALLOY CASTING, AND METHOD FOR PRODUCING FREE-CUTTING COPPER ALLOY CASTING

This is a National Phase Application in the United States of International Patent Application No. PCT/JP2017/029374 filed Aug. 15, 2017, which claims priority on Japanese Patent Application No. 2016-159238, filed Aug. 15, 2016. The entire disclosures of the above patent applications are hereby incorporated by reference.

TECHNICAL FIELD

The present invention relates to a free-cutting copper alloy casting having excellent corrosion resistance, excellent castability, impact resistance, wear resistance, and high-temperature properties in which the lead content is significantly reduced, and a method of manufacturing the free-cutting copper alloy casting. In particular, the present invention relates to a free-cutting copper alloy casting (copper alloy casting having good machinability) used in devices such as faucets, valves, or fittings for drinking water consumed by a person or an animal every day as well as valves, fittings and the like for electrical uses, automobiles, machines, and industrial plumbing in various harsh environments, and a method of manufacturing the free-cutting copper alloy casting.

Priority is claimed on Japanese Patent Application No. 2016-159238, filed on Aug. 15, 2016, the content of which is incorporated herein by reference.

BACKGROUND ART

Conventionally, as a copper alloy that is used in devices for drinking water and valves, fittings and the like for electrical uses, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze:gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. In addition, it is said that a regulation for reducing the amount of Pb leaching from the drinking water supply devices to about 5 mass ppm will come into force in the future. In countries other than the United States, a movement of the regulation has become rapid, and the development of a copper alloy material corresponding to the regulation of the Pb content has been required.

In addition, in other industrial fields such as automobiles, machines, and electrical and electronic apparatuses industries, for example, in ELV regulations and RoHS regulations of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength under high temperature (for example, 150° C.), and thus cannot realize a reduction in thickness and weight, for example, in automobile components used under high temperature near the engine room when the sun is blazing, or in plumbing pipes used under high temperature and high pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under high temperature is low, and impact resistance is poor. Therefore, the brass is not appropriate for the above-described uses.

On the other hand, for example, Patent Documents 3 to 9 disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and 4 disclose a method of improving corrosion resistance by forming a large amount of γ phase.

In addition, Patent Document 5 discloses a copper alloy including an extremely small amount of 0.02 mass % or lower of Pb having excellent machinability that is mainly realized by defining the total area of γ phase and κ phase. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, an extremely small amount of Zr is added in the presence of P, and the P/Zr ratio or the like is important.

In addition, in Patent Document 8, proposes a copper alloy in which Fe is added to a Cu—Zn—Si alloy is proposed.

Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, μ phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle. Therefore, when a large amount of γ phase is contained, problems arise in corrosion resistance, impact resistance, high-temperature strength (high temperature creep), and the like in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound shortens tool life of a cutting tool during cutting and causes to generate hard spots during polishing such that the external appearance is impaired. It also has problems such as causing reduction in impact resistance. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but β phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T-2016-511792
[Patent Document 9] JP-A-2004-263301
[Patent Document 10] U.S. Pat. No. 4,055,445

Non-Patent Document

[Non-Patent Document 1] Genjiro *MIMA*, Masaharu HASEGAWA, Journal of the Japan Copper and Brass Research Association, 2 (1963), p. 62 to 77

SUMMARY OF THE INVENTION

Problem that the Invention is to Solve

The present invention has been made in order to solve the above-described problems of the conventional art, and an object thereof is to provide a free-cutting copper alloy casting having excellent corrosion resistance in a harsh environment, impact resistance, and high-temperature strength, and a method of manufacturing the free-cutting copper alloy casting. In this specification, unless specified otherwise, corrosion resistance refers to both dezincification corrosion resistance and stress corrosion cracking resistance.

Means for Solving the Problem

In order to achieve the object by solving the problems, a free-cutting copper alloy casting according to the first aspect of the present invention includes:

75.0 mass % to 78.5 mass % of Cu;
2.95 mass % to 3.55 mass % of Si;
0.07 mass % to 0.28 mass % of Sn;
0.06 mass % to 0.14 mass % of P;
0.022 mass % to 0.20 mass % of Pb; and
a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.2 \leq f1 = [Cu] + 0.8 \times [Si] - 8.5 \times [Sn] + [P] + 0.5 \times [Pb] \leq 80.3$$

and $$61.2 \leq f2 = [Cu] - 4.4 \times [Si] - 0.8 \times [Sn] - [P] + 0.5 \times [Pb] 62.8$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$25 \leq (\kappa) \leq 65,$$

$$0 \leq (\gamma) \leq 2.0,$$

$$0 \leq (\beta) \leq 0.3,$$

$$0 \leq (\mu) \leq 2.0,$$

$$96.5 \leq f3 = (\alpha) + (\kappa),$$

$$99.2 \leq f4 = (\alpha) + (\kappa) + (\gamma) + (\mu),$$

$$0 \leq f5 = (\gamma) + (\mu) \leq 3.0, \text{ and}$$

$$29 \leq f6 = (\kappa) + 6 \times (\gamma)^{1/2} + 0.5 \times (\mu) \leq 66$$

are satisfied, the length of the long side of γ phase is 50 μm or less, the length of the long side of μ phase is 25 μm or less, and κ phase is present in α phase.

According to the second aspect of the present invention, the free-cutting copper alloy casting according to the first aspect further includes:

one or more element(s) selected from the group consisting of 0.02 mass % to 0.08 mass % of Sb, 0.02 mass % to 0.08 mass % of As, and 0.02 mass % to 0.30 mass % of Bi.

A free-cutting copper alloy casting according to the third aspect of the present invention includes:

75.5 mass % to 77.8 mass % of Cu;

3.1 mass % to 3.4 mass % of Si;

0.10 mass % to 0.27 mass % of Sn;

0.06 mass % to 0.13 mass % of P;

0.024 mass % to 0.15 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.65 \leq f1 = [Cu] + 0.8 \times [Si] - 8.5 \times [Sn] + [P] + 0.5 \times [Pb] 79.6$$

and $$61.4 \leq f2 = [Cu] - 4.4 \times [Si] - 0.8 \times [Sn] - [P] + 0.5 \times [Pb] \leq 62.6$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \leq (\kappa) \leq 56,$$

$$0 \leq (\gamma) \leq 1.2,$$

$$(\beta) = 0,$$

$$0 \leq (\mu) \leq 1.0,$$

$$98.0 \leq f3 = (+) + (\kappa),$$

$$99.5 \leq f4 = (\alpha) + (\kappa) + (\gamma) + (\mu),$$

$$0 \leq f5 = (\gamma) + (\mu) \leq 1.5, \text{ and}$$

$$32 \leq f6 = (\kappa) + 6 \times (\gamma)^{1/2} + 0.5 \times (\mu) \leq 58$$

are satisfied, the length of the long side of γ phase is 40 μm or less, the length of the long side of μ phase is 15 μm or less, and κ phase is present in α phase.

According to the fourth aspect of the present invention, the free-cutting copper alloy casting according to the third aspect further includes:

one or more element(s) selected from the group consisting of higher than 0.02 mass % and 0.07 mass % or lower of Sb, higher than 0.02 mass % and 0.07 mass % or lower of As, and 0.02 mass % to 0.20 mass % of Bi.

According to the fifth aspect of the present invention, in the free-cutting copper alloy casting according to any one of the first to fourth aspects of the present invention, a total amount of Fe, Mn, Co, and Cr as the inevitable impurities is lower than 0.08 mass %.

According to the sixth aspect of the present invention, in the free-cutting copper alloy casting according to any one of the first to fifth aspects of the present invention, the amount of Sn in κ phase is 0.08 mass % to 0.40 mass %, and the amount of P in κ phase is 0.07 mass % to 0.22 mass %.

According to the seventh aspect of the present invention, in the free-cutting copper alloy casting according to any one of the first to sixth aspects of the present invention, a Charpy impact test value is 23 J/cm$^2$ to 60 J/cm$^2$, and a creep strain after holding the material at 150° C. for 100 hours in a state where a load corresponding to 0.2% proof stress at room temperature is applied is 0.4% or lower.

The Charpy impact test value is a value of a specimen having an U-shaped notch.

According to the eighth aspect of the present invention, in the free-cutting copper alloy casting according to any one of the first to seventh aspects of the present invention, a solidification temperature range is 40° C. or lower.

According to the ninth aspect of the present invention, the free-cutting copper alloy casting according to any one of the first to eighth aspects of the present invention is used in a water supply device, a component for industrial plumbing, a device that comes in contact with liquid, an automobile component, or an electrical component.

According to the tenth aspect of the present invention, the method of manufacturing the free-cutting copper alloy casting according to any one of the first to ninth aspects of the present invention includes:

a melting and casting step, wherein the copper alloy casting is cooled in a temperature range from 575° C. to 510° C. at an average cooling rate of 0.1° C./min to 2.5° C./min and subsequently is cooled in a temperature range from 470° C. to 380° C. at an average cooling rate of higher than 2.5° C./min and lower than 500° C./min in the process of cooling after the casting.

According to the eleventh aspect of the present invention, the method of manufacturing the free-cutting copper alloy casting according to any one of the first to ninth aspects of the present invention includes:

a melting and casting step; and a heat treatment step that is performed after the melting and casting step, wherein in the melting and casting step, the casting is cooled to lower than 380° C. or normal temperature, in the heat treatment step, (i) the casting is held at a temperature of 510° C. to 575° C. for 20 minutes to 8 hours or (ii) the casting is heated under the condition where a maximum reaching temperature is 620° C. to 550° C. and is cooled in a temperature range from 575° C. to 510° C. at an average cooling rate of 0.1° C./min to 2.5° C./min, and subsequently the casting is cooled in a temperature range from 470° C. to 380° C. at an average cooling rate of higher than 2.5° C./min and lower than 500° C./min.

According to the twelfth aspect of the present invention, in the method of manufacturing the free-cutting copper alloy casting according to the eleventh aspect of the present invention, in the heat treatment step, the casting is heated under the condition (i), and the heat treatment temperature and the heat treatment time satisfy the following relational expression, $$800 \leq f7 = (T-500) \times t,$$

wherein T represents a heat treatment temperature (° C.), and when T is 540° C. or higher, T is set as 540, and t represents a heat treatment time (min) in a temperature range of 510° C. to 575° C.

Advantage of the Invention

According to the aspects of the present invention, a metallographic structure is defined in which the amount of μ phase that is effective for machinability but has low corrosion resistance, impact resistance, and high-temperature strength like γ phase is reduced as much as possible while minimizing the amount of γ phase that has an excellent machinability improvement function but has low corrosion resistance, impact resistance, and high-temperature strength. Further, a composition and a manufacturing method for obtaining this metallographic structure are defined. Therefore, according to the aspects of the present invention, it is possible to provide a free-cutting copper alloy casting having excellent corrosion resistance in a harsh environment, impact resistance, and high-temperature strength, and a method of manufacturing the free-cutting copper alloy casting.

BRIEF DESCRIPTION OF THE DRAWINGS

FIG. 5(*b*) is a metallographic micrograph of a cross-section of Test No. T402 after dezincification corrosion test 1. FIG. 5(*c*) is a metallographic micrograph of a cross-section of Test No. T03 after dezincification corrosion test 1.

BEST MODE FOR CARRYING OUT THE INVENTION

Figure 1:
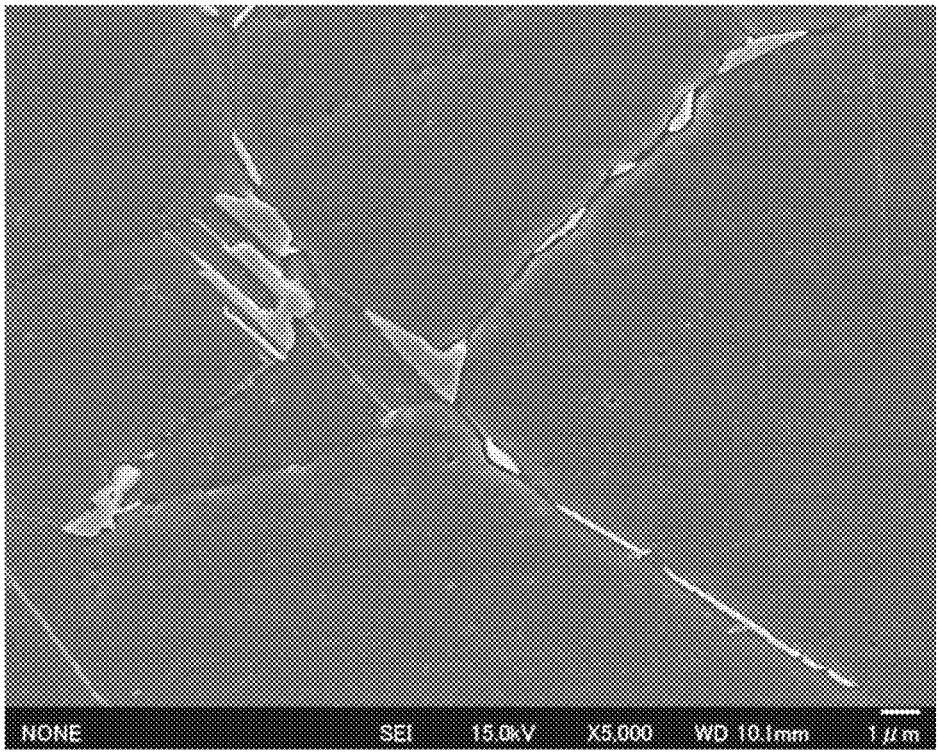
FIG. 1 is an electron micrograph of a metallographic structure of a free-cutting copper alloy casting (Test No. T04) according to Example 1.

Below is a description of free-cutting copper alloy castings according to the embodiments of the present invention and the methods of manufacturing the free-cutting copper alloy castings.

The free-cutting copper alloy castings according to the embodiments are for use in devices such as faucets, valves, or fittings to supply drinking water consumed by a person or an animal every day, components for electrical uses, automobiles, machines and industrial plumbing such as valves or fittings, and devices and components that contact liquid.

Here, in this specification, an element symbol in parentheses such as [Zn] represents the content (mass %) of the element.

In the embodiment, using this content expressing method, a plurality of composition relational expressions are defined as follows.

$$f1=[Cu]+0.8\times[Si]-8.5\times[Sn]+[P]+0.5\times[Pb] \quad \text{Composition Relational Expression}$$

$$f2=[Cu]-4.4\times[Si]-0.8\times[Sn]-[P]+0.5\times[Pb] \quad \text{Composition Relational Expression}$$

Further, in the embodiments, in constituent phases of metallographic structure, an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%. Constituent phases of metallographic structure refer to α phase, γ phase, κ phase, and the like and do not include intermetallic compound, precipitate, non-metallic inclusion, and the like. In addition, κ phase present in α phase is included in the area ratio of α phase. The sum of the area ratios of all the constituent phases is 100%.

In the embodiments, a plurality of metallographic structure relational expressions are defined as follows.

Metallographic Structure Relational Expression $$f3=(\alpha)+(\kappa)$$

Metallographic Structure Relational Expression $$f4=(\alpha)+(\kappa)+(\gamma)+(\mu)$$

Metallographic Structure Relational Expression $$f5=(\gamma)+(\mu)$$

Metallographic Structure Relational Expression $$f6=(\kappa)+6\times(\gamma)^{1/2}+0.5\times(\mu)$$

A free-cutting copper alloy casting according to the first embodiment of the present invention includes: 75.0 mass % to 78.5 mass % of Cu; 2.95 mass % to 3.55 mass % of Si; 0.07 mass % to 0.28 mass % of Sn; 0.06 mass % to 0.14 mass % of P; 0.022 mass % to 0.20 mass % of Pb; and a balance including Zn and inevitable impurities. The composition relational expression f1 is in a range of $76.2 \leq f1 \leq 80.3$, and the composition relational expression f2 is in a range of $61.2 \leq f2 \leq 62.8$. The area ratio of κ phase is in a range of $25 \leq (\kappa) \leq 65$, the area ratio of γ phase is in a range of $0 \leq (\gamma) \leq 2.0$, the area ratio of β phase is in a range of $0 \leq (\beta) \leq 0.3$, and the area ratio of μ phase is in a range of $0 \leq (\mu) \leq 2.0$. The metallographic structure relational expression f3 is in a range of $96.5 \leq f3$, the metallographic structure relational expression f4 is in a range of $99.2 \leq f4$, the metallographic structure relational expression f5 is in a range of $0 \leq f5 \leq 3.0$, and the metallographic structure relational expression f6 is in a range of $29 \leq f6 \leq 66$. The length of the long side of γ phase is 50 μm or less, the length of the long side of μ phase is 25 μm or less, and κ phase is present in α phase.

A free-cutting copper alloy casting according to the second embodiment of the present invention includes: 75.5 mass % to 77.8 mass % of Cu; 3.1 mass % to 3.4 mass % of Si; 0.10 mass % to 0.27 mass % of Sn; 0.06 mass % to 0.13 mass % of P; 0.024 mass % to 0.15 mass % of Pb; and a balance including Zn and inevitable impurities. The composition relational expression f1 is in a range of 76.679.6, and the composition relational expression f2 is in a range of $61.4 \leq f2 \leq 62.6$. The area ratio of κ phase is in a range of $30 \leq (\kappa) \leq 56$, the area ratio of γ phase is in a range of $0 \leq (\gamma) \leq 1.2$, the area ratio of β phase is 0, and the area ratio of μ phase is in a range of $0 \leq (\mu) \leq 1.0$. The metallographic structure relational expression f3 is in a range of $98.0 \leq f3$, the metallographic structure relational expression f4 is in a range of $99.5 \leq f4$, the metallographic structure relational expression f5 is in a range of $0 \leq f5 \leq 1.5$, and the metallographic structure relational expression f6 is in a range of $32 \leq f6 \leq 58$. The length of the long side of γ phase is 40 μm or less, the length of the long side of μ phase is 15 μm or less, and κ phase is present in α phase.

The free-cutting copper alloy casting according to the first embodiment of the present invention may further include one or more element(s) selected from the group consisting of 0.02 mass % to 0.08 mass % of Sb, 0.02 mass % to 0.08 mass % of As, and 0.02 mass % to 0.30 mass % of Bi.

In addition, the free-cutting copper alloy casting according to the second embodiment of the present invention may further include one or more element(s) selected from the group consisting of higher than 0.02 mass % and 0.07 mass % or lower of Sb, higher than 0.02 mass % and 0.07 mass % or lower of As, and 0.02 mass % to 0.20 mass % of Bi.

In the free-cutting copper alloy casting according to the first and second embodiments of the present invention, it is preferable that the amount of Sn in κ phase is 0.08 mass % to 0.40 mass %, and it is preferable that the amount of P in κ phase is 0.07 mass % to 0.22 mass %.

In the free-cutting copper alloy casting according to the first and second embodiments of the present invention, it is preferable that a Charpy impact test value is 23 J/cm$^2$ to 60 J/cm$^2$, and it is preferable that a creep strain after holding the copper alloy casting at 150° C. for 100 hours in a state where 0.2% proof stress (load corresponding to 0.2% proof stress) at room temperature is applied is 0.4% or lower.

In the free-cutting copper alloy casting according to the first and second embodiments of the present invention, it is preferable that the solidification temperature range is 40° C. or lower.

The reason why the component composition, the composition relational expressions f1 and f2, the metallographic structure, the metallographic structure relational expressions f3, f4, f5, and f6, and the mechanical properties are defined as above is explained below.

<Component Composition>

(Cu)

Cu is a main element of the alloy castings according to the embodiments. In order to achieve the object of the present invention, it is necessary to add at least 75.0 mass % or higher of Cu. When the Cu content is lower than 75.0 mass %, the proportion of γ phase is higher than 2.0% although depending on the contents of Si, Zn, and Sn, and the manufacturing process, and dezincification corrosion resistance, stress corrosion cracking resistance, impact resistance, ductility, normal-temperature strength, and high-temperature strength (high temperature creep) deteriorate, and solidification temperature range expands resulting in deterioration in castability. In some cases, β phase may also appear. Accordingly, the lower limit of the Cu content is 75.0 mass % or higher, preferably 75.5 mass % or higher, and more preferably 75.8 mass % or higher.

On the other hand, when the Cu content is higher than 78.5 mass %, cost of alloy increases because a large amount of expensive copper is used. Further, the effects on corrosion resistance, normal-temperature strength, and high-temperature strength are saturated. Plus, not only the solidification temperature range expands causing deterioration of castability, but also the proportion of κ phase becomes excessively high. In addition, μ phase having a high Cu concentration, in some cases, ζ phase and χ phase are more likely to precipitate. As a result, machinability, impact resistance, and castability may deteriorate although depending on the conditions of the metallographic structure. Accordingly, the upper limit of the Cu content is 78.5 mass % or lower, preferably 77.8 mass % or lower, and more preferably 77.5 mass % or lower.

(Si)

Si is an element necessary for obtaining most of the excellent properties of the alloy casting according to the embodiments. Si contributes to the formation of metallic phases such as κ phase, γ phase, or μ phase. Si improves machinability, corrosion resistance, stress corrosion cracking resistance, strength, high-temperature strength, and wear resistance of the alloy castings according to the embodiments. Regarding machinability, addition of Si scarcely improves machinability of α phase. However, due to a phase such as γ phase, κ phase, or μ phase that is formed by addition of Si and is harder than α phase, excellent machinability can be obtained without containing a large amount of Pb. However, as the proportion of the metallic phase such as γ phase or μ phase increases, problems like deterioration in ductility or impact resistance, deterioration of corrosion resistance in a harsh environment, and a problem in high temperature creep properties for withstanding long-term use arise. Therefore, it is necessary to define appropriate ranges for κ phase, γ phase, μ phase, and β phase.

In addition, Si has an effect of significantly suppressing evaporation of Zn during melting and casting and improves melt fluidity. Although other elements such as Cu are also involved, by adjusting the amount of Si to be in an appropriate range, the solidification temperature range can be narrowed, and castability can be improved. In addition, by increasing the Si content, the specific gravity can be reduced.

In order to solve these problems of a metallographic structure and to have all the desired properties, it is necessary to add 2.95 mass % or higher amount of Si although depending on the contents of Cu, Zn, Sn, and the like. The lower limit of the Si content is preferably 3.05 mass % or higher, more preferably 3.1 mass % or higher, and still more preferably 3.15 mass % or higher. It may look as if the Si content should be reduced in order to reduce the proportion of γ phase or μ phase having a high Si concentration. However, as a result of a thorough study on a mixing ratio between Si and other elements and the manufacturing process, it was found that it is necessary to define the lower limit of the Si content as described above. In addition, although depending on the contents of other elements, the composition relational expressions, and the manufacturing process, once Si content reaches about 2.95 mass %, elongated acicular κ phase starts to appear in α phase, and when the Si content is about 3.05 or 3.1 mass % or higher, the amount of acicular κ phase increases. Due to the presence of κ phase in α phase, machinability, impact resistance, and wear resistance are improved without deterioration in ductility. Hereinafter, κ phase present in α phase will also be referred to as κ1 phase.

On the other hand, when the Si content is excessively high, a problem may arise if the amount of κ phase, which is harder than α phase, is excessively large because ductility and impact resistance are important in the embodiments. Therefore, the upper limit of the Si content is 3.55 mass % or lower, preferably 3.45 mass % or lower, more preferably 3.4 mass % or lower, and still more preferably 3.35 mass % or lower. By limiting Si content to the afore-descried ranges, it is possible to narrow the solidification temperature range and improve castability.

(Zn)

Zn is a main element of the alloy castings according to the embodiments together with Cu and Si and is required for improving machinability, corrosion resistance, castability, and wear resistance. Zn is included in the balance, but to be specific, the upper limit of the Zn content is about 21.7 mass % or lower, and the lower limit thereof is about 17.5 mass % or higher.

(Sn)

Sn significantly improves dezincification corrosion resistance, in particular, in a harsh environment and improves stress corrosion cracking resistance, machinability, and wear resistance. In a copper alloy casting including a plurality of metallic phases (constituent phases), there is a difference in corrosion resistance between the respective metallic phases. Even in the case the two phases that remain in the metallographic structure are α phase and κ phase, corrosion begins from a phase having lower corrosion resistance and progresses. Sn improves corrosion resistance of α phase having the highest corrosion resistance and improves corrosion resistance of κ phase having the second highest corrosion resistance at the same time. The amount of Sn distributed in κ phase is about 1.4 times the amount of Sn distributed in α phase. That is, the amount of Sn distributed in κ phase is about 1.4 times the amount of Sn distributed in α phase. As the amount of Sn in κ phase is more than α phase, corrosion resistance of κ phase improves more. Because of the larger Sn content in κ phase, there is little difference in corrosion resistance between α phase and κ phase. Alternatively, at least a difference in corrosion resistance between α phase and κ phase is reduced. Therefore, the corrosion resistance of the alloy significantly improves.

However, addition of Sn promotes the formation of γ phase. Sn itself does not have any excellent machinability improvement function, but improves the machinability of the alloy by forming γ phase having excellent machinability. On the other hand, γ phase deteriorates alloy corrosion resistance, ductility, impact resistance, and high-temperature strength. The amount of Sn distributed in γ phase is about 10 times to 17 times the amount of Sn distributed in α phase. That is, the amount of Sn distributed in γ phase is about 10 times to 17 times the amount of Sn distributed in α phase. γ phase including Sn improves corrosion resistance slightly more than γ phase not including Sn, which is insufficient. This way, addition of Sn to a Cu—Zn—Si alloy promotes the formation of γ phase although the corrosion resistance of κ phase and α phase is improved. In addition, a large amount of Sn is distributed in γ phase. Therefore, unless a mixing ratio between the essential elements of Cu, Si, P, and Pb is appropriately adjusted and the metallographic structure is put into an appropriate state by means including adjustment of the manufacturing process, addition of Sn merely slightly improves the corrosion resistance of κ phase and α phase. Instead, an increase in γ phase causes deterioration in alloy corrosion resistance, ductility, impact resistance, and high temperature properties. In addition, when κ phase contains Sn, its machinability improves. This effect is further improved by addition of P together with Sn.

In addition, addition of Sn, which is a metal having a low melting point that is lower than that of Cu by about 850° C., widens the solidification temperature range of the alloy. That is, it is believed that, since a residual liquid that is rich in Sn is present immediately before the end of solidification, the solidus temperature decreases and the solidification temperature range is widened. However, due to a relation with Cu and Si, the solidification temperature range does not widen. Instead, it remains to be equal to the same level when Sn is not added, or becomes slightly narrower than when Sn is not added. As a result, due to addition of Sn in the range of the embodiment, a casting having reduced casting defects can be obtained. However, since Sn is a low melting point metal, residual liquid that is rich in Sn tends to change to β phase or γ phase such that a long series of elongated γ phase having a high Sn concentration is present at a phase boundary between α phase and κ phase or at a gap between dendrites.

By performing a control of a metallographic structure including the relational expressions and the manufacturing process described below, a copper alloy having excellent properties can be prepared. In order to exhibit the above-described effect, the lower limit of the Sn content needs to be 0.07 mass % or higher, preferably 0.10 mass % or higher, and more preferably 0.12 mass % or higher.

On the other hand, when the Sn content is higher than 0.28 mass %, the proportion of γ phase increases. As a countermeasure, it is necessary to metallographically increase κ phase by increasing Cu concentration. Therefore, higher impact resistance may not be obtained. The upper limit of the Sn content is 0.28 mass % or lower, preferably 0.27 mass % or lower, and more preferably 0.25 mass % or lower.

(Pb)

Addition of Pb improves the machinability of copper alloy. About 0.003 mass % of Pb is solid-solubilized in the matrix, and the amount of Pb in excess of 0.003 mass % is present in the form of Pb particles having a diameter of about 1 μm. Pb has an effect of improving machinability even with a small amount of addition. In particular, when the Pb content is higher than 0.02 mass %, a significant effect starts to be exhibited. In the alloy according to the embodiment, the proportion of γ phase having excellent machinability is limited to be 2.0% or lower. Therefore, a small amount of Pb works in place of γ phase.

Therefore, the lower limit of the Pb content is 0.022 mass % or higher, preferably 0.024 mass % or higher, and more preferably 0.025 mass % or higher. In particular, when the value of the metallographic structure relational expression f6 relating to machinability is lower than 32, it is preferable that the Pb content is 0.024 mass % or higher.

On the other hand, Pb is harmful to a human body and influences impact resistance and high-temperature strength. Therefore, the upper limit of the Pb content is 0.20 mass % or lower, preferably 0.15 mass % or lower, and most preferably 0.10 mass % or lower.

(P)

As in the case of Sn, P significantly improves dezincification corrosion resistance and stress corrosion cracking resistance, in particular, in a harsh environment.

As in the case of Sn, the amount of P distributed in κ phase is about 2 times the amount of P distributed in α phase. That is, the amount of P distributed in κ phase is about 2 times the amount of P distributed in α phase. In addition, p has a significant effect of improving the corrosion resistance of α phase. However, when P is added alone, the effect of improving the corrosion resistance of κ phase is low. However, in cases where P is present together with Sn, the corrosion resistance of κ phase can be improved. P scarcely improves the corrosion resistance of γ phase. In addition, P contained in κ phase slightly improves the machinability of κ phase. By adding P together with Sn, machinability can be more effectively improved.

In order to exhibit the above-described effects, the lower limit of the P content is 0.06 mass % or higher, preferably 0.065 mass % or higher, and more preferably 0.07 mass % or higher.

On the other hand, in cases where the P content is higher than 0.14 mass %, the effect of improving corrosion resistance is saturated. In addition, a compound of P and Si is more likely to be formed, impact resistance and ductility deteriorates, and machinability becomes adversely affected also. Therefore, the upper limit of the P content is 0.14 mass % or lower, preferably 0.13 mass % or lower, and more preferably 0.12 mass % or lower.

(Sb, As, Bi)

As in the case of P and Sn, Sb and As significantly improve dezincification corrosion resistance and stress corrosion cracking resistance, in particular, in a harsh environment.

In order to improve corrosion resistance by addition of Sb, it is necessary to add 0.02 mass % or higher of Sb. Sb content is preferably higher than 0.02 mass %, more preferably 0.03 mass % or more. On the other hand, even if Sb content is higher than 0.08 mass %, the effect of improving corrosion resistance is saturated, and the proportion of γ phase increases instead. Therefore, Sb content is 0.08 mass % or lower and preferably 0.07 mass % or lower.

In order to improve corrosion resistance due to addition of As, it is necessary to add 0.02 mass % or higher of As. As content is preferably higher than 0.02 mass %, more preferably 0.03 mass % or more. On the other hand, even if As content is higher than 0.08 mass %, the effect of improving corrosion resistance is saturated. Therefore, the As content is 0.08 mass % or lower and preferably 0.07 mass % or lower.

By adding Sb alone, the corrosion resistance of α phase is improved. Sb is a metal of low melting point although it has a higher melting point than Sn, and exhibits similar behavior to Sn. The amount of Sn distributed in γ phase or κ phase is larger than the amount of Sn distributed in α phase. By adding Sn together, Sb has an effect of improving the corrosion resistance of κ phase. However, regardless of whether Sb is added alone or added together with Sn and P, the effect of improving the corrosion resistance of γ phase is low. Rather, addition of an excessive amount of Sb may increase the proportion of γ phase.

Among Sn, P, Sb, and As, As strengthens the corrosion resistance of α phase. Even in cases where κ phase is corroded, the corrosion resistance of α phase is improved, and thus As functions to prevent α phase from corroding in a chain reaction. However, regardless of whether As is added alone or added together with Sn, P, and Sb, the effect of improving the corrosion resistance of κ phase and γ phase is low.

In cases where both Sb and As are added, even when the total content of Sb and As is higher than 0.10 mass %, the effect of improving corrosion resistance is saturated, and ductility and impact resistance deteriorate. Therefore, the total content of Sb and As is preferably 0.10 mass % or lower. Like Sn, Sb has an effect of improving the corrosion resistance of κ phase. Therefore, when the amount of [Sn]+0.7×[Sb] is higher than 0.12 mass %, the corrosion resistance of the alloy is further improved.

Bi further improves the machinability of the copper alloy. For Bi to exhibits the effect, it is necessary to add 0.02 mass % or higher of Bi, and it is preferable to add 0.025 mass % or higher of Bi. On the other hand, whether Bi is harmfulness to human body is uncertain However, considering the influence on impact resistance and high-temperature strength, the upper limit of the Bi content is 0.30 mass % or lower, preferably 0.20 mass % or lower, more preferably 0.10 mass % or lower.

(Inevitable Impurities)

Examples of the inevitable impurities in the embodiment include Al, Ni, Mg, Se, Te, Fe, Co, Ca, Zr, Cr, Ti, In, W, Mo, B, Ag, and rare earth elements.

Conventionally, a free-cutting copper alloy is not mainly formed of a good-quality raw material such as electrolytic copper or electrolytic zinc but is mainly formed of a recycled copper alloy. In a subsequent step (downstream step, machining step) of the related art, almost all the members and components are machined, and a large amount of copper alloy is wasted at a proportion of 40 to 80% in the process. Examples of the wasted copper alloy include chips, ends of an alloy material, burrs, runners, and products having manufacturing defects. This wasted copper alloy is the main raw material. When chips and the like are insufficiently separated, alloy becomes contaminated by Pb, Fe, Se, Te, Sn, P, Sb, As, Ca, Al, Zr, Ni, or rare earth elements of other free-cutting copper alloys. In addition, the cutting chips include Fe, W, Co, Mo, and the like that originate in tools. The wasted materials include plated product, and thus are contaminated with Ni and Cr. Mg, Fe, Cr, Ti, Co, In, and Ni are mixed into pure copper-based scrap. From the viewpoints of reuse of resources and costs, scrap such as chips including these elements is used as a raw material to the extent that such use does not have any adverse effects to the properties. Empirically speaking, a large part of Ni that is mixed into the alloy comes from the scrap and the like, and Ni may be contained in the amount lower than 0.06 mass %, but it is preferable if the content is lower than 0.05 mass %. Fe, Mn, Co, Cr, or the like forms an intermetallic compound with Si and, in some cases, forms an intermetallic compound with P and affect machinability. Therefore, each amount of Fe, Mn, Co, and Cr is preferably lower than 0.05 mass % and more preferably lower than 0.04 mass %. The total content of Fe, Mn, Co, and Cr is also preferably lower than 0.08 mass %, more preferably lower than 0.07 mass %, and still more preferably lower than 0.06 mass %. With respect to other elements such as Al, Mg, Se, Te, Ca, Zr, Ti, In, W, Mo, B, and rare earth elements, each amount is preferably lower than 0.02 mass % and more preferably lower than 0.01 mass %.

The amount of the rare earth elements refers to the total amount of one or more of Sc, Y, La, Ce, Pr, Nd, Pm, Sm, Eu, Gd, Tb, Dy, Ho, Er, Tm, Tb, and Lu.

Ag may be contained to a certain extent since Ag can be roughly regarded as Cu. It is preferable that the amount of Ag is less than 0.05 mass %.

(Composition Relational Expression f1)

The composition relational expression f1 is an expression indicating a relation between the composition and the metallographic structure. Even if the amount of each of the elements is in the above-described defined range, unless this composition relational expression f1 is satisfied, the properties that the embodiment targets cannot be obtained. In the composition relational expression f1, a large coefficient of −8.5 is assigned to Sn. When the value of the composition relational expression f1 is lower than 76.2, the proportion of γ phase increases, the long side of γ phase becomes longer, and corrosion resistance, impact resistance, and high temperature properties deteriorate, no matter how the manufacturing process is devised. Accordingly, the lower limit of the composition relational expression f1 is 76.2 or higher, preferably 76.4 or higher, more preferably 76.6 or higher, and still more preferably 76.8 or higher. The more preferable the value of the composition relational expression f1 is, the smaller the area ratio of γ phase is. Even in cases where γ phase is present, γ phase tends to break, and corrosion resistance, impact resistance, ductility, and high temperature properties further improve. When the value of the composition relational expression f1 is 76.6 or higher, elongated acicular κ phase comes to appear more clearly in α phase although it is affected by the manufacturing process, and machinability, wear resistance, and impact resistance are improved without causing deterioration in ductility.

On the other hand, the upper limit of the composition relational expression f1 mainly influences the proportion of κ phase. When the value of the composition relational expression f1 is higher than 80.3, the proportion of κ phase is excessively high from the viewpoints of ductility and impact resistance. In addition, μ phase is more likely to precipitate. When the proportion of κ phase or μ phase is excessively high, impact resistance, ductility, high temperature properties, and corrosion resistance deteriorate. In some cases, wear resistance also deteriorates. Accordingly, the upper limit of the composition relational expression f1 is 80.3 or lower, preferably 79.6 or lower, and more preferably 79.3 or lower.

This way, by defining the composition relational expression f1 to be in the above-described range, a copper alloy having excellent properties can be obtained. As, Sb, and Bi that are selective elements and the inevitable impurities that are separately defined scarcely affect the composition relational expression f1 because the contents thereof are low, and thus are not defined in the composition relational expression f1.

(Composition Relational Expression f2)

The composition relational expression f2 is an expression indicating a relation between the composition and workability, various properties, and the metallographic structure. When the composition relational expression f2 is lower than 61.2, the proportion of γ phase in the metallographic structure increases, and other metallic phases including β phase are more likely to appear and remain. Therefore, corrosion resistance, impact resistance, cold workability, and high temperature creep properties deteriorate. Accordingly, the lower limit of the composition relational expression f2 is 61.2 or higher, preferably 61.4 or higher, more preferably 61.6 or higher, and still more preferably 61.8 or higher.

On the other hand, when the value of the composition relational expression f2 is higher than 62.8, coarse α phase having a length of more than 300 μm and a width of more than 100 μm or coarse dendrites are more likely to appear. The length of a long side of γ phase present at a boundary between coarse α phase and κ phase or at a gap between dendrites increases, and the amount of acicular and elongated κ phase formed in α phase decreases. The presence of coarse α phase deteriorates machinability, strength, and wear resistance. When the amount of acicular and elongated κ phase formed in α phase is reduced, the degree of improvement in wear resistance and machinability declines. As the length of the long side of γ phase increases, corrosion resistance deteriorates. In addition, the solidification temperature range, that is, (liquidus temperature-solidus temperature) becomes higher than 40° C., shrinkage cavities and casting defects during casting become significant, and sound casting can no longer be obtained. The upper limit of the composition relational expression f2 is 62.8 or lower, preferably 62.6 or lower, and more preferably 62.4 or lower.

This way, by defining the composition relational expression f2 to be in the narrow range as described above, a copper alloy casting having excellent properties can be manufactured with a high yield. As, Sb, and Bi that are selective elements and the inevitable impurities that are separately defined scarcely affect the composition relational expression f2 because the contents thereof are low, and thus are not defined in the composition relational expression f2.

(Comparison to Patent Documents)

Here, the results of comparing the compositions of the Cu—Zn—Si alloys described in Patent Documents 3 to 9 and the composition of the alloy casting according to the embodiment are shown in Table 1.

The embodiment and Patent Document 3 are different from each other in the Pb content and the Sn content which is a selective element. The embodiment and Patent Document 4 are different from each other in the Sn content which is a selective element. The embodiment and Patent Document 5 are different from each other in the Pb content. The embodiment and Patent Documents 6 and 7 are different from each other as to whether or not Zr is added. The embodiment and Patent Document 8 are different from each other as to whether or not Fe is added. The embodiment and Patent Document 9 are different from each other as to whether or not Pb is added and also whether or not Fe, Ni, and Mn are added.

As described above, the alloy casting according to the embodiment and the Cu—Zn—Si alloys described in Patent Documents 3 to 9 are different from each other in the composition ranges.

TABLE 1

| | Cu | Si | Pb | Sn | P | Fe | Zr | Other Essential Elements |
|---|---|---|---|---|---|---|---|---|
| First Embodiment | 75.0-78.5 | 2.95-3.55 | 0.022-0.20 | 0.07-0.28 | 0.06-0.14 | — | — | |
| Second Embodiment | 75.5-77.8 | 3.1-3.4 | 0.024-0.15 | 0.10-0.27 | 0.06-0.13 | — | — | |
| Patent Document 3 | 69-79 | 2.0-4.0 | — | 0.3-3.5 | 0.02-0.25 | — | — | |
| Patent Document 4 | 69-79 | 2.0-4.0 | 0.02-0.4 | 0.3-3.5 | 0.02-0.25 | — | — | |
| Patent Document 5 | 71.5-78.5 | 2.0-4.5 | 0.005-0.02 | 0.1-1.2 | 0.01-0.2 | 0.5 or lower | — | |

TABLE 1-continued

| | Cu | Si | Pb | Sn | P | Fe | Zr | Other Essential Elements |
|---|---|---|---|---|---|---|---|---|
| Patent Document 6 | 69-88 | 2-5 | 0.004-0.45 | 0.1-2.5 | 0.01-0.25 | — | 5 ppm-400 ppm | |
| Patent Document 7 | 69-88 | 2-5 | 0.005-0.45 | 0.05-1.5 | 0.01-0.25 | 0.3 or lower | 5 ppm-400 ppm | |
| Patent Document 8 | 74.5-76.5 | 3.0-3.5 | 0.01-0.25 | 0.05-0.2 | 0.04-0.10 | 0.11-0.2 | — | |
| Patent Document 9 | 70-83 | 1-5 | — | 0.01-2 | 0.1 or lower | 0.01-0.3 | 0.5 or lower | Ni: 0.01-0.3 Mn: 0.01-0.3 |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between a phase having low corrosion resistance and a phase adjacent to such phase. In the case of Cu—Zn—Si alloys including three elements of Cu, Zn, and Si, for example, when corrosion resistances of α phase, α' phase, β phase (including β' phase), κ phase, γ phase (including γ' phase), and μ phase are compared, the ranking of corrosion resistance is: α phase>α' phase>κ phase>μ phase≥γ phase>β phase. The difference in corrosion resistance between κ phase and μ phase is particularly large.

Compositions of the respective phases vary depending on the composition of the alloy and the area ratios of the respective phases, and the following can be said.

With respect to the Si concentration of each phase, that of μ phase is the highest, followed by γ phase, κ phase, α phase, α' phase, and β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase.

The Cu concentration ranking is: μ phase>κ (phase≥α phase>α' phase≥γ phase>β phase from highest to lowest. The Cu concentration in μ phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, μ phase starts to corrode slightly later than or at the same time as γ phase. For example, when α phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase, or α phase or α' phase adjacent thereto to be corroded, and corrosion progresses in a chain reaction.

The water quality of drinking water varies across the world including Japan, and this water quality is becoming one where corrosion is more likely to occur to copper alloys. For example, the concentration of residual chlorine used for disinfection for the safety of human body is increasing although the upper limit of chlorine level is regulated. That is to say, the environment where copper alloys that compose water supply devices are used is becoming one in which alloys are more likely to be corroded. The same is true of corrosion resistance in a use environment where a variety of solutions are present, for example, those where component materials for automobiles, machines, and industrial plumbing described above are used.

On the other hand, even if the amount of γ phase, or the amounts of γ phase, μ phase, and β phase are controlled, that is, the proportions of the respective phases are significantly reduced or are made to be zero, the corrosion resistance of a Cu—Zn—Si alloy including two phases of α phase and κ phase is not perfect. Depending on the environment where corrosion occurs, κ phase having lower corrosion resistance than α phase may be selectively corroded, and it is necessary to improve the corrosion resistance of κ phase. Further, in cases where κ phase is corroded, the corroded κ phase becomes a corrosion product that is rich in Cu. This corrosion product causes α phase to be corroded, and thus it is also necessary to improve the corrosion resistance of α phase.

In addition, γ phase is a hard and brittle phase. Therefore, when a large load is applied to a copper alloy member, the γ phase microscopically becomes a stress concentration source. Therefore, γ phase makes the alloy more vulnerable to stress corrosion cracking, deteriorates impact resistance, and further deteriorates high-temperature strength (high temperature creep strength) due to a high-temperature creep phenomenon. μ phase is mainly present at a grain boundary of α phase or at a phase boundary between α phase and κ phase. Therefore, as in the case of γ phase, μ phase microscopically becomes a stress concentration source. Due to being a stress concentration source or a grain boundary sliding phenomenon, μ phase makes the alloy more vulnerable to stress corrosion cracking, deteriorates impact resistance, and deteriorates high-temperature strength. In some cases, the presence of μ phase deteriorates these properties more than γ phase.

However, if the proportion of γ phase or the proportions of γ phase and μ phase are significantly reduced or are made to be zero in order to improve corrosion resistance and the above-mentioned properties, satisfactory machinability may not be obtained merely by containing a small amount of Pb and three phases of α phase, α' phase, and κ phase. Therefore, providing that the alloy with a small amount of Pb has excellent machinability, it is necessary that constituent phases of a metallographic structure (metallic phases or crystalline phases) are defined as follows in order to improve corrosion resistance, ductility, impact resistance, strength, and high-temperature strength in a harsh use environment.

Hereinafter, the unit of the proportion of each of the phases is area ratio (area %).

(γ Phase)

γ phase is a phase that contributes most to the machinability of Cu—Zn—Si alloys. In order to improve corrosion resistance, strength, high temperature properties, and impact resistance in a harsh environment, it is necessary to limit γ phase. In order to improve corrosion resistance, it is necessary to add Sn, and addition of Sn further increases the proportion of γ phase. In order to obtain sufficient machinability and corrosion resistance at the same time when Sn has such contradicting effects, the Sn content, the P content, the composition relational expressions f1 and f2, metallographic structure relational expressions described below, and the manufacturing process are limited.

(β Phase and Other Phases)

In order to obtain excellent corrosion resistance and high ductility, impact resistance, strength, and high-temperature strength, the proportions of β phase, γ phase, μ phase, and other phases such as ζ phase in a metallographic structure are particularly important.

The proportion of β phase needs to be at least 0% to 0.3% and is preferably 0.1% or lower, and it is most preferable that β phase is not present. In particular, a casting is obtained by solidification of melt. Therefore, other phases including β phase are likely to be formed and are likely to remain.

The proportion of phases such as ζ phase other than α phase, κ phase, β phase, γ phase, and μ phase is preferably 0.3% or lower and more preferably 0.1% or lower. It is most preferable that the other phases such as ζ phase are not present.

First, in order to obtain excellent corrosion resistance, it is necessary that the proportion of γ phase is 0% to 2.0% and the length of the long side of γ phase is 50 μm or less.

The length of the long side of γ phase is measured using the following method. Using a metallographic micrograph of, for example, 500-fold or 1000-fold, the maximum length of the long side of γ phase is measured in one visual field. This operation is performed in a plurality of visual fields, for example, five arbitrarily chosen visual fields as described below. The average maximum length of the long side of γ phase calculated from the lengths measured in the respective visual fields is regarded as the length of the long side of γ phase. Therefore, the length of the long side of γ phase can be referred to as the maximum length of the long side of γ phase.

Here, the proportion of γ phase is preferably 1.2% or lower, more preferably 0.8% or lower, and most preferably 0.5% or lower. For example, in cases where the Pb content is 0.03 mass % or lower or the proportion of κ phase is 33% or lower, machinability can be better improved if the amount of γ phase is 0.05% or higher and lower than 0.5% because the properties such as corrosion resistance and machinability will be less affected although depending on the Pb content or the proportion of κ phase.

Since the length of the long side of γ phase affects corrosion resistance, high temperature properties, and impact resistance, the length of the long side of γ phase is 50 μm or less, preferably 40 μm or less, and most preferably 30 μm or less.

As the amount of γ phase increases, γ phase is more likely to be selectively corroded. In addition, the longer the lengths of γ phase and a series of γ phases are, the more likely γ phase is to be selectively corroded, and the progress of corrosion in the direction away from the surface is accelerated. In addition, the larger the corroded portion is, the more affected the corrosion resistance of α phase or α' phase present around the corroded γ phase, or the corrosion resistance of κ phase is. In addition, γ phase tends to be present at a phase boundary, a gap between dendrites, or a grain boundary. If the length of the long side of γ phase is long, high temperature properties and impact resistance are affected. In particular, in a casting step of a casting, a continuous change from melt to solid occurs. Therefore, in castings, γ phase is present to be elongated mainly around a phase boundary or a gap between dendrites, the size of crystal grains of α phase is larger than that of a hot worked material, and γ phase is likely to be present at a boundary between α phase and κ phase.

The proportion of γ phase and the length of the long side of γ phase are closely related to the contents of Cu, Sn, and Si and the composition relational expressions f1 and f2.

As the proportion of γ phase increases, ductility, impact resistance, high-temperature strength, and stress corrosion cracking resistance deteriorate. Therefore, the proportion of γ phase needs to be 2.0% or lower, is preferably 1.2% or lower, more preferably 0.8% or lower, and most preferably 0.5% or lower. γ phase present in a metallographic structure becomes a stress concentration source when put under high stress. In addition, crystal structure of γ phase is BCC, which is also a cause of deterioration in high-temperature strength, impact resistance, and stress corrosion cracking resistance. However, when the proportion of κ phase is 30% or lower, there is a little problem in machinability, and about 0.1% of γ phase (an amount of γ phase which does not affect corrosion resistance, impact resistance, ductility, and high-temperature strength) may be present. In addition, presence of 0.05% to 1.2% of γ phase improves wear resistance.

(μ Phase)

μ phase is effective to improve machinability and affects corrosion resistance, ductility, impact resistance, and high temperature properties. Therefore, it is necessary that the proportion of μ phase is at least 0% to 2.0%. The proportion of μ phase is preferably 1.0% or lower and more preferably 0.3% or lower, and it is most preferable that μ phase is not present. μ phase is mainly present at a grain boundary or a phase boundary. Therefore, in a harsh environment, grain boundary corrosion occurs at a grain boundary where μ phase is present. In addition, when impact is applied, cracks are more likely to develop from hard μ phase present at a grain boundary. In addition, for example, when a copper alloy casting is used in a valve used around the engine of a vehicle or in a high-temperature, high-pressure gas valve, if the copper alloy casting is held at a high temperature of 150° C. for a long period of time, grain boundary sliding occurs, and creep is more likely to occur. Likewise, if μ phase is present at a grain boundary or phase boundary, impact resistance tremendously deteriorates. Therefore, it is necessary to limit the amount of β phase, and at the same time limit the length of the long side of μ phase that is mainly present at a grain boundary to 25 μm or less. The length of the long side of μ phase is preferably 15 μm or less, more preferably 5 μm or less, still more preferably 4 μm or less, and most preferably 2 μm or less.

The length of the long side of μ phase is measured using the same method as the method of measuring the length of the long side of γ phase. That is, by using, for example, a 500-fold or 1000-fold metallographic micrograph or using a 2000-fold or 5000-fold secondary electron micrograph (electron micrograph) according to the size of β phase, the maximum length of the long side of μ phase in one visual field is measured. This operation is performed in a plurality of visual fields, for example, five arbitrarily chosen visual fields. The average maximum length of the long sides of μ phase calculated from the lengths measured in the respective visual fields is regarded as the length of the long side of μ phase. Therefore, the length of the long side of γ phase can be referred to as the maximum length of the long side of μ phase.

(κ Phase)

Under recent high-speed machining conditions, the machinability of a material including cutting resistance and chip dischargeability is important. However, in order to obtain excellent machinability when the proportion of γ phase which has the highest machinability improvement function is limited to be 2.0% or lower, it is necessary that the proportion of κ phase is at least 25% or higher. The proportion of κ phase is preferably 30% or higher, and more preferably 33% or higher. In addition, when the proportion of κ phase is the necessary minimum amount for obtaining satisfy machinability, the material exhibits excellent ductility and impact resistance, and good corrosion resistance, high temperature properties, and wear resistance.

As hard κ phase increases, machinability and strength improve. However, on the other hand, as the proportion of κ phase increases, ductility and impact resistance gradually deteriorate. When the proportion of κ phase reaches a certain level, the effect of improving machinability is saturated, and as the proportion of κ phase further increases, machinability deteriorates instead of improves, and wear resistance also deteriorates. Considering ductility, impact resistance, machinability, and wear resistance, it is necessary that the proportion of κ phase is 65% or lower. That is, it is necessary that the proportion of κ phase in a metallographic structure is ⅔ or lower. The proportion of κ phase is preferably 56% or lower, and more preferably 52% or lower.

In order to obtain excellent machinability in a state where the area ratio of γ phase having excellent machinability is limited to be 2.0% or lower, it is necessary to improve the machinability of κ phase and α phase themselves. That is, the machinability of κ phase itself is improved if Sn and P are contained in κ phase. Further, by making acicular κ phase to be present in α phase, the machinability, wear resistance, and strength of a phase further improve, and in turn, the machinability of the alloy is improved without significant deterioration in ductility. It is most preferable that the proportion of κ phase in a metallographic structure is about 33% to about 52% from the viewpoints of obtaining ductility, strength, impact resistance, corrosion resistance, high temperature properties, machinability, and wear resistance.

(Presence of Elongated Acicular κ Phase (κ1 phase) in α Phase)

When the above-described requirements of the composition, the composition relational expressions, and the process are satisfied, thin, elongated, and acicular κ phase (κ1 phase) starts to appear in α phase. This κ1 phase is harder than α phase. In addition, the thickness of κ phase (κ1 phase) in α phase is about 0.1 μm to about 0.2 μm (about 0.05 μm to about 0.5 μm), and this κ phase (κ1 phase) is thin.

Due to the presence of the κ1 phase in α phase, the following effects are obtained.

1) α phase is strengthened, and the strength of the alloy is improved.

2) The machinability of α phase itself is improved, and machinability such as cutting resistance or chip partibility is improved.

3) Since κ1 phase is present in α phase, there is no adverse effect on corrosion resistance.

4) α phase is strengthened, and wear resistance is improved.

The acicular κ phase present in α phase is affected by a constituent element such as Cu, Zn, or Si or a relational expression. In particular, when the Si content is about 2.95% or higher, the acicular κ phase (κ1 phase) starts to be present in α phase. When the Si content is about 3.1% or higher, a more significant amount of κ1 phase is present in α phase. When value of the composition relational expression f2 is 62.8 or lower and further 62.6 or lower, κ1 phase is more likely to be present.

The elongated and thin κ phase (κ1 phase) precipitated in α phase can be observed using a metallographic microscope at a magnification of about 500-fold or 1000-fold. However, since it is difficult to calculate the area ratio of κ 1 phase, it should be noted that the area ratio of κ1 phase in α phase is included in the area ratio of α phase.

(Metallographic Structure Relational Expressions f3, f4, f5, and f6)

In addition, in order to obtain excellent corrosion resistance, impact resistance, high-temperature strength, and wear resistance, it is necessary that the total proportions of α phase and κ phase (the value of metallographic structure relational expression f3=(α)+(κ)) is 96.5% or higher. The value of f3 is preferably 98.0% or higher, more preferably 98.5% or higher, and most preferably 99.0% or higher. Likewise, the total proportion of α phase, κ phase, γ phase, and μ phase (the value of metallographic structure relational expression f4=(α)+(κ)+(γ)+(μ)) needs to be 99.2% or higher and is most preferably 99.5% or higher.

Further, it is necessary that the total proportion of γ phase and μ phase (f5=(γ)+(μ) is 0% to 3.0%. The value of f5 is preferably 1.5% or lower, more preferably 1.0% or lower, and most preferably 0.5% or lower. However, when the proportion of κ phase is low, there is a little problem in machinability. Therefore, γ phase may be added in an amount which scarcely affects impact resistance like 0.1% to 0.5%.

The metallographic structure relational expressions f3 to f6 are directed to 10 kinds of metallic phases including α phase, β phase, γ phase, δ phase, ε phase, ζ phase, η phase, κ phase, μ phase, and χ phase, and are not directed to intermetallic compounds, Pb particles, oxides, non-metallic inclusion, non-melted materials, and the like. In addition, acicular κ phase present in α phase is included in α phase, and μ phase that cannot be observed with a metallographic microscope is excluded. Intermetallic compounds that are formed by Si, P, and elements that are inevitably mixed in (for example, Fe, Co, and Mn) are excluded from the area ratio calculation of metallic phase. However, these intermetallic compounds affect machinability, and thus it is necessary to pay attention to the inevitable impurities.

(Metallographic Structure Relational Expression f6)

In the alloy casting according to the embodiment, it is necessary that machinability is excellent while minimizing the Pb content in the Cu—Zn—Si alloy, and it is necessary that the alloy has particularly excellent corrosion resistance, impact resistance, ductility, normal-temperature strength, and high-temperature strength. However, γ phase improves machinability, but for obtaining excellent corrosion resistance and impact resistance, presence of γ phase has an adverse effect.

Metallographically, it is preferable to contain a large amount of γ phase having the highest machinability. However, from the viewpoints of corrosion resistance, impact resistance, and other properties, it is necessary to reduce the amount of γ phase. It was found from experiment results that, when the proportion of γ phase is 2.0% or lower, it is necessary that the value of the metallographic structure relational expression f6 is in an appropriate range in order to obtain excellent machinability.

γ phase has the highest machinability. However, in particular, when the amount of γ phase is small, that is, when the area ratio of γ phase is 2.0% or lower, a coefficient that is six times the proportion of κ phase ((κ)) is assigned to the square root value of the proportion of γ phase ((γ) (%)). In order to obtain excellent machinability, it is necessary that the value of the metallographic structure relational expression f6 is 29 or higher. The value of f6 is preferably 32 or higher and more preferably 35 or higher. When the value of the metallographic structure relational expression f6 is 28 to 32, in order to obtain excellent machinability, it is preferable that the Pb content is 0.024 mass % or higher or the amount of Sn in κ phase is 0.11 mass % or higher.

On the other hand, when the value of the metallographic structure relational expression f6 is higher than 66, machinability deteriorates, and deterioration of impact resistance and ductility becomes more evident. Therefore, it is necessary that the value of the metallographic structure relational expression f6 is 66 or lower. The value of f6 is preferably 58 or lower and more preferably 55 or lower.

(Amounts of Sn and P in κ phase)

In order to improve the corrosion resistance of κ phase, it is preferable if the alloy casting contains 0.07 mass % to 0.28 mass % of Sn and 0.06 mass % to 0.14 mass % of P.

In the alloy according to the embodiment, when the Sn content is 0.07 to 0.28 mass % and the amount of Sn distributed in α phase is 1, the amount of Sn distributed in κ phase is about 1.4, the amount of Sn distributed in γ phase is about 10 to about 15, and the amount of Sn distributed in μ phase is about 2 to about 3. By devising the manufacturing process, the amount of Sn distributed in γ phase can be reduced to be about 10 times the amount of Sn distributed in α phase. For example, in the case of the alloy according to the embodiment, in a Cu—Zn—Si—Sn alloy including 0.2 mass % of Sn, when the proportion of α phase is 50%, the proportion of κ phase is 49%, and the proportion of γ phase is 1%, the Sn concentration in α phase is about 0.15 mass %, the Sn concentration in κ phase is about 0.22 mass %, and the Sn concentration in γ phase is about 1.5-2.2 mass %. When the area ratio of γ phase is high, the amount of Sn consumed by γ phase is large, and the amounts of Sn distributed in κ phase and α phase are small. Accordingly, if the amount of γ phase is small, Sn is effectively used for corrosion resistance and machinability as described below.

On the other hand, assuming that the amount of P distributed in α phase is 1, the amount of P distributed in κ phase is about 2, the amount of P distributed in γ phase is about 3, and the amount of P distributed in μ phase is about 4. For example, in the case of the alloy according to the embodiment, in a Cu—Zn—Si alloy including 0.1 mass % of P, when the proportion of α phase is 50%, the proportion of κ phase is 49%, and the proportion of γ phase is 1%, the P concentration in α phase is about 0.06 mass %, the P concentration in κ phase is about 0.12 mass %, and the P concentration in γ phase is about 0.18 mass %.

Both Sn and P improve the corrosion resistance of α phase and κ phase, and the amount of Sn and the amount of P in κ phase are about 1.4 times and about 2 times the amount of Sn and the amount of P in α phase, respectively. That is, the amount of Sn in κ phase is about 1.4 times the amount of Sn in α phase, and the amount of P in κ phase is about 2 times the amount of P in α phase. Therefore, the degree of corrosion resistance improvement of κ phase is higher than that of α phase. As a result, the corrosion resistance of κ phase approaches the corrosion resistance of α phase. By adding both Sn and P, in particular, the corrosion resistance of κ phase can be improved. However, even though there is a difference in content, the contribution of Sn to corrosion resistance is higher than that of P.

When the Sn content is lower than 0.07 mass %, the corrosion resistance and dezincification corrosion resistance of κ phase are lower than the corrosion resistance and dezincification corrosion resistance of α phase. Therefore, when used in water of bad quality, κ phase is selectively corroded. Due to a large amount of Sn being distributed to κ phase, corrosion resistance of κ phase, which is lower than the corrosion resistance of α phase, improves, and when κ phase contains a certain concentration of Sn (or higher than that), the corrosion resistance of κ phase and that of α phase narrow. When Sn is contained in κ phase, machinability and wear resistance of κ phase also improve. To that end, the Sn concentration in κ phase is preferably 0.08 mass % or higher, more preferably 0.11 mass % or higher, and still more preferably 0.14 mass % or higher.

On the other hand, a large amount of Sn is distributed in γ phase. However, even if a large amount of Sn is contained in γ phase, the corrosion resistance of γ phase scarcely improves mainly because the crystal structure of γ phase is a BCC structure. On the contrary, if the proportion of γ phase is high, the corrosion resistance of κ phase scarcely improves because the amount of Sn distributed in κ phase is small. If the proportion of γ phase is reduced, the amount of Sn distributed in κ phase increases. When a large amount of Sn is distributed in κ phase, the corrosion resistance and machinability of κ phase are improved, and the loss of the machinability of γ phase can be compensated for by that. It is presumed that, by having a predetermined amount or more of Sn in κ phase, the machinability improvement function of κ phase itself and chip partibility are improved. However, even though the machinability of the alloy improves when the Sn concentration in κ phase is higher than 0.40 mass %, the toughness of κ phase starts to deteriorate. If a higher importance is placed on toughness, the upper limit of the Sn concentration in κ phase is 0.40 mass % or lower, and is preferably 0.36 mass % or lower.

On the other hand, as the Sn content increases, it becomes difficult to reduce the amount of γ phase due to a relation between Sn content and contents of other elements such as Cu or Si. In order to adjust the proportion of γ phase to be 2.0% or lower or 1.2% or lower, and further 0.8% or lower, the Sn content in the alloy casting needs to be 0.28 mass % or lower and preferably 0.27 mass % or lower.

As in the case of Sn, when a large amount of P is distributed in κ phase, corrosion resistance is improved, and the machinability of κ phase is also improved. However, when an excessive amount of P is added, P is consumed by formation of an intermetallic compound with Si such that the properties deteriorate, or if excessively solid-solubilized, impact resistance and ductility are impaired. The lower limit of the P concentration in κ phase is preferably 0.07 mass % or higher and more preferably 0.08 mass % or higher. The upper limit of the P concentration in κ phase is preferably 0.22 mass % or lower, more preferably 0.20 mass % or lower, and still more preferably 0.16 mass % or lower.

<Properties>

(Normal-Temperature Strength and High-Temperature Strength)

As strength required in various fields such as valves and devices for drinking water and automobiles, tensile strength that is breaking stress applied to pressure vessel is being made much of. In addition, for example, a valve used in an environment close to the engine room of a vehicle or a high-temperature and high-pressure valve is used in a temperature environment of 150° C. at a maximum. Regarding the high-temperature strength, it is preferable that a creep strain after holding the copper alloy casting at 150° C. for 100 hours in a state where a stress corresponding to 0.2% proof stress at room temperature is applied is 0.4% or lower. This creep strain is more preferably 0.3% or lower and still more preferably 0.2% or lower. In this case, even if the copper alloy casting is exposed to a high temperature as in the case of, for example, a high-temperature high-pressure valve or a valve used close to the engine room of a vehicle, deformation is not likely to occur, and high-temperature strength is excellent.

Incidentally, in the case of free-cutting brass including 60 mass % of Cu, 3 mass % of Pb with a balance including Zn and inevitable impurities, the creep strain after the alloy is exposed to 150° C. for 100 hours in a state where a stress corresponding to 0.2% proof stress at room temperature is applied is about 4% to 5%. Therefore, the creep strength (heat resistance) of the alloy casting according to the embodiment is higher than that of conventional free-cutting brass including Pb.

(Impact Resistance)

In general, in a casting, component segregation is more likely to occur a0s compared to a material having undergone hot working, for example, a hot extruded rod, the crystal grain size is large, and some microscopic defects are present. Therefore, a casting is said to be "brittle" or "weak", and is desired to have a high impact value which is a yardstick of toughness. Further, due to an unique problem of a casting such as microscopic defects, it is necessary to adopt a high safety factor. On the other hand, in terms of machinability, it is said that some kind of brittleness is necessary for a material having excellent chip partibility. Impact resistance is a property that is contrary to machinability or strength in some aspect.

If the casting is for use in various members including drinking water devices such as valves or fittings, automobile components, mechanical components, and industrial plumbing components, the casting needs to be a material having not only high corrosion resistance, wear resistance, and strength, but also toughness that is sufficient to resist impact. As described above, in the case of a casting, a higher level of impact resistance is required than a hot worked material in consideration of reliability. Specifically, when a Charpy impact test is performed using a U-notched specimen, the resultant Charpy impact test value is preferably 23 J/cm$^2$ or higher, more preferably 27 J/cm$^2$ or higher, and still more preferably 30 J/cm$^2$ or higher. On the other hand, a thin rod of about 20 mm or less in diameter having undergone hot extrusion and drawing is very straight and therefore is suitable for precision machining. As compared to this thin rod having undergone hot extrusion and drawing, a highest level of machinability is not required for a casting. Even if application of a casting is taken into consideration, its Charpy impact test value does not need to exceed 60 J/cm$^2$. If the Charpy impact test value is higher than 60 J/cm$^2$, so-called stickiness of the material increases causing deterioration in machinability (higher cutting resistance, likeliness of generating unseparated chips, etc.). Where machinability is important, a Charpy impact test value of a U-notched specimen is preferably lower than 60 J/cm$^2$, more preferably lower than 55 J/cm$^2$ or higher, and still more preferably lower than 50 J/cm$^2$.

Impact resistance has a close relation with a metallographic structure, and γ phase deteriorates impact resistance. In addition, if μ phase is present at a grain boundary of α phase or a phase boundary between α phase, κ phase, and γ phase, the grain boundary and the phase boundary is embrittled, and impact resistance deteriorates.

As a result of a study, it was found that if μ phase having the length of the long side of more than 25 μm is present at a grain boundary or a phase boundary, impact resistance particularly deteriorates. Therefore, the length of the long side of μ phase present is 25 μm or less, preferably 15 μm or less, more preferably 5 μm or less, and most preferably 2 μm or less. In addition, in a harsh environment, μ phase present at a grain boundary is more likely to corrode than α phase or κ phase, thus causes grain boundary corrosion and deteriorate properties under high temperature.

In the case of μ phase, if the occupancy ratio is low and the length is short and the width is narrow, it is difficult to detect the μ phase using a metallographic microscope at a magnification of about 500-fold or 1000-fold. When observing μ phase whose length is 5 μm or less, the μ phase may be observed at a grain boundary or a phase boundary using an electron microscope at a magnification of about 2000-fold or 5000-fold, μ phase can be found at a grain boundary or a phase boundary.

(Wear Resistance)

Wear resistance is required if a copper alloy is used for something that comes in contact with another piece of metal. Representative examples of such application include a bearing. As a criterion to determine whether wear resistance is good or bad, abrasion loss of a copper alloy having good wear resistance is small. However, it is equally or more important that the copper alloy does not damage stainless steel, which is a representative type of steel (raw material) used for a shaft, that is, a component that comes in contact with a copper alloy component.

Accordingly, first, it is effective to strengthen α phase that is the softest phase. α phase is strengthened by increasing the amount of acicular κ phase in α phase and distributing a large amount of Sn in α phase. The strengthening of α phase has good effects on other various properties such as corrosion resistance, wear resistance, and machinability. κ phase is a phase that is important in wear resistance. However, as the proportion of κ phase increases and as the amount of Sn in κ phase increases, the hardness increases, the impact value decreases, and brittleness becomes significant. In some cases, the contacting material may be damaged. The proportion of soft α phase and the proportion of κ phase that is harder than α phase are important. When the proportion of κ phase is 30% to 50%, κ phase and α phase are well-balanced. The amount of γ phase that is harder than κ phase is further limited. Although the balance with the amount of κ phase should be taken into consideration, when the amount of γ phase is small, for example, 1.2% or less, the abrasion loss of the copper alloy material decreases, and the contacting material will not be damaged.

<Manufacturing Process>

Next, the method of manufacturing the free-cutting copper alloy casting according to the first or second embodiment of the present application is described below.

The metallographic structure of the alloy casting according to the embodiment varies not only depending on the composition but also depending on the manufacturing process. The metallographic structure of the alloy casting is affected not only by the average cooling rate in the process of cooling after melting and casting. Alternatively, in the case a casting is cooled to lower than 380° C. or to a normal temperature and subsequently a heat treatment is performed thereon under appropriate temperature conditions, the metallographic structure of the alloy casting is affected by the cooling rate in this process of cooling after the heat treatment. As a result of a thorough study, it was found that various properties are significantly affected by the cooling rate in a temperature range from 575° C. to 510° C., in particular, from 570° C. to 530° C., and the cooling rate in a temperature range from 470° C. to 380° C. in the process of cooling after casting or in the process of cooling after the heat treatment of the casting.

(Melt Casting)

Melting is performed at a temperature of about 950° C. to about 1200° C. that is higher than the melting point (liquidus temperature) of the alloy according to the embodiment by about 100° C. to about 300° C. Although depending on the shape of the casting or the runner or the kind of a mold, casting (molding) is performed at about 900° C. to about 1100° C. that is higher than the melting point by about 50° C. to about 200° C. Melt (molten alloy) is cast into a predetermined mold such as a sand mold, a metal mold, or a lost wax and is cooled by some cooling means such as air cooling, slow cooling, or water cooling. After solidification, constituent phase(s) changes in various ways.

(Casting (Molding))

The cooling rate after casting varies depending on the weight of a cast copper alloy and the volume and material of a sand mold or a metal mold. For example, in general, when a conventional copper alloy casting is obtained by casting in a metal mold formed of a copper alloy or an iron alloy, the casting is removed from the mold at a temperature of about 700° C. or about 600° C. or lower in consideration of productivity after solidification and then is air-cooled. Although depending on the size of the casting, the casting is cooled to 100° C. or lower or to a normal temperature at a cooling rate of about 10° C./min to about 60° C./min. On the other hand, various kinds of sand are used for sand molds. Although depending on the size of the casting and the material and size of the sand mold, the copper alloy cast into the sand mold is cooled to about 250° C. or lower at a cooling rate of about 0.2° C./min to 5° C./min in the mold. Next, the casting is removed from the sand mold and is air-cooled. At the temperature of 250° C. or lower, the casting is easy to handle, and Pb and Bi included in the copper alloy at a level of several % completely solidify. Irrespective of whether cooling in the mold or air-cooling is performed, the cooling rate at around 550° C. is higher than that at 400° C. For example, the cooling rate at about 550° C. is about 1.3 times to 2 times the cooling rate at 400° C.

In the copper alloy casting according to the embodiment, the metallographic structure in a solidified state after casting, for example, in a high-temperature state of 800° C. is rich in β phase. During subsequent cooling, various phases such as γ phase or κ phase are produced and formed. Of course, in the case the cooling rate is high, β phase or γ phase remains.

During cooling, the casting is cooled in a temperature range from 575° C. to 510° C., in particular, in a temperature range from 570° C. to 530° C. at an average cooling rate of 0.1° C./min to 2.5° C./min. As a result, β phase can be completely removed, and γ phase can be significantly reduced. Further, the casting is cooled in a temperature range from 470° C. to 380° C. at an average cooling rate of at least higher than 2.5° C./min and lower than 500° C./min, preferably 4° C./min or higher and more preferably 8° C./min or higher. As a result, an increase in the amount of μ phase is prevented. This way, by controlling the cooling rate in a temperature range from 510° C. to 470° C. against the laws of nature, a more desirable metallographic structure can be obtained.

Extruded material is not a casting, but most of extruded materials are made of brass alloys including 1 to 4 mass % of Pb. Typically, this brass alloy including 1 to 4 mass % of Pb is wound into a coil after hot extrusion unless the diameter of the extruded material exceeds, for example, about 38 mm. The heat of the ingot (billet) during extrusion is taken by an extrusion device such that the temperature of the ingot decreases. The extruded material comes into contact with a winding device such that heat is taken and the temperature further decreases. A temperature decrease of 50° C. to 100° C. from the temperature of the ingot at the start of the extrusion or from the temperature of the extruded material occurs when the average cooling rate is relatively high. Although depending on the weight of the coil and the like, the wound coil is cooled in a temperature range from 470° C. to 380° C. at a relatively low average cooling rate of about 2° C./min due to a heat keeping effect. After the material's temperature reaches about 300° C., the average cooling rate further declines. Therefore, water cooling is sometimes performed to facilitate the production. In the case of a brass alloy including Pb, hot extrusion is performed at about 600° C. to 800° C. In the metallographic structure immediately after extrusion, a large amount of β phase having excellent hot workability is present. When the average cooling rate after extrusion is high, a large amount of β phase remains in the cooled metallographic structure such that corrosion resistance, ductility, impact resistance, and high temperature properties deteriorate. In order to avoid the deterioration, by cooling at a relatively low average cooling rate using the heat keeping effect of the extruded coil and the like, β phase is made to transform into α phase so that the metallographic structure has abundant α phase is obtained. As described above, the average cooling rate of the extruded material is relatively high immediately after extrusion. Therefore, by performing subsequent cooling at a lower cooling rate, a metallographic structure that is rich in α phase is obtained. Patent Document 1 does not describe the average cooling rate but discloses that, in order to reduce the amount of β phase and to isolate β phase, slow cooling is performed until the temperature of an extruded material is 180° C. lower. Cooling is performed at a cooling rate that is completely different from that of the method of manufacturing the alloy according to the embodiment.

(Heat Treatment)

In general, heat treatment is not performed on copper alloy castings. In rare cases, in order to reduce residual stress of the casting, low-temperature annealing is performed at 250° C. to 400° C. Heat treatment can be performed as a means for obtaining a casting having desired properties of the embodiment, that is, for obtaining a desired metallographic structure. After casting, the casting is cooled to lower than 380° C. including normal temperature. Next, a heat treatment is performed on the casting in a batch furnace or a continuous furnace at a predetermined temperature.

In the case of a hot worked material of a brass alloy including Pb which is not a casting, a heat treatment is optionally performed. In the case of the brass alloy including Bi disclosed in Patent Document 1, a heat treatment is performed under conditions of 350° C. to 550° C. and 1 to 8 hours.

In the case a heat treatment is performed on the alloy casting according to the embodiment in a batch annealing furnace by holding the alloy casting at a temperature of 510° C. to 575° C. for 20 minutes to 8 hours, corrosion resistance, impact resistance, and high temperature properties are improved. In the case a heat treatment is performed under a condition where the material temperature is higher than 620° C., a large amount of γ phase or β phase is formed, and α phase is coarsened. As a heat treatment condition, a heat treatment is performed at preferably 575° C. or lower and more preferably 570° C. or lower. In the case a heat treatment is performed at a temperature of lower than 510° C., a reduction in the amount of γ phase is small, and μ phase appears. Accordingly, a heat treatment is performed at 510° C. or higher and more preferably 530° C. or higher. Regarding the heat treatment time, it is necessary to hold the casting at a temperature of 510° C. to 575° C. for at least 20 minutes or longer. The holding time contributes to a reduction in the amount of γ phase. Therefore, the holding time is preferably 30 minutes or longer, more preferably 50 minutes or longer, and most preferably 80 minutes or longer. The upper limit of the holding time is 480 minutes or shorter and preferably 240 minutes or shorter from the viewpoint of economic efficiency. The heat treatment temperature is preferably 530° C. to 570° C. In the case a heat treatment is performed at 510° C. or higher and lower than 530° C., in order to reduce the amount of γ phase, it is necessary that the heat treatment time is two times or three times or more that in the case a heat treatment is performed at 530° C. to 570° C.

Incidentally, when the heat treatment time in a temperature range of 510° C. to 575° C. is represented by t (min) and the heat treatment temperature is represented by T (° C.), the following heat treatment index f7 is preferably 800 or higher and more preferably 1200 or higher.

$$f7=(T-500)\times t \qquad \text{Heat Treatment Index}$$

Note that when T is 540° C. or higher, T is set as 540.

Examples of another heat treatment method include a continuous heat treatment furnace in which the casting is moved in a heat source. In the case a heat treatment is performed using the continuous heat treatment furnace, the above-described problem occurs at higher than 620° C. The material temperature is increased to be 550° C. to 620° C., and subsequently cooling is performed in a temperature range of 510° C. to 575° C. at an average cooling rate of 0.1° C./min to 2.5° C./min. This cooling condition is a condition corresponding to holding the casting in a temperature range of 510° C. to 575° C. for 20 minutes or longer. In simple calculation, the material is heated at a temperature of 510° C. to 575° C. for 26 minutes. Due to this heat treatment condition, the metallographic structure can be improved. The average cooling rate in a temperature range of 510° C. to 575° C. is preferably 2° C./min or lower, more preferably 1.5° C./min or lower, and still more preferably 1° C./min or lower. The lower limit of the average cooling rate is set to be 0.1° C./min or higher in consideration of economic efficiency.

Of course, the temperature is not necessarily set to be 575° C. or higher. For example, in the case the maximum reaching temperature is 540° C., cooling may be performed in a temperature range from 540° C. to 510° C. for at least 20 minutes. Preferably, cooling is performed under a condition where the value of (T−500)×t (heat treatment index f7) is 800 or higher. In the case the temperature is 550° C. or higher, by increasing the temperature to be a slightly higher temperature, the productivity can be secured, and a desired metallographic structure can be obtained.

A cooling rate after the end of the heat treatment is also important. Finally, the casting is cooled to normal temperature. In this case, it is necessary that the casting is cooled in a temperature range from 470° C. to 380° C. at an average cooling rate of higher than 2.5° C./min and lower than 500° C./min. The average cooling rate in a temperature range from 470° C. to 380° C. is preferably 4° C./min or higher and more preferably 8° C./min or higher. As a result, an increase in the amount of μ phase is prevented. That is, from about 500° C., it is necessary to adjust the average cooling rate to be high. In general, during cooling in the heat treatment furnace, the average cooling rate is low at a lower temperature.

The control of the cooling rate after casting and the heat treatment are advantageous not only in improving corrosion resistance but also in improving high temperature properties, impact resistance, and wear resistance. In the metallographic structure, the amount of the hardest γ phase is reduced, the amount of κ phase having appropriate ductility is increased, and acicular κ phase is present in α phase such that α phase is strengthened.

By adopting the above-described manufacturing process, the alloy according to the embodiment having not only excellent corrosion resistance but also excellent impact resistance, wear resistance, ductility, and strength can be prepared without deterioration in machinability.

In the case the heat treatment is performed, the cooling rate after cast is not limited to the above-described condition.

Regarding the metallographic structure of the alloy casting according to the embodiment, one important thing in the manufacturing step is the average cooling rate in a temperature range from 470° C. to 380° C. in the process of cooling after casting or after the heat treatment. In the case the average cooling rate is lower than 2.5° C./min, the proportion of μ phase increases. μ phase is mainly formed around a grain boundary or a phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high temperature creep strength deteriorates. The average cooling rate in a temperature range from 470° C. to 380° C. is higher than 2.5° C./min, preferably 4° C./min or higher, more preferably 8° C./min or higher, and still more preferably 12° C./min or higher. In the case the average cooling rate is high, residual stress is generated from the casting. Therefore, the upper limit is necessarily lower than 500° C./min and more preferably 300° C./min or lower.

When the metallographic structure is observed using a 2000-fold or 5000-fold electron microscope, it can be seen that the average cooling rate in a temperature range from 470° C. to 380° C., which decides whether μ phase appears or not, is about 8° C./min. In particular, the critical average cooling rate that significantly affects the properties is 2.5° C./min, 4° C./min, or further 5° C./min in a temperature range from 470° C. to 380° C. Of course, whether or not μ phase appears depends on the metallographic structure as well. If the amount of α phase is large, μ phase is more likely to appear at a grain boundary of α phase. In the case the average cooling rate in a temperature range from 470° C. to 380° C. is lower than 8° C./min, the length of the long side of μ phase precipitated at a grain boundary is higher than about 1 μm, and μ phase further grows as the average cooling rate becomes lower. When the average cooling rate is about 5° C./min, the length of the long side of μ phase is about 3 μm to 10 μm. When the average cooling rate is about 2.5° C./min or lower, the length of the long side of p phase is higher than 15 μm and, in some cases, is higher than 25 μm. When the length of the long side of μ phase reaches about 10 μm, μ phase can be distinguished from a grain boundary and can be observed using a 1000-fold metallographic microscope.

Currently, for most of extrusion materials of a copper alloy, brass alloy including 1 to 4 mass % of Pb is used. In the case of the brass alloy including Pb, as disclosed in Patent Document 1, a heat treatment is performed at a temperature of 350° C. to 550 as necessary. The lower limit of 350° C. is a temperature at which recrystallization occurs and the material softens almost entirely. At the upper limit of 550° C., the recrystallization ends. In addition, heat treatment at a higher temperature causes a problem in relation to energy. In addition, when a heat treatment is performed at a temperature of 550° C. or higher, the amount of β phase significantly increases. It is presumed that this is the reason the heat treatment is performed at a temperature between 350° C. and 550° C. The heat treatment is performed using a common manufacturing facility, a batch furnace or a continuous furnace, and the material is held at a predetermined temperature for 1 to 8 hours. In the case a batch furnace is used, air cooling is performed after furnace cooling or after the material's temperature decreases to about 250° C. In the case a continuous furnace is used, cooling is performed at a relatively low rate until the material's temperature decreases to about 250° C. Specifically, in a temperature range from 470° C. to 380° C., cooling is performed at an average cooling rate of about 2° C./min (excluding the time during which the material is held at a predetermined temperature from the calculation of the average cooling rate). Cooling is performed at a cooling rate that is different from that of the method of manufacturing the alloy according to the embodiment.

(Low-Temperature Annealing)

In the alloy casting according to the embodiment, if the cooling rate after casting or after the heat treatment is appropriate, low-temperature annealing for removing residual stress is not necessary.

Using this manufacturing method, the free-cutting copper alloy casting according to the first or second embodiment is manufactured.

In the free-cutting alloy casting according to the first or second embodiment having the above-described constitution, the alloy composition, the composition relational expressions, the metallographic structure, the metallographic structure relational expressions, and the manufacturing process are defined as described above. Therefore, corrosion resistance in a harsh environment, impact resistance, high-temperature strength, and wear resistance are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the constitution of the example alloys, processes, and conditions included in the descriptions of the Examples do not limit the technical range of the present invention.

Example 1

<Experiment on the Actual Production Line>

Using a melting furnace or a holding furnace on the actual production line, a trial manufacture test of the copper alloy was performed. Table 2 shows alloy compositions. Since the equipment used was the one on the actual production line, impurities were also measured in the alloys shown in Table 2. The amounts of Sb, As, and Bi are shown in the item "Impurities" even if Sb, As, and Bi were intentionally added.

(Steps No. A1 to A10 and AH1 to AH8)

Molten alloy was extracted from the melting furnace on the actual production line and was cast into an iron mold having an inner diameter of ϕ 40 mm and a length of 250 mm to prepare a casting. Next, the casting was cooled in a temperature range of 575° C. to 510° C. at an average cooling rate of about 20° C./min, subsequently was cooled in a temperature range from 470° C. to 380° C. at an average cooling rate of about 15° C./min, and subsequently was cooled in a temperature range from lower than 380° C. to 100° C. at an average cooling rate of about 12° C./min. In Step No. A10, the casting was extracted from the mold at 300° C. and then was air-cooled (the average cooling rate in a range up to 100° C. was about 35° C./min).

In Steps No. A1 to A6 and AH2 to AH5, a heat treatment was performed in a laboratory electric furnace. Regarding heat treatment conditions, as shown in Table 5, the heat treatment temperature was made to vary in a range of 500° C. to 630° C., and the holding time was made to vary in a range of 30 minutes to 180 minutes.

In Steps No. A7 to A10 and AH6 to AH8, heating was performed using a continuous annealing furnace at a temperature of 560° C. to 590° C. within a short period of time. Subsequently, cooling was performed while making an average cooling rate in a temperature range from 575° C. to 510° C. or an average cooling rate in a temperature range from 470° C. to 380° C. to vary. In the continuous annealing furnace, the casting was not held at a predetermined temperature for a long period of time. Therefore, a period of time for which the casting was held in a range of the predetermined temperature±5° C. (range of predetermined temperature−5° C. to predetermined temperature+5° C.) was set as the holding time. In the batch furnace, the same operation was performed.

(Steps No. B1 to B4, BH1, and BH2)

The molten alloy was cast into a mold formed of iron, and subsequently the casting and the mold were immediately put into an electric furnace. By controlling the temperature in the electric furnace, the average cooling rate in a temperature range from 575° C. to 510° C. and the average cooling rate in a temperature range from 470° C. to 380° C. were made to vary to perform cooling.

<Laboratory Experiment>

Using a laboratory facility, a trial manufacture test of a copper alloy was performed. Tables 3 and 4 show alloy compositions. The copper alloys having the compositions shown in Table 2 were also used in the laboratory experiment. In addition, a trial manufacture test was performed using a laboratory facility under the same conditions as the experiment performed on the actual production line. In this case, in the "Step No." column of the tables, corresponding step numbers of the actual production line experiment are shown.

(Steps No. C1 to C4 and CH1 to Ch3: Continuously Cast Rod)

Using a continuous casting facility, predetermined raw material components were melted to prepare a continuously cast rod having a diameter of 40 mm. After solidification, the continuously cast rod was cooled in a temperature range from 575° C. to 510° C. at an average cooling rate of about 18° C./min, subsequently was cooled in a temperature range from 470° C. to 380° C. at an average cooling rate of about 14° C./min, and subsequently was cooled in a temperature range from lower than 380° C. to 100° C. at an average cooling rate of about 12° C./min. Step No. CH1 ends in this cooling step, the sample of Step No. CH1 refers to the casting after cooling.

In Steps No. C1 to C3 and CH2, a heat treatment was performed in a laboratory electric furnace. As shown in Table 7, a heat treatment was performed under conditions of heat treatment temperature: 540° C. and holding time: 100 minutes. Next, the casting was cooled in a temperature range of 575° C. to 510° C. at an average cooling rate of about ° C./min, and subsequently was cooled in a temperature range from 470° C. to 380° C. at an average cooling rate of about 1.8° C./min to 10° C./min.

In Steps No. C4 and CH3, a heat treatment was performed in a continuous furnace. Heating was performed within a short period of time at a maximum reaching temperature of 570° C. Next, the casting was cooled in a temperature range of 575° C. to 510° C. at an average cooling rate of about 1.5° C./min, and subsequently was cooled in a temperature range from 470° C. to 380° C. at an average cooling rate of about 1.5° C./min or 10° C./min.

TABLE 2

| Alloy | Component Composition (mass %) | | | | | | Impurities (mass %) | | | | Composition Relational Expression | |
|---|---|---|---|---|---|---|---|---|---|---|---|---|
| No. | Cu | Si | Pb | Sn | P | Zn | Element | Amount | Element | Amount | f1 | f2 |
| S01 | 76.5 | 3.19 | 0.038 | 0.16 | 0.08 | Balance | Fe | 0.03 | Ni | 0.01 | 77.8 | 62.3 |
| | | | | | | | Al | 0.005 | Ag | 0.01 | | |
| | | | | | | | Cr | 0.01 | Co | 0.003 | | |
| S02 | 77.2 | 3.30 | 0.044 | 0.24 | 0.12 | Balance | Fe | 0.03 | Ni | 0.01 | 77.9 | 62.4 |
| | | | | | | | Mn | 0.005 | Ag | 0.03 | | |
| | | | | | | | Cr | 0.01 | Co | 0.003 | | |
| S03 | 76.2 | 3.11 | 0.045 | 0.11 | 0.09 | Balance | Fe | 0.02 | Ni | 0.04 | 77.9 | 62.4 |
| | | | | | | | Ag | 0.005 | Sb | 0.01 | | |
| | | | | | | | Bi | 0.004 | Zr | 0.001 | | |
| | | | | | | | Cr | 0.008 | Rare Earth Element | 0.005 | | |
| S04 | 76.8 | 3.26 | 0.033 | 0.21 | 0.13 | Balance | Sb | 0.03 | As | 0.04 | 77.8 | 62.2 |
| | | | | | | | Fe | 0.03 | Ni | 0.04 | | |
| | | | | | | | Al | 0.002 | Ag | 0.01 | | |
| | | | | | | | Mn | 0.008 | | | | |
| S05 | 76.1 | 3.20 | 0.042 | 0.12 | 0.10 | Balance | Fe | 0.01 | Ni | 0.03 | 77.8 | 61.8 |
| | | | | | | | Cr | 0.002 | Ag | 0.01 | | |
| | | | | | | | Mn | 0.008 | Bi | 0.007 | | |
| | | | | | | | Sb | 0.008 | | | | |
| S06 | 77.4 | 3.36 | 0.028 | 0.25 | 0.07 | Balance | Fe | 0.02 | Ni | 0.01 | 78.0 | 62.4 |
| | | | | | | | Mn | 0.01 | Co | 0.01 | | |

TABLE 3

| Alloy | Component Composition (mass %) | | | | | | | Composition Relational Expression | |
|---|---|---|---|---|---|---|---|---|---|
| No. | Cu | Si | Pb | Sn | P | Others | Zn | f 1 | f 2 |
| S11 | 76.6 | 3.19 | 0.037 | 0.18 | 0.09 | Sb: 0.04, Bi: 0.028 | Balance | 77.7 | 62.3 |
| S12 | 77.2 | 3.32 | 0.041 | 0.23 | 0.12 | As: 0.04, Bi: 0.031 | Balance | 78.0 | 62.3 |
| S13 | 77.5 | 3.44 | 0.040 | 0.11 | 0.07 | Sb: 0.03, As: 0.03 | Balance | 79.4 | 62.2 |
| S14 | 78.2 | 3.53 | 0.028 | 0.25 | 0.09 | | Balance | 79.0 | 62.4 |
| S15 | 77.8 | 3.47 | 0.028 | 0.23 | 0.10 | | Balance | 78.7 | 62.3 |
| S16 | 76.9 | 3.19 | 0.050 | 0.26 | 0.11 | | Balance | 77.4 | 62.6 |
| S17 | 77.6 | 3.42 | 0.040 | 0.12 | 0.07 | | Balance | 79.4 | 62.4 |
| S18 | 77.1 | 3.39 | 0.039 | 0.27 | 0.14 | | Balance | 77.7 | 61.8 |
| S19 | 76.0 | 3.24 | 0.032 | 0.15 | 0.10 | | Balance | 77.4 | 61.5 |
| S20 | 75.2 | 2.99 | 0.048 | 0.09 | 0.08 | | Balance | 76.9 | 61.9 |
| S21 | 76.2 | 3.11 | 0.050 | 0.11 | 0.07 | | Balance | 77.8 | 62.4 |
| S22 | 75.3 | 3.04 | 0.045 | 0.09 | 0.07 | | Balance | 77.1 | 61.8 |
| S23 | 76.4 | 3.13 | 0.042 | 0.08 | 0.07 | | Balance | 78.3 | 62.5 |

TABLE 4

| Alloy | Component Composition (mass %) | | | | | | | Composition Relational Expression | |
|---|---|---|---|---|---|---|---|---|---|
| No. | Cu | Si | Pb | Sn | P | Others | Zn | f 1 | f 2 |
| S51 | 75.9 | 3.08 | 0.043 | 0.33 | 0.08 | | Balance | 75.7 | 62.0 |
| S52 | 73.6 | 3.03 | 0.025 | 0.13 | 0.10 | | Balance | 75.0 | 60.1 |
| S53 | 75.9 | 3.03 | 0.042 | 0.02 | 0.01 | | Balance | 78.2 | 62.6 |
| S54 | 76.0 | 3.12 | 0.034 | 0.05 | 0.10 | | Balance | 78.2 | 62.1 |
| S55 | 76.3 | 3.18 | 0.042 | 0.17 | 0.04 | | Balance | 77.5 | 62.2 |
| S56 | 76.9 | 3.24 | 0.041 | 0.04 | 0.03 | | Balance | 79.2 | 62.6 |
| S57 | 78.9 | 3.65 | 0.034 | 0.14 | 0.08 | | Balance | 80.7 | 62.7 |
| S58 | 75.2 | 2.90 | 0.052 | 0.08 | 0.09 | | Balance | 77.0 | 62.3 |
| S59 | 74.7 | 3.02 | 0.048 | 0.09 | 0.09 | | Balance | 76.5 | 61.3 |
| S60 | 75.8 | 3.03 | 0.006 | 0.10 | 0.07 | | Balance | 77.4 | 62.3 |
| S61 | 77.8 | 3.63 | 0.038 | 0.18 | 0.12 | | Balance | 79.3 | 61.6 |
| S62 | 76.9 | 3.42 | 0.043 | 0.25 | 0.17 | | Balance | 77.7 | 61.5 |
| S63 | 77.3 | 3.15 | 0.039 | 0.12 | 0.10 | | Balance | 78.9 | 63.3 |
| S64 | 76.7 | 3.02 | 0.036 | 0.18 | 0.07 | | Balance | 77.7 | 63.2 |
| S65 | 74.4 | 2.87 | 0.045 | 0.16 | 0.12 | | Balance | 75.5 | 61.5 |
| S66 | 74.4 | 3.22 | 0.033 | 0.15 | 0.09 | | Balance | 75.8 | 60.0 |
| S67 | 77.1 | 3.33 | 0.028 | 0.05 | 0.03 | | Balance | 79.4 | 62.4 |
| S68 | 75.4 | 2.85 | 0.047 | 0.16 | 0.09 | | Balance | 76.4 | 62.7 |
| S69 | 75.2 | 3.03 | 0.038 | 0.19 | 0.12 | | Balance | 76.1 | 61.6 |
| S70 | 76.0 | 3.01 | 0.036 | 0.28 | 0.07 | | Balance | 76.1 | 62.5 |
| S71 | 75.8 | 3.39 | 0.033 | 0.18 | 0.10 | | Balance | 77.1 | 60.7 |
| S72 | 80.8 | 3.98 | 0.034 | 0.02 | 0.01 | | Balance | 83.8 | 63.3 |
| S73 | 75.5 | 3.06 | 0.045 | 0.10 | 0.07 | Fe: 0.12 | Balance | 77.2 | 61.9 |
| S74 | 75.7 | 3.05 | 0.045 | 0.09 | 0.07 | Fe: 0.08, Cr: 0.04 | Balance | 77.5 | 62.2 |

TABLE 5

| | Casting | | | | Heat Treatment | | | | |
|---|---|---|---|---|---|---|---|---|---|
| Step No. | Casting Temperature (test material's temperature) (° C.) | Cooling Rate from 575° C. to 510° C. (° C./min) | Cooling Rate from 470° C. to 380° C. (° C./min) | Whether Heat Treated after Cooling | Kind of Furnace | Temperature (° C.) | Time (min) | Cooling Rate from 575° C. to 510° C. (° C./min) | Cooling Rate from 470° C. to 380° C. (° C./min) |
| A1 | 1000 | 20 | 15 | ○ | Batch Furnace | 540 | 100 | 20 | 15 |
| A2 | 1000 | 20 | 15 | ○ | Batch Furnace | 540 | 100 | 20 | 8 |
| A3 | 1000 | 20 | 15 | ○ | Batch Furnace | 540 | 100 | 20 | 5 |
| A4 | 1000 | 20 | 15 | ○ | Batch Furnace | 540 | 100 | 20 | 3.2 |
| A5 | 1000 | 20 | 15 | ○ | Batch Furnace | 520 | 180 | 20 | 15 |
| A6 | 1000 | 20 | 15 | ○ | Batch Furnace | 520 | 30 | 20 | 15 |
| A7 | 1000 | 20 | 15 | ○ | Continuous Furnace | 590 | 5 | 1.8 | 10 |
| A8 | 1000 | 20 | 15 | ○ | Continuous Furnace | 590 | 5 | 1.2 | 10 |
| A9 | 1000 | 20 | 15 | ○ | Continuous Furnace | 560 | 5 | 1 | 10 |
| A10 | 1000 | 20 | 15 | ○ | Continuous Furnace | 590 | 5 | 1.2 | 10 |
| AH1 | 1000 | 20 | 15 | | — | — | — | — | — |
| AH2 | 1000 | 20 | 15 | ○ | Batch Furnace | 540 | 100 | 10 | 2 |
| AH3 | 1000 | 20 | 15 | ○ | Batch Furnace | 540 | 100 | 10 | 1 |
| AH4 | 1000 | 20 | 15 | ○ | Batch Furnace | 630 | 30 | 20 | 15 |
| AH5 | 1000 | 20 | 15 | ○ | Batch Furnace | 500 | 180 | 20 | 15 |
| AH6 | 1000 | 20 | 15 | ○ | Continuous Furnace | 590 | 5 | 8 | 10 |
| AH7 | 1000 | 20 | 15 | ○ | Continuous Furnace | 560 | 5 | 6 | 10 |
| AH8 | 1000 | 20 | 15 | ○ | Continuous Furnace | 590 | 5 | 1.8 | 1.6 |

TABLE 6

| Step No. | Note |
|---|---|
| A1 | The heat treatment conditions were within the rage according to the embodiments of the present invention. |
| A2 | The heat treatment conditions were within the rage according to the embodiments of the present invention. |
| A3 | The cooling rate was close to the critical value. |
| A4 | The cooling rate was close to the critical value. |
| A5 | The heating temperature was relatively low, but the heating time was relatively long. |
| A6 | The heating temperature was relatively low, and the heating time was relatively short. |
| A7 | The heating temperature was relatively high, but the cooling rate from 575° C. to 510° C. was relatively low. |
| A8 | The heating temperature was relatively high, but the cooling rate from 575° C. to 510° C. was relatively low. |
| A9 | The heating temperature was moderate (standard), and the cooling rate from 575° C. to 510° C. was relatively low. |
| A10 | The casting was cooled to 300° C. then taken out and air cooled, followed by heat treatment performed with the conditions same as Process No. A8. |
| AH1 | |
| AH2 | Due to furnace cooling, the cooling rate from 470° C. to 380° C. was low. |
| AH3 | Due to furnace cooling, the cooling rate from 470° C. to 380° C. was low. |
| AH4 | The heating temperature was high. |
| AH5 | The heating temperature was low. |
| AH6 | The heating temperature was relatively high, but the cooling rate from 575° C. to 510° C. was relatively high. |
| AH7 | The heating temperature was moderate (standard), but the cooling rate from 575° C. to 510° C. was relatively high. |
| AH8 | The cooling rate from 470° C. to 380° C. was low. |

TABLE 8-continued

| Step No. | Note |
|---|---|
| B3 | The cooling rate from 575° C. to 510° C. after solidification was relatively low, and the cooling rate from 470° C. to 380° C. was relatively high. |
| B4 | The cooling rate from 575° C. to 510° C. after solidification was relatively low, and the cooling rate from 470° C. to 380° C. was relatively high. |
| BH1 | The cooling rate from 575° C. to 510° C. after solidification was high. |
| BH2 | The cooling rate from 575° C. to 510° C. after solidification was relatively low, but the cooling rate from 470° C. to 380° C. was relatively low. |
| C1 | Continuously casted rod; the temperature was appropriate, and the cooling rate from 470° C. to 380° C. was relatively high. |
| C2 | Continuously casted rod; the temperature was appropriate, and the cooling rate from 470° C. to 380° C. was relatively high. |
| C3 | Continuously casted rod; the temperature was appropriate, and the cooling rate from 470° C. to 380° C. was close to the critical value. |
| C4 | Continuously casted rod; although the holding time was short, the cooling rate from 575° C. to 510° C. was relatively low. |
| CH1 | |
| CH2 | Continuously casted rod; the temperature was appropriate, but the cooling rate from 470° C. to 380° C. was low. |
| CH3 | Continuously casted rod; the cooling rate from 470° C. to 380° C. was low. |

Regarding the above-described test materials, the metallographic structure observed, corrosion resistance (dezincification corrosion test/dipping test), and machinability were evaluated by the following procedure.

TABLE 7

| | Casting | | | | Heat Treatment | | | | |
|---|---|---|---|---|---|---|---|---|---|
| Step No. | Casting Temperature (test material's temperature) (° C.) | Cooling Rate from 575° C. to 510° C. (° C./min) | Cooling Rate from 470° C. to 380° C. (° C./min) | Whether Heat Treated after Cooling | Kind of Furnace | Temperature (° C.) | Time (min) | Cooling Rate from 575° C. to 510° C. (° C./min) | Cooling Rate from 470° C. to 380° C. (° C./min) |
| B1 | 1000 | 1.6 | 15 | | — | — | — | — | — |
| B2 | 1000 | 0.8 | 15 | | — | — | — | — | — |
| B3 | 1000 | 0.8 | 6.5 | | — | — | — | — | — |
| B4 | 1000 | 0.8 | 4 | | — | — | — | — | — |
| BH1 | 1000 | 3.4 | 15 | | — | — | — | — | — |
| BH2 | 1000 | 0.8 | 1.5 | | — | — | — | — | — |
| C1 | 1030 | 18 | 14 | ○ | Batch Furnace | 540 | 100 | 15 | 10 |
| C2 | 1030 | 18 | 14 | ○ | Batch Furnace | 540 | 100 | 15 | 6 |
| C3 | 1030 | 18 | 14 | ○ | Batch Furnace | 540 | 100 | 15 | 3.5 |
| C4 | 1030 | 18 | 14 | ○ | Continuous Furnace | 570 | 5 | 1.5 | 10 |
| CH1 | 1030 | 18 | 14 | | — | — | — | — | — |
| CH2 | 1030 | 18 | 14 | ○ | Batch Furnace | 540 | 100 | 15 | 1.8 |
| CH3 | 1030 | 18 | 14 | ○ | Continuous Furnace | 570 | 5 | 1.5 | 1.5 |

TABLE 8

| Step No. | Note |
|---|---|
| B1 | The cooling rate from 575° C. to 510° C. after solidification was relatively low. |
| B2 | The cooling rate from 575° C. to 510° C. after solidification was relatively low. |

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials was cut in a direction parallel to the longitudinal direction of the casting. Next, the surface was polished (mirror-polished) and was etched with a mixed solution of hydrogen peroxide and ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. In micrographs of five visual fields, respective phases (α phase, κ phase, β phase, γ phase, and μ phase) were manually painted using image processing software "Photoshop CC". Next, the micrographs were binarized using image processing software "WinROOF 2013" to obtain the area ratios of the respective phases. Specifically, the average value of the area ratios of the five visual fields for each phase was calculated and regarded as the proportion of the phase. Thus, the total of the area ratios of all the constituent phases was 100%.

The lengths of the long sides of γ phase and μ phase were measured using the following method. Using a 500-fold or 1000-fold metallographic micrograph, the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of μ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify a phase, the phase was identified using an electron backscattering diffraction pattern (FE-SEM-EBSP) method at a magnification of 500-fold or 2000-fold.

In addition, in Examples in which the average cooling rates were made to vary, in order to determine whether or not μ phase, which mainly precipitates at a grain boundary, was present, a secondary electron image was obtained using JSM-7000F (manufactured by JEOL Ltd.) under the conditions of acceleration voltage: 15 kV and current value (set value: 15), and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the μ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is 5 μm or less, and the width of such μ phase is 0.3 μm or less. Therefore, such μ phase scarcely affects the area ratio.

The length of μ phase was measured in arbitrarily selected five visual fields, and the average value of the maximum lengths measured in the five visual fields was regarded as the length of the long side of μ phase as described above. The composition of μ phase was verified using an EDS, an accessory of JSM-7000F. Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Regarding μ phase, when cooling was performed in a temperature range from 470° C. to 380° C. at an average cooling rate of about 8° C./min or about 8° C./min or lower after casting or after the heat treatment, the presence of μ phase was able to be verified. FIG. 1 shows an example of a secondary electron image of Test No. T04 (Alloy No. S01/Step No. A3). It was verified that μ phase was an elongated phase present along a grain boundary or a phase boundary around a grain boundary of α phase and a phase boundary between α phase and κ phase.

(Acicular κ Phase Present in a Phase)

Acicular κ phase (κ1 phase) present in α phase has a width of about 0.05 μm to about 0.5 μm and has an elongated linear shape or an acicular shape. When the width is 0.1 μm or more, the presence of κ phase can be identified using a metallographic microscope.

Figure 2:
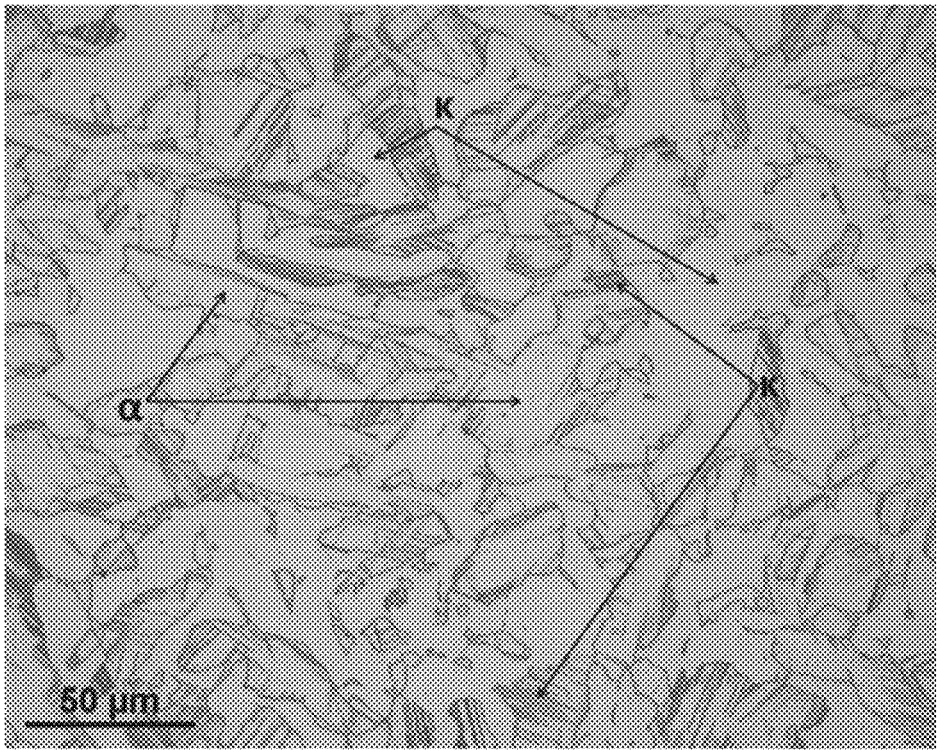
FIG. 2 is a metallographic micrograph of a metallographic structure of a free-cutting copper alloy casting (Test No. T32) according to Example 1.
Figure 3:
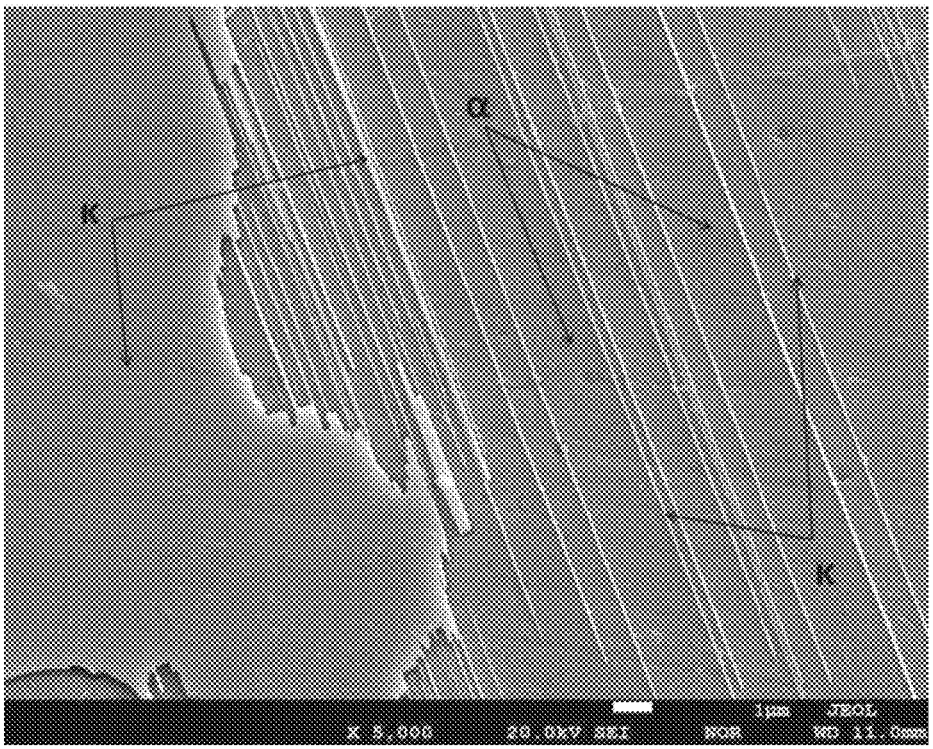
FIG. 3 is an electron micrograph of a metallographic structure of a free-cutting copper alloy casting (Test No. T32) according to Example 1.

FIG. 2 shows a metallographic micrograph of Test No. T32 (Alloy No. S02/Step No. A1) as a representative metallographic micrograph. FIG. 3 shows an electron micrograph of Test No. T32 (Alloy No. S02/Step No. A1) as a representative electron micrograph of acicular κ phase present in α phase. Observation points of FIGS. 2 and 3 were not the same. In the copper alloy, κ phase may be confused with twin crystal present in α phase. However, the width of κ phase is narrow, and twin crystal consists of a pair of crystals, and thus κ phase present in α phase can be distinguished from twin crystal present in α phase. In the metallographic micrograph of FIG. 2, a phase having an elongated linear acicular pattern is observed in α phase. In the secondary electron image (electron micrograph) of FIG. 3, a pattern present in α phase can be clearly identified as κ phase. The thickness of κ phase was about 0.1 μm. In the metallographic micrograph of FIG. 2, κ phase matches with acicular and linear phase as described above. Regarding the length of κ phase, some κ phase grains crossed over the inside of α phase grains, and some κ phase grains crossed over about ½ to ¼ of the inside of α phase grains.

The amount (number) of acicular κ phase in α phase was determined using the metallographic microscope. For the determination of the metallic constituent phase, the micrographs of the five visual fields obtained at a magnification of 500-fold or 1000-fold for the determination of the metallographic structure constituent phases (metallographic structure observation) were used. In an enlarged visual field having a length of about 70 mm and a width of about 90 mm, the number of acicular κ phases was measured, and the average value of five visual fields was obtained. When the average number of acicular κ phases in the five visual fields was 5 or more and less than 49, it was determined that acicular κ phase was present, and "Δ" was indicated. When the average number of acicular κ phases in the five visual fields was more than 50, it was determined that a large amount of acicular κ phase was present, and "O" was indicated. When the average number of acicular κ phases in the five visual fields was 4 or less, it was determined that almost no acicular κ phase was present, and this case was represented by "X" was indicated. The number of acicular κ1 phases that was not able to be observed using the images was not counted.

Incidentally, a phase having a width of 0.2 μm only looks like a line having a width of 0.1 mm when observed with a 500-fold metallographic microscope. This is the limit of the observation with a metallographic microscope of approximately 500× magnification. In the case narrow κ phase is present, it is necessary to observe the κ phase with a 1000-fold metallographic microscope.

(Amounts of Sn and P in κ Phase)

The amount of Sn and the amount of P contained in κ phase were measured using an X-ray microanalyzer. The measurement was performed using "JXA-8200" (manufactured by JEOL Ltd.) under the conditions of acceleration voltage: 20 kV and current value: $3.0\times10^{-8}$ A.

Regarding Test No. T01 (Alloy No. S01/Step No. AH1), Test No. T02 (Alloy No. S01/Step No. A1), Test No. T06 (Alloy No. S01/Step No. AH2), the quantitative analysis of the concentrations of Sn, Cu, Si, and P in the respective phases was performed using the X-ray microanalyzer. The results thereof are shown in Tables 9 to 11.

TABLE 9

Test No. T01 (Alloy No. S01:76.5Cu—3.19Si—0.16Sn—0.08P/Step No. AH1) (mass %)

| | Cu | Si | Sn | P | Zn |
|---|---|---|---|---|---|
| α Phase | 76.5 | 2.6 | 0.09 | 0.06 | Balance |
| κ Phase | 77.5 | 3.9 | 0.13 | 0.11 | Balance |
| γ Phase | 73.5 | 5.9 | 1.4 | 0.16 | Balance |
| μ Phase | — | — | — | — | — |

TABLE 10

Test No. T02 (Alloy No. S01:76.5Cu—3.19Si—0.16Sn—0.08P/Step No. A1) (mass %)

| | Cu | Si | Sn | P | Zn |
|---|---|---|---|---|---|
| α Phase | 76.5 | 2.6 | 0.13 | 0.06 | Balance |
| κ Phase | 77.0 | 4.1 | 0.19 | 0.11 | Balance |
| γ Phase | 74.5 | 6.2 | 1.5 | 0.16 | Balance |
| μ Phase | — | — | — | — | — |

TABLE 11

Test No. T 06 (Alloy No. S01: 76.5Cu—3.19Si—0.16Sn—0.08P/Step No. AH2) (mass %)

| | Cu | Si | Sn | P | Zn |
|---|---|---|---|---|---|
| α Phase | 76.5 | 2.6 | 0.13 | 0.06 | Balance |
| κ Phase | 77.0 | 4.0 | 0.19 | 0.11 | Balance |
| γ Phase | 75.0 | 6.1 | 1.4 | 0.16 | Balance |
| μ Phase | 82.0 | 7.7 | 0.26 | 0.23 | Balance |

Based on the above-described measurement results, the following findings were obtained.

1) The concentrations distributed in the respective phases vary depending on the alloy compositions.

2) The amount of Sn distributed in κ phase is about 1.4 to 1.5 times that in α phase.

3) The Sn concentration in γ phase is about 10 to about 17 times the Sn concentration in α phase.

4) The Si concentrations in κ phase, γ phase, and μ phase are about 1.5 times, about 2.2 times, and about 2.7 times the Si concentration in α phase, respectively.

5) The Cu concentration in μ phase is higher than that in α phase, κ phase, γ phase, or μ phase.

6) As the proportion of γ phase increases, the Sn concentration in κ phase necessarily decreases.

Even if the composition is the same, when the area ratio of γ phase is high, the amount of Sn distributed in κ phase or α phase is merely about ⅔ of that when the area ratio of γ phase is low, and the Sn concentration in κ phase is lower than the Sn content in the alloy when the area ratio of γ phase is low. In addition, when the case where the area ratio of γ phase is high is compared to the case where the area ratio of γ phase is low, the Sn concentrations in α phases are 0.09 mass % and 0.13 mass %, respectively, and a difference therebetween is 0.04 mass %. In addition, the Sn concentrations in κ phase are 0.13 mass % and 0.19 mass %, respectively, and a difference therebetween is 0.06 mass %. An increase in the Sn concentration in κ phase is more than an increase in the Sn concentration in α phase.

7) The amount of P distributed in κ phase is about 2 times that in α phase.

8) The P concentrations in γ phase and μ phase are about 3 times and about 4 times the P concentration in α phase.

(Mechanical Properties)

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.4% or lower after the test piece is held at 150° C. for 100 hours in a state where a load corresponding to 0.2% plastic deformation is applied, the specimen is regarded to have good high-temperature creep. In the case where this creep strain is 0.3% or lower, the alloy is regarded to be of the highest quality among copper alloys, and such material can be used as a highly reliable material in, for example, valves used under high temperature or in automobile components used in a place close to the engine room.

(Impact Resistance)

In an impact test, a U-notched specimen (notch depth: 2 mm, notch bottom radius: 1 mm) according to JIS Z 2242 was taken from each of the test materials. Using an impact blade having a radius of 2 mm, a Charpy impact test was performed to measure the impact value.

The relation between the impact value obtained when a V-notched specimen is used and when a U-notched specimen is used is as follows.

$$(\text{V-Notch Impact Value})=0.8\times(\text{U-Notch Impact Value})-3$$

(Machinability)

The machinability was evaluated as follows in a machining test using a lathe.

A casting having a diameter of 40 mm was machined to prepare a test material having a diameter of 30 mm. A point nose straight tool, in particular, a tungsten carbide tool not equipped with a chip breaker was attached to the lathe. Using this lathe, the circumference of the test material was machined under dry conditions at rake angle: −6 degrees, nose radius: 0.4 mm, machining speed: 130 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the casting was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "O" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 10%, the cutting resistance is sufficiently acceptable for practical use. In the embodiment, the cutting resistance was evaluated based on whether it had 130 N (boundary value). Specifically, when the cutting resistance was lower than 130 N, the machinability was evaluated as excellent (evaluation: O). When the cutting resistance was 118 N or lower, the machinability was evaluated as especially excellent. When the cutting resistance was 130 N or higher and lower than 150 N, the machinability was evaluated as "acceptable (Δ)". When the cutting resistance was 150 N or higher, the cutting resistance was evaluated as "unacceptable (X)". Incidentally, when hot forging was performed on a 58 mass % Cu-42 mass % Zn alloy to prepare a sample and this sample was evaluated, the cutting resistance was 185 N.

As an overall evaluation of machinability, a material whose chip shape was excellent (evaluation: O) and the cutting resistance was low (evaluation: O), the machinability was evaluated as excellent. When either the chip shape or the cutting resistance is evaluated as Δ or acceptable, the machinability was evaluated as good under some conditions. When either the chip shape or cutting resistance was evaluated as Δ or acceptable and the other was evaluated as X or unacceptable, the machinability was evaluated as unacceptable (poor).

(Dezincification Corrosion Tests 1 and 2)

The test material was embedded in a phenol resin material such that an exposed sample surface of each of the test materials was perpendicular to a longitudinal direction of the cast material. The sample surface was polished with emery paper up to grit 1200, was ultrasonically cleaned in pure water, and then was dried with a blower. Next, each of the samples was dipped in a prepared dipping solution.

After the end of the test, the sample was embedded again in a phenol resin material such that the exposed surface was maintained to be perpendicular to the longitudinal direction. Next, the sample was cut such that a cross-section of a corroded portion was obtained as the longest cut portion. Next, the sample was polished.

Using a metallographic microscope, corrosion depth was observed in 10 visual fields (any 10 visual fields) of the microscope at a magnification of 500-fold. Regarding a sample having a large corrosion depth, the magnification was set as 200 fold. The deepest corrosion point was recorded as a maximum dezincification corrosion depth.

In the dezincification corrosion test 1, the following test solution 1 was prepared as the dipping solution, and the above-described operation was performed. In the dezincification corrosion test 2, the following test solution 2 was prepared as the dipping solution, and the above-described operation was performed.

The test solution 1 is a solution for performing an accelerated test in a harsh corrosion environment simulating an environment in which an excess amount of a disinfectant which acts as an oxidant is added such that pH is significantly low. When this solution is used, it is presumed that this test is an about 60 to 90 times accelerated test performed in such a harsh corrosion environment. If the maximum corrosion depth is 80 μm or less, corrosion resistance is considered to be excellent since what is aimed at in the embodiment is excellent corrosion resistance under a harsh environment. In the case more excellent corrosion resistance is required, it is presumed that the maximum corrosion depth is preferably 60 μm or less and more preferably 40 μm or less.

The test solution 2 is a solution for performing an accelerated test in a harsh corrosion environment, for simulating water quality that makes corrosion advance fast in which the chloride ion concentration is high and pH is low. When this solution is used, it is presumed that corrosion is accelerated about 30 to 50 times in such a harsh corrosion environment. If the maximum corrosion depth is 50 μm or less, corrosion resistance is good. If excellent corrosion resistance is required, it is presumed that the maximum corrosion depth is preferably 40 μm or less and more preferably 30 μm or less. The Examples of the instant invention were evaluated based on these presumed values.

In the dezincification corrosion test 1, hypochlorous acid water (concentration: 30 ppm, pH=6.8, water temperature: 40° C.) was used as the test solution 1. Using the following method, the test solution 1 was adjusted. Commercially available sodium hypochlorite (NaClO) was added to 40 L of distilled water and was adjusted such that the residual chlorine concentration measured by iodometric titration was 30 mg/L. Residual chlorine decomposes and decreases in amount over time. Therefore, while continuously measuring the residual chlorine concentration using a voltammetric method, the amount of sodium hypochlorite added was electronically controlled using an electromagnetic pump. In order to reduce pH to 6.8, carbon dioxide was added while adjusting the flow rate thereof. The water temperature was adjusted to 40° C. using a temperature controller. While maintaining the residual chlorine concentration, pH, and the water temperature to be constant, the sample was held in the test solution 1 for 2 months. Next, the sample was taken out from the aqueous solution, and the maximum value (maximum dezincification corrosion depth) of the dezincification corrosion depth was measured.

In the dezincification corrosion test 2, a test water including components shown in Table 12 was used as the test solution 2. The test solution 2 was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.3, carbon dioxide was added while adjusting the flow rate thereof. In order to saturate the dissolved oxygen concentration, oxygen gas was continuously added. The water temperature was adjusted to 25° C. which is the same as room temperature. While maintaining pH and the water temperature to be constant and maintaining the dissolved oxygen concentration in the saturated state, the sample was held in the test solution 2 for 3 months. Next, the sample was taken out from the aqueous solution, and the maximum value (maximum dezincification corrosion depth) of the dezincification corrosion depth was measured.

TABLE 12

| | | | | | | | (Units of Items other than pH: mg/L) | | |
|---|---|---|---|---|---|---|---|---|---|
| Mg | Ca | Na | K | $NO^{3-}$ | $SO_4^{2-}$ | Cl | Alkalinity | Hardness | pH |
| 10.1 | 7.3 | 55 | 19 | 30 | 40 | 80 | 30 | 60 | 6.3 |

(Dezincification Corrosion Test 3: Dezincification Corrosion Test According to ISO 6509)

This test is adopted in many countries as a dezincification corrosion test method and is defined by JIS H 3250 of JIS Standards.

As in the case of the dezincification corrosion tests 1 and 2, the test material was embedded in a phenol resin material. Specifically, test samples cut out of the test material were embedded in a phenol resin material such that the exposed surfaces of the samples were perpendicular to the longitudinal direction of the cast material. The samples' surfaces were polished with emery paper up to grit 1200, ultrasonically cleaned in pure water, and then were dried.

Each of the samples were dipped in an aqueous solution (12.7 g/L) of 1.0% cupric chloride dihydrate ($CuCl_2.2H_2O$) and were held under a temperature condition of 75° C. for 24 hours. Next, the samples were taken out from the aqueous solution.

The samples were embedded in a phenol resin material again such that the exposed surfaces were maintained to be perpendicular to the longitudinal direction. Next, the samples were cut such that the longest possible cross-section of a corroded portion could be obtained. Next, the samples were polished.

Using a metallographic microscope, corrosion depth was observed in 10 visual fields of the microscope at a magnification of 100-fold to 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "O" (good). In the embodiment, an especially strict evaluation was performed because the alloy was assumed to be used in a harsh corrosion environment, and only when the evaluation was "O", it was determined that corrosion resistance was excellent.

(Abrasion Test)

In two tests including an Amsler abrasion test under a lubricating condition and a ball-on-disk abrasion test under a dry condition, wear resistance was evaluated.

The Amsler abrasion test was performed using the following method. At room temperature, each of the samples was machined to prepare an upper specimen having a diameter 32 mm. In addition, a lower specimen (surface hardness: HV184) having a diameter of 42 mm formed of austenitic stainless steel (SUS304 according to JIS G 4303) was prepared. By applying 490 N of load, the upper specimen and the lower specimen were brought into contact with each other. For an oil droplet and an oil bath, silicone oil was used. In a state where the upper specimen and the lower specimen were brought into contact with the load being applied, the upper specimen and the lower specimen were rotated under the conditions that the rotation speed of the upper specimen was 188 rpm and the rotation speed of the lower specimen was 209 rpm. Due to a difference in circumferential speed between the upper specimen and the lower specimen, a sliding speed was 0.2 m/sec. By making the diameters and the rotation speeds of the upper specimen and the lower specimen different from each other, the specimen was made to wear. The upper specimen and the lower specimen were rotated until the number of times of rotation of the lower specimen reached 250000.

After the test, the change in the weight of the upper specimen was measured, and wear resistance was evaluated based on the following criteria. When the decrease in the weight of the upper specimen caused by abrasion was 0.25 g or less, it was evaluated as "◎" (excellent). When the decrease in the weight of the upper specimen was more than 0.25 g and 0.5 g or less, it was evaluated as "O" (good). When the decrease in the weight of the upper specimen was more than 0.5 g and 1.0 g or less, it was evaluated as "Δ" (fair). When the decrease in the weight of the upper specimen was more than 1.0 g, it was evaluated as "X" (poor). The wear resistance was evaluated in these four grades. In addition, when the weight of the lower specimen decreased by 0.025 g or more, it was evaluated as "X".

Incidentally, the abrasion loss (a decrease in weight caused by abrasion) of a free-cutting brass 59Cu-3Pb-38Zn including Pb under the same test conditions was 12 g.

The ball-on-disk abrasion test was performed using the following method. A surface of the specimen was polished with a #2000 sandpaper. A steel ball having a diameter of 10 mm formed of austenitic stainless steel (SUS304 according to JIS G 4303) was pressed against the specimen and was slid thereon under the following conditions.

(Conditions)

Room temperature, no lubrication, load: 49 N, sliding diameter: diameter 10 mm, sliding speed: 0.1 m/sec, sliding distance: 120 m After the test, a change in the weight of the specimen was measured, and wear resistance was evaluated based on the following criteria. A case where a decrease in the weight of the specimen caused by abrasion was 4 mg or less was evaluated as "◎" (excellent). A case where a decrease in the weight of the specimen was more than 4 mg and 8 mg or less was evaluated as "O" (good). A case where a decrease in the weight of the specimen was more than 8 mg and 20 mg or less was evaluated as "Δ" (fair). A case where a decrease in the weight of the specimen was more than 20 mg was evaluated as "X" (poor). The wear resistance was evaluated in these four grades.

Incidentally, an abrasion loss of a free-cutting brass 59Cu-3Pb-38Zn including Pb under the same test conditions was 80 mg.

The copper alloy may be used for a bearing, and it is preferable that the abrasion loss of the copper alloy is small. In addition, it is more important that stainless steel, which is representative steel (material) of a shaft, that is, an opposite material, is not damaged. A small amount of hydrogen peroxide water (30%) to 20% nitric acid to prepare a solution. After the test, a ball (steel ball) was dipped in the solution for about 3 minutes to remove adhered materials from the surface. Next, the surface of the steel ball was observed at a magnification of 30 fold to investigate a damaged state. In the case a scratch (scratch having a depth of 5 μm in cross-section) formed by a claw was clearly observed after the investigation of the damaged state of the surface and the removal of the adhered material, wear resistance was determined as "x (poor)".

(Measurement of Melting Point and Castability Test)

The residue of the molten alloy used for the preparation of the samples was used. A thermocouple was put into the molten alloy to obtain a liquidus temperature and a solidus temperature, and a solidification temperature range was obtained.

Figure 4:
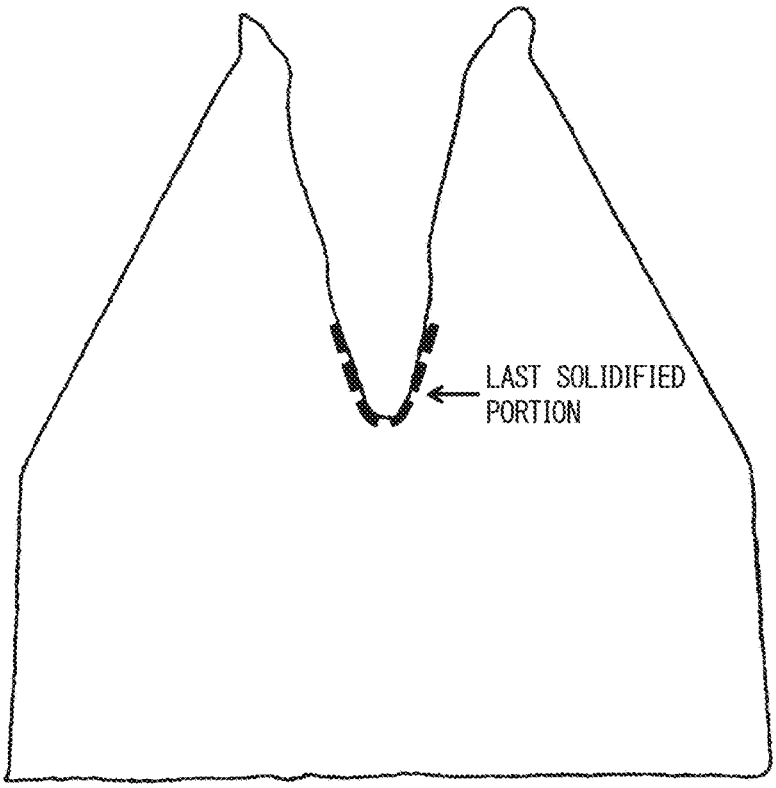
FIG. 4 is a schematic diagram showing a vertical section cut from a casting in a castability test.

In addition, the molten alloy at 1000° C. was cast into a Tatur mold formed of iron, and whether or not defects such as holes or shrinkage cavities were present at a final solidification portion or the vicinity thereof were specifically investigated (Tatur Shrinkage Test). Specifically, the casting was cut so as to obtain a vertical section including the final solidification portion as shown in a schematic vertical section diagram of FIG. 4. The cross-section of the sample was polished with emery paper up to grit 400. Next, using a penetration test, whether or not microscopic defects were present were investigated.

Castability was evaluated as follows. In the case, in the cross-section, a defect indication appeared in a region at a distance of 3 mm or less from the final solidification portion of the surface of the vicinity thereof but did not appear in a region at a distance of more than 3 mm from the final solidification portion of the surface of the vicinity thereof, castability was evaluated as "O (good)". In the case a defect indication appeared in a region at a distance of 6 mm or less from the final solidification portion of the surface of the vicinity thereof but did not appear in a region at a distance of more than 6 mm from the final solidification portion of the surface of the vicinity thereof, castability was evaluated as "Δ (fair)". In the case where a defect indication appeared in a region at a distance of more than 6 mm from the final solidification portion of the surface of the vicinity thereof, castability was evaluated as "X (poor)".

The final solidification portion is present in a dead head portion due to a good casting plan in most cases, but may be present in the main body of the casting. In the case of the alloy casting according to the embodiment, the result of the Tatur shrinkage test and the solidification temperature range have a close relation. In the case the solidification temperature range was 25° C. or lower or 30° C. or lower, castability was evaluated as "O" in many cases. In the case the solidification temperature range was 45° C. or lower, castability was evaluated as "X" in many cases. In the case the solidification temperature range was 40° C. or lower, castability was evaluated as "O" or "Δ".

The evaluation results are shown in Tables 13 to 39. Tests No. T01 to T127 are the results of the experiment performed on the actual production line. Tests No. T201 to T245 and T301 to T345 are the results of the experiment performed in a laboratory.

TABLE 13

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T01 | S01 | AH1 | 33.6 | 4.2 | 0 | 0 | 95.8 | 100 | 4.2 | 45.9 | 120 | 0 | X | 0.13 | 0.11 |
| T02 | S01 | A1 | 38.8 | 0.2 | 0 | 0 | 99.8 | 100 | 0.2 | 41.6 | 22 | 0 | ○ | 0.19 | 0.11 |
| T03 | S01 | A2 | 39.2 | 0.3 | 0 | 0 | 99.7 | 100 | 0.3 | 42.5 | 24 | 1 | ○ | 0.19 | 0.11 |
| T04 | S01 | A3 | 38.6 | 0.2 | 0 | 0 | 99.8 | 100 | 0.2 | 41.5 | 22 | 8 | ○ | 0.19 | 0.11 |
| T05 | S01 | A4 | 38.4 | 0.3 | 0 | 0.8 | 98.9 | 100 | 1.1 | 42.0 | 23 | 18 | ○ | 0.19 | 0.11 |
| T06 | S01 | AH2 | 37.8 | 0.2 | 0 | 2.3 | 97.5 | 100 | 2.5 | 41.6 | 22 | 32 | ○ | 0.19 | 0.11 |
| T07 | S01 | AH3 | 36.9 | 0.1 | 0 | 4.8 | 95.1 | 100 | 4.9 | 41.2 | 26 | 40 or more | ○ | 0.20 | 0.11 |
| T08 | S01 | A5 | 38.3 | 0.4 | 0 | 0 | 99.6 | 100 | 0.4 | 42.1 | 36 | 0 | ○ | 0.19 | 0.11 |
| T09 | S01 | A6 | 37.5 | 0.9 | 0 | 0 | 99.1 | 100 | 0.9 | 43.2 | 48 | 0 | Δ | 0.18 | 0.11 |
| T10 | S01 | AH4 | 36.6 | 1.3 | 0 | 0 | 98.7 | 100 | 1.3 | 43.4 | 54 | 0 | Δ | 0.17 | 0.11 |
| T11 | S01 | AH5 | 35.8 | 2.4 | 0 | 0 | 97.6 | 100 | 2.4 | 45.1 | 52 | 0 | Δ | 0.15 | 0.11 |
| T12 | S01 | A7 | 38.1 | 1.0 | 0 | 0 | 99.0 | 100 | 1.0 | 44.1 | 40 | 0 | ○ | 0.18 | 0.11 |
| T13 | S01 | A8 | 38.3 | 0.4 | 0 | 0 | 99.6 | 100 | 0.4 | 42.1 | 34 | 0 | ○ | 0.19 | 0.11 |
| T14 | S01 | A9 | 38.7 | 0.5 | 0 | 0 | 99.5 | 100 | 0.5 | 43.0 | 38 | 0 | ○ | 0.18 | 0.11 |
| T15 | S01 | AH6 | 37.0 | 2.1 | 0 | 0 | 97.9 | 100 | 2.1 | 45.7 | 54 | 0 | Δ | 0.15 | 0.11 |
| T16 | S01 | AH7 | 37.2 | 1.6 | 0 | 0 | 98.4 | 100 | 1.6 | 44.8 | 46 | 0 | Δ | 0.17 | 0.11 |
| T17 | S01 | AH8 | 37.0 | 0.5 | 0 | 2.7 | 96.8 | 100 | 3.2 | 42.6 | 26 | 40 or more | ○ | 0.19 | 0.11 |
| T18 | S01 | A10 | 38.5 | 0.3 | 0 | 0 | 99.7 | 100 | 0.3 | 41.8 | 32 | 0 | ○ | 0.19 | 0.11 |
| T21 | S01 | BH1 | 34.2 | 3.2 | 0 | 0 | 96.8 | 100 | 3.2 | 44.9 | 102 | 0 | Δ | 0.14 | 0.11 |
| T22 | S01 | B1 | 35.4 | 1.6 | 0 | 0 | 98.4 | 100 | 1.6 | 43.0 | 50 | 0 | Δ | 0.16 | 0.11 |
| T23 | S01 | B2 | 37.8 | 0.7 | 0 | 0 | 99.3 | 100 | 0.7 | 42.8 | 38 | 0 | ○ | 0.18 | 0.11 |
| T24 | S01 | B3 | 38.0 | 0.8 | 0 | 0 | 99.2 | 100 | 0.8 | 43.4 | 40 | 2 | ○ | 0.18 | 0.11 |
| T25 | S01 | B4 | 37.6 | 0.8 | 0 | 0.4 | 98.8 | 100 | 1.2 | 43.2 | 38 | 14 | ○ | 0.18 | 0.11 |
| T26 | S01 | BH2 | 36.8 | 0.7 | 0 | 2.7 | 96.6 | 100 | 3.4 | 43.2 | 36 | 40 or more | ○ | 0.19 | 0.11 |

TABLE 14

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T01 | S01 | AH1 | 111 | ○ | 124 | 88 | ○ | 23.5 | 0.42 |
| T02 | S01 | A1 | 115 | ○ | 28 | 20 | ○ | 41.8 | 0.09 |
| T03 | S01 | A2 | 114 | ○ | 34 | 24 | ○ | 41.0 | 0.11 |
| T04 | S01 | A3 | 115 | ○ | 44 | 30 | ○ | 40.5 | 0.11 |
| T05 | S01 | A4 | 115 | ○ | 58 | 42 | ○ | 36.8 | 0.21 |
| T06 | S01 | AH2 | 116 | ○ | 80 | 52 | ○ | 33.7 | 0.33 |
| T07 | S01 | AH3 | 119 | ○ | 100 | 56 | ○ | 30.0 | 0.46 |
| T08 | S01 | A5 | 114 | ○ | 46 | 32 | ○ | 41.2 | 0.11 |
| T09 | S01 | A6 | 115 | ○ | 74 | 44 | ○ | 39.3 | 0.31 |
| T10 | S01 | AH4 | 115 | ○ | 82 | 52 | ○ | 37.9 | 0.41 |
| T11 | S01 | AH5 | 113 | ○ | 108 | 64 | ○ | 31.3 | 0.31 |
| T12 | S01 | A7 | 112 | ○ | 64 | 40 | ○ | 38.3 | 0.17 |
| T13 | S01 | A8 | 114 | ○ | 48 | 28 | — | 41.2 | — |
| T14 | S01 | A9 | 114 | ○ | 60 | 32 | ○ | 40.4 | — |
| T15 | S01 | AH6 | 113 | ○ | 108 | 58 | ○ | 32.5 | 0.28 |
| T16 | S01 | AH7 | 114 | ○ | 82 | 50 | ○ | 34.8 | 0.23 |
| T17 | S01 | AH8 | 116 | ○ | 80 | 54 | ○ | 31.9 | 0.42 |
| T18 | S01 | A10 | 115 | ○ | 46 | 28 | — | 41.6 | — |
| T21 | S01 | BH1 | 112 | ○ | 116 | 84 | ○ | 27.9 | 0.32 |
| T22 | S01 | B1 | 113 | ○ | 84 | 46 | ○ | 36.1 | 0.23 |
| T23 | S01 | B2 | 114 | ○ | 52 | 34 | ○ | 40.1 | 0.14 |
| T24 | S01 | B3 | 113 | ○ | 56 | 38 | ○ | 38.1 | 0.11 |
| T25 | S01 | B4 | 113 | ○ | 70 | 46 | ○ | 36.8 | 0.21 |
| T26 | S01 | BH2 | 116 | ○ | 104 | 60 | ○ | 31.2 | 0.44 |

TABLE 15

| Test No. | Alloy No. | Step No. | Wear Resistance: Amsler Abrasion Test | Wear Resistance: Ball-on-disk Abrasion Test | Solidification Temperature Range(° C.) | Castability |
|---|---|---|---|---|---|---|
| T01 | S01 | AH1 | | | | |
| T02 | S01 | A1 | | | 27 | ○ |
| T03 | S01 | A2 | | | | |
| T04 | S01 | A3 | | | | |
| T05 | S01 | A4 | | | | |
| T06 | S01 | AH2 | | | | |
| T07 | S01 | AH3 | | | | |
| T08 | S01 | A5 | ◎ | ◎ | | |
| T09 | S01 | A6 | | | | |
| T10 | S01 | AH4 | | | | |
| T11 | S01 | AH5 | | | | |
| T12 | S01 | A7 | | | | |
| T13 | S01 | A8 | | | | |

TABLE 15-continued

| Test No. | Alloy No. | Step No. | Wear Resistance: Amsler Abrasion Test | Wear Resistance: Ball-on-disk Abrasion Test | Solidification Temperature Range(° C.) | Castability |
|---|---|---|---|---|---|---|
| T14 | S01 | A9 | | | | |
| T15 | S01 | AH6 | | | | |
| T16 | S01 | AH7 | | | | |
| T17 | S01 | AH8 | | | | |
| T18 | S01 | A10 | | | | |
| T21 | S01 | BH1 | ○ | ○ | | |
| T22 | S01 | B1 | | | | |
| T23 | S01 | B2 | | | | |
| T24 | S01 | B3 | | | | |
| T25 | S01 | B4 | | | | |
| T26 | S01 | BH2 | | | | |

TABLE 16

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence Of Acicular κ Phase | Amount of Sn in κ Phase (mass %) | Amount of P in κ Phase (mass %) |
|---|---|---|---|---|---|---|---|---|---|---|---|---|---|---|---|
| T31 | S02 | AH1 | 38.5 | 3.7 | 0 | 0 | 96.3 | 100 | 3.7 | 50.1 | 110 | 0 | X | 0.19 | 0.16 |
| T32 | S02 | A1 | 45.5 | 0.1 | 0 | 0 | 99.9 | 100 | 0.1 | 47.5 | 18 | 0 | ○ | 0.28 | 0.16 |
| T33 | S02 | A2 | 45.0 | 0.3 | 0 | 0 | 99.7 | 100 | 0.3 | 48.3 | 24 | 0 | ○ | 0.27 | 0.16 |
| T34 | S02 | A3 | 45.2 | 0.2 | 0 | 0 | 99.8 | 100 | 0.2 | 47.9 | 26 | 2 | ○ | 0.28 | 0.16 |
| T35 | S02 | A4 | 44.8 | 0.2 | 0 | 0.4 | 99.4 | 100 | 0.6 | 47.7 | 20 | 12 | ○ | 0.28 | 0.16 |
| T36 | S02 | AH2 | 44.3 | 0.1 | 0 | 1.7 | 98.2 | 100 | 1.8 | 47.0 | 24 | 26 | ○ | 0.28 | 0.16 |
| T37 | S02 | AH3 | 43.6 | 0.2 | 0 | 4.5 | 95.3 | 100 | 4.7 | 48.5 | 34 | 40 or more | ○ | 0.29 | 0.16 |
| T38 | S02 | A5 | 44.3 | 0.4 | 0 | 0 | 99.6 | 100 | 0.4 | 48.1 | 40 | 0 | ○ | 0.27 | 0.16 |
| T39 | S02 | A6 | 44.6 | 0.8 | 0 | 0 | 99.2 | 100 | 0.8 | 50.0 | 44 | 0 | ○ | 0.26 | 0.16 |
| T40 | S02 | AH4 | 43.7 | 1.1 | 0 | 0 | 98.9 | 100 | 1.1 | 50.0 | 52 | 0 | Δ | 0.25 | 0.16 |
| T41 | S02 | AH5 | 43.0 | 2.2 | 0 | 0 | 97.8 | 100 | 2.2 | 51.9 | 60 | 0 | Δ | 0.22 | 0.15 |
| T42 | S02 | A7 | 44.4 | 0.9 | 0 | 0 | 99.1 | 100 | 0.9 | 50.1 | 42 | 0 | ○ | 0.26 | 0.16 |

TABLE 16-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence Of Acicular κ Phase | Amount of Sn in κ Phase (mass %) | Amount of P in κ Phase (mass %) |
|---|---|---|---|---|---|---|---|---|---|---|---|---|---|---|---|
| T43 | S02 | A8 | 45.3 | 0.3 | 0 | 0 | 99.7 | 100 | 0.3 | 48.6 | 36 | 0 | ○ | 0.27 | 0.16 |
| T44 | S02 | A9 | 44.7 | 0.4 | 0 | 0 | 99.6 | 100 | 0.4 | 48.5 | 38 | 0 | ○ | 0.27 | 0.16 |
| T45 | S02 | AH6 | 43.8 | 2.1 | 0 | 0 | 97.9 | 100 | 2.1 | 52.5 | 48 | 0 | Δ | 0.23 | 0.15 |
| T46 | S02 | AH7 | 44.2 | 1.4 | 0 | 0 | 98.6 | 100 | 1.4 | 51.3 | 44 | 0 | ○ | 0.24 | 0.16 |
| T47 | S02 | AH8 | 45.3 | 0.4 | 0 | 2.4 | 97.2 | 100 | 2.8 | 50.3 | 30 | 40 or more | ○ | 0.28 | 0.16 |
| T48 | S02 | A10 | 45.5 | 0.3 | 0 | 0 | 99.7 | 100 | 0.3 | 48.8 | 34 | 0 | ○ | 0.27 | 0.16 |
| T51 | S02 | BH1 | 39.9 | 2.9 | 0 | 0 | 97.1 | 100 | 2.9 | 50.1 | 98 | 0 | Δ | 0.20 | 0.16 |
| T52 | S02 | B1 | 41.7 | 1.4 | 0 | 0 | 98.6 | 100 | 1.4 | 48.8 | 46 | 0 | ○ | 0.24 | 0.16 |
| T53 | S02 | B2 | 45.0 | 0.6 | 0 | 0 | 99.4 | 100 | 0.6 | 49.7 | 32 | 0 | ○ | 0.27 | 0.16 |
| T54 | S02 | B3 | 45.4 | 0.7 | 0 | 0 | 99.3 | 100 | 0.7 | 50.4 | 36 | 1 | ○ | 0.26 | 0.16 |
| T55 | S02 | B4 | 44.8 | 0.6 | 0 | 0.3 | 99.1 | 100 | 0.9 | 49.6 | 32 | 10 | ○ | 0.27 | 0.16 |
| T56 | S02 | BH2 | 44.0 | 0.5 | 0 | 2.3 | 97.2 | 100 | 2.8 | 49.4 | 34 | 40 or more | ○ | 0.28 | 0.16 |

TABLE 17

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T31 | S02 | AH1 | 109 | ○ | 122 | 82 | ○ | 21.7 | 0.33 |
| T32 | S02 | A1 | 111 | ○ | 26 | 18 | ○ | 35.5 | 0.08 |
| T33 | S02 | A2 | 115 | ○ | 26 | 18 | — | 35.0 | — |
| T34 | S02 | A3 | 115 | ○ | 38 | 22 | — | 34.2 | 0.10 |
| T35 | S02 | A4 | 115 | ○ | 54 | 36 | ○ | 32.3 | 0.16 |
| T36 | S02 | AH2 | 115 | ○ | 80 | 52 | ○ | 30.0 | 0.27 |
| T37 | S02 | AH3 | 113 | ○ | 106 | 66 | ○ | 25.5 | 0.44 |
| T38 | S02 | A5 | 115 | ○ | 50 | 34 | ○ | 35.0 | — |
| T39 | S02 | A6 | 114 | ○ | 62 | 44 | — | 33.1 | — |
| T40 | S02 | AH4 | 113 | ○ | 76 | 54 | ○ | 32.3 | — |
| T41 | S02 | AH5 | 113 | ○ | 102 | 58 | ○ | 26.6 | 0.29 |
| T42 | S02 | A7 | 113 | ○ | 60 | 38 | — | 32.8 | 0.16 |
| T43 | S02 | A8 | 115 | ○ | 44 | 30 | — | 34.8 | — |
| T44 | S02 | A9 | 111 | ○ | 52 | 30 | — | 34.8 | — |
| T45 | S02 | AH6 | 113 | ○ | 92 | 54 | — | 27.2 | — |
| T46 | S02 | AH7 | 112 | ○ | 74 | 46 | — | 29.7 | 0.21 |
| T47 | S02 | AH8 | 116 | ○ | 108 | 60 | ○ | 26.9 | — |
| T48 | S02 | A10 | 115 | ○ | 44 | 32 | — | 34.7 | — |
| T51 | S02 | BH1 | 110 | ○ | 110 | 80 | — | 24.2 | 0.27 |
| T52 | S02 | B1 | 111 | ○ | 72 | 46 | ○ | 31.2 | 0.21 |
| T53 | S02 | B2 | 114 | ○ | 48 | 30 | — | 33.7 | 0.13 |
| T54 | S02 | B3 | 113 | ○ | 54 | 34 | — | 31.9 | — |
| T55 | S02 | B4 | 114 | ○ | 62 | 38 | — | 31.6 | 0.19 |
| T56 | S02 | BH2 | 116 | ○ | 104 | 66 | ○ | 27.4 | 0.41 |

TABLE 18

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T31 | S02 | AH1 | Δ | ◎ | | |
| T32 | S02 | A1 | | | 30 | ○ |
| T33 | S02 | A2 | | | | |
| T34 | S02 | A3 | | | | |
| T35 | S02 | A4 | | | | |
| T36 | S02 | AH2 | ◎ | ○ | | |
| T37 | S02 | AH3 | ◎ | Δ | | |

TABLE 18-continued

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T38 | S02 | A5 | | | | |
| T39 | S02 | A6 | | | | |
| T40 | S02 | AH4 | | | | |
| T41 | S02 | AH5 | | | | |
| T42 | S02 | A7 | | | | |
| T43 | S02 | A8 | | | | |
| T44 | S02 | A9 | ◎ | ◎ | | |

TABLE 18-continued

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T45 | S02 | AH6 | | | | |
| T46 | S02 | AH7 | | | | |
| T47 | S02 | AH8 | | | | |
| T48 | S02 | A10 | | | | |
| T51 | S02 | BH1 | | | | |
| T52 | S02 | B1 | ○ | ◎ | | |
| T53 | S02 | B2 | ◎ | ◎ | | |
| T54 | S02 | B3 | | | | |
| T55 | S02 | B4 | | | | |
| T56 | S02 | BH2 | | | | |

TABLE 21

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T61 | S03 | AH1 | Δ | ○ | | |
| T62 | S03 | A1 | ◎ | ○ | 29 | ○ |
| T63 | S03 | A2 | | | | |
| T64 | S03 | A3 | | | | |
| T65 | S03 | A4 | | | | |
| T66 | S03 | AH2 | | | | |
| T67 | S03 | AH3 | ○ | Δ | | |
| T68 | S03 | A5 | | | | |
| T69 | S03 | A6 | | | | |
| T70 | S03 | AH4 | | | | |
| T71 | S03 | AH5 | | | | |

TABLE 19

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T61 | S03 | AH1 | 30.6 | 3.5 | 0 | 0 | 96.5 | 100 | 3.5 | 41.8 | 120 | 0 | X | 0.09 | 0.12 |
| T62 | S03 | A1 | 34.2 | 0.2 | 0 | 0 | 99.8 | 100 | 0.2 | 37.1 | 22 | 0 | ○ | 0.13 | 0.13 |
| T63 | S03 | A2 | 34.0 | 0.1 | 0 | 0 | 99.9 | 100 | 0.1 | 35.9 | 20 | 1 | ○ | 0.13 | 0.13 |
| T64 | S03 | A3 | 34.2 | 0.2 | 0 | 0 | 99.8 | 100 | 0.2 | 36.9 | 24 | 5 | ○ | 0.13 | 0.13 |
| T65 | S03 | A4 | 33.6 | 0.2 | 0 | 0.8 | 99.0 | 100 | 1.0 | 36.7 | 22 | 18 | ○ | 0.13 | 0.13 |
| T66 | S03 | AH2 | 33.1 | 0.2 | 0 | 2.6 | 97.2 | 100 | 2.8 | 37.1 | 22 | 34 | ○ | 0.14 | 0.13 |
| T67 | S03 | AH3 | 33.0 | 0.1 | 0 | 5.5 | 94.4 | 100 | 5.6 | 37.6 | 26 | 40 or more | ○ | 0.14 | 0.13 |
| T68 | S03 | A5 | 33.5 | 0.4 | 0 | 0 | 99.6 | 100 | 0.4 | 37.3 | 38 | 0 | Δ | 0.13 | 0.13 |
| T69 | S03 | A6 | 33.5 | 0.7 | 0 | 0 | 99.3 | 100 | 0.7 | 38.5 | 52 | 0 | Δ | 0.13 | 0.13 |
| T70 | S03 | AH4 | 33.2 | 1.0 | 0 | 0 | 99.0 | 100 | 1.0 | 39.2 | 60 | 0 | X | 0.12 | 0.13 |
| T71 | S03 | AH5 | 32.4 | 1.7 | 0 | 0 | 98.3 | 100 | 1.7 | 40.2 | 52 | 0 | X | 0.11 | 0.13 |
| T72 | S03 | A7 | 33.2 | 0.8 | 0 | 0 | 99.2 | 100 | 0.8 | 38.6 | 36 | 0 | ○ | 0.13 | 0.13 |
| T73 | S03 | A8 | 34.3 | 0.4 | 0 | 0 | 99.6 | 100 | 0.4 | 38.1 | 20 | 0 | ○ | 0.13 | 0.13 |
| T74 | S03 | A9 | 34.0 | 0.3 | 0 | 0 | 99.7 | 100 | 0.3 | 37.3 | 19 | 0 | ○ | 0.13 | 0.13 |
| T75 | S03 | AH6 | 33.3 | 1.6 | 0 | 0 | 98.4 | 100 | 1.6 | 40.9 | 56 | 0 | Δ | 0.11 | 0.13 |
| T76 | S03 | AH7 | 33.3 | 1.8 | 0 | 0 | 98.2 | 100 | 1.8 | 41.3 | 52 | 0 | X | 0.11 | 0.12 |
| T77 | S03 | AH8 | 34.4 | 0.3 | 0 | 2.7 | 97.0 | 100 | 3.0 | 39.0 | 16 | 40 or more | ○ | 0.13 | 0.13 |

TABLE 20

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T61 | S03 | AH1 | 115 | ○ | 124 | 84 | — | 31.3 | — |
| T62 | S03 | A1 | 120 | ○ | 30 | 18 | — | 47.6 | — |
| T63 | S03 | A2 | 125 | ○ | 32 | 22 | — | 48.6 | — |
| T64 | S03 | A3 | 123 | ○ | 40 | 32 | — | 46.2 | — |
| T65 | S03 | A4 | 123 | ○ | 62 | 40 | — | 42.7 | 0.23 |
| T66 | S03 | AH2 | 122 | ○ | 76 | 52 | — | 37.6 | 0.38 |
| T67 | S03 | AH3 | 120 | ○ | 102 | 56 | ○ | 31.5 | 0.47 |
| T68 | S03 | A5 | 124 | ○ | 48 | 30 | — | 47.3 | — |
| T69 | S03 | A6 | 122 | ○ | 78 | 52 | — | 45.5 | — |
| T70 | S03 | AH4 | 122 | ○ | 88 | 56 | — | 44.0 | — |
| T71 | S03 | AH5 | 119 | ○ | 90 | 56 | ○ | 38.5 | — |
| T72 | S03 | A7 | 121 | ○ | 52 | 36 | — | 45.2 | — |
| T73 | S03 | A8 | 122 | ○ | 34 | 22 | — | 46.5 | 0.11 |
| T74 | S03 | A9 | 119 | ○ | 28 | 20 | — | 47.4 | — |
| T75 | S03 | AH6 | 119 | ○ | 86 | 54 | — | 39.1 | — |
| T76 | S03 | AH7 | 118 | ○ | 90 | 56 | ○ | 38.0 | 0.25 |
| T77 | S03 | AH8 | 119 | ○ | 76 | 52 | — | 35.8 | 0.33 |

TABLE 21-continued

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T72 | S03 | A7 | | | | |
| T73 | S03 | A8 | | | | |
| T74 | S03 | A9 | | | | |
| T75 | S03 | AH6 | | | | |
| T76 | S03 | AH7 | | | | |
| T77 | S03 | AH8 | | | | |

TABLE 24

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T81 | S03 | BH1 | | | | |
| T82 | S03 | B1 | ○ | ○ | | |
| T83 | S03 | B2 | | | | |
| T84 | S03 | B3 | | | | |
| T85 | S03 | B4 | | | | |
| T86 | S03 | BH2 | | | | |
| T101 | S04 | CH1 | ○ | ○ | 27 | |

TABLE 22

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T81 | S03 | BH1 | 31.4 | 2.6 | 0 | 0 | 97.4 | 100 | 2.6 | 41.1 | 90 | 0 | X | 0.10 | 0.13 |
| T82 | S03 | B1 | 33.0 | 1.1 | 0 | 0 | 98.9 | 100 | 1.1 | 39.3 | 40 | 0 | Δ | 0.12 | 0.13 |
| T83 | S03 | B2 | 34.3 | 0.4 | 0 | 0 | 99.6 | 100 | 0.4 | 38.1 | 32 | 0 | ○ | 0.13 | 0.13 |
| T84 | S03 | B3 | 34.6 | 0.5 | 0 | 0 | 99.5 | 100 | 0.5 | 38.8 | 28 | 2 | ○ | 0.13 | 0.13 |
| T85 | S03 | B4 | 34.3 | 0.3 | 0 | 0.3 | 99.4 | 100 | 0.6 | 37.7 | 22 | 12 | ○ | 0.13 | 0.13 |
| T86 | S03 | BH2 | 33.5 | 0.4 | 0 | 2.7 | 96.9 | 100 | 3.1 | 38.7 | 26 | 40 or more | ○ | 0.13 | 0.13 |
| T101 | S04 | CH1 | 37.3 | 4.0 | 0 | 0 | 96.0 | 100 | 4.0 | 49.3 | 150 or more | 0 | X | 0.16 | 0.17 |
| T102 | S04 | C1 | 43.2 | 0.2 | 0 | 0 | 99.8 | 100 | 0.2 | 45.9 | 18 | 0 | ○ | 0.24 | 0.17 |
| T103 | S04 | C2 | 43.0 | 0.3 | 0 | 0 | 99.7 | 100 | 0.3 | 46.3 | 12 | 3 | ○ | 0.24 | 0.17 |
| T104 | S04 | C3 | 42.8 | 0.2 | 0 | 0.5 | 99.3 | 100 | 0.7 | 45.7 | 16 | 12 | ○ | 0.24 | 0.17 |
| T105 | S04 | CH2 | 42.0 | 0.1 | 0 | 1.8 | 98.1 | 100 | 1.9 | 44.8 | 16 | 28 | ○ | 0.25 | 0.18 |
| T106 | S04 | C4 | 43.0 | 0.3 | 0 | 0 | 99.7 | 100 | 0.3 | 46.3 | 26 | 0 | ○ | 0.24 | 0.17 |
| T107 | S04 | CH3 | 41.7 | 0.4 | 0 | 2.4 | 97.2 | 100 | 2.8 | 46.7 | 26 | 40 or more | ○ | 0.25 | 0.18 |

TABLE 23

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T81 | S03 | BH1 | 116 | ○ | 112 | 70 | ○ | 35.5 | 0.25 |
| T82 | S03 | B1 | 117 | ○ | 62 | 38 | ○ | 42.1 | — |
| T83 | S03 | B2 | 122 | ○ | 48 | 30 | — | 46.5 | — |
| T84 | S03 | B3 | 121 | ○ | 46 | 28 | — | 44.0 | — |
| T85 | S03 | B4 | 122 | ○ | 42 | 26 | ○ | 43.9 | — |
| T86 | S03 | BH2 | 120 | ○ | 80 | 54 | ○ | 36.0 | 0.42 |
| T101 | S04 | CH1 | 109 | ○ | 140 | 94 | ○ | 22.5 | 0.36 |
| T102 | S04 | C1 | 111 | ○ | 24 | 16 | — | 37.3 | 0.10 |
| T103 | S04 | C2 | 115 | ○ | 30 | 20 | — | 35.8 | 0.11 |
| T104 | S04 | C3 | 116 | ○ | 52 | 38 | ○ | 34.6 | 0.21 |
| T105 | S04 | CH2 | 118 | ○ | 102 | 56 | ○ | 31.7 | 0.29 |
| T106 | S04 | C4 | 112 | ○ | 36 | 22 | — | 35.8 | 0.19 |
| T107 | S04 | CH3 | 117 | ○ | 108 | 64 | ○ | 29.3 | 0.40 |

TABLE 24-continued

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T102 | S04 | C1 | | | | |
| T103 | S04 | C2 | | | | |
| T104 | S04 | C3 | ◎ | ○ | | |
| T105 | S04 | CH2 | | | | |
| T106 | S04 | C4 | ◎ | ◎ | | |
| T107 | S04 | CH3 | | | | |

TABLE 27

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T111 | S05 | CH1 | | | 25 | |
| T112 | S05 | C1 | | | | |
| T113 | S05 | C2 | ◎ | ◎ | | |
| T114 | S05 | C3 | | | | |
| T115 | S05 | CH2 | | | | |
| T116 | S05 | C4 | | | | |
| T117 | S0S | CH3 | | | | |

TABLE 25

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T111 | S05 | CH1 | 33.6 | 4.1 | 0 | 0 | 95.9 | 100 | 4.1 | 45.8 | 140 | 0 | X | 0.10 | 0.13 |
| T112 | S05 | C1 | 40.2 | 0.4 | 0 | 0 | 99.6 | 100 | 0.4 | 44.0 | 21 | 0 | ○ | 0.14 | 0.13 |
| T113 | S05 | C2 | 40.0 | 0.3 | 0 | 0 | 99.7 | 100 | 0.3 | 43.3 | 19 | 4 | ○ | 0.14 | 0.14 |
| T114 | S05 | C3 | 39.7 | 0.3 | 0 | 0.8 | 98.9 | 100 | 1.1 | 43.4 | 20 | 18 | ○ | 0.14 | 0.14 |
| T115 | S05 | CH2 | 39.0 | 0.3 | 0 | 2.6 | 97.1 | 100 | 2.9 | 43.6 | 19 | 34 | ○ | 0.14 | 0.14 |
| T116 | S05 | C4 | 39.9 | 0.7 | 0 | 0 | 99.3 | 100 | 0.7 | 44.9 | 28 | 0 | ○ | 0.13 | 0.13 |
| T117 | S05 | CH3 | 38.5 | 0.6 | 0 | 2.7 | 96.7 | 100 | 3.3 | 44.5 | 24 | 40 or more | ○ | 0.14 | 0.14 |
| T121 | S06 | CH1 | 39.3 | 3.3 | 0 | 0 | 96.7 | 100 | 3.3 | 50.2 | 124 | 0 | X | 0.21 | 0.09 |
| T122 | S06 | C1 | 48.4 | 0.2 | 0 | 0 | 99.8 | 100 | 0.2 | 51.1 | 18 | 0 | ○ | 0.28 | 0.09 |
| T123 | S06 | C2 | 48.0 | 0.2 | 0 | 0 | 99.8 | 100 | 0.2 | 50.7 | 18 | 4 | ○ | 0.28 | 0.09 |
| T124 | S06 | C3 | 48.3 | 0.2 | 0 | 0.8 | 99.0 | 100 | 1.0 | 51.4 | 20 | 18 | ○ | 0.29 | 0.09 |
| T125 | S06 | CH2 | 47.5 | 0.1 | 0 | 2.6 | 97.3 | 100 | 2.7 | 50.7 | 16 | 34 | ○ | 0.29 | 0.09 |
| T126 | S06 | C4 | 48.2 | 0.4 | 0 | 0 | 99.6 | 100 | 0.4 | 52.0 | 28 | 0 | ○ | 0.28 | 0.09 |
| T127 | S06 | CH3 | 47.4 | 0.4 | 0 | 2.7 | 96.9 | 100 | 3.1 | 52.5 | 24 | 40 or more | ○ | 0.29 | 0.09 |

TABLE 26

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T111 | S05 | CH1 | 111 | ○ | 128 | 90 | ○ | 25.1 | 0.41 |
| T112 | S05 | C1 | 113 | ○ | 28 | 18 | — | 39.6 | 0.14 |
| T113 | S05 | C2 | 116 | ○ | 34 | 22 | — | 38.9 | — |
| T114 | S05 | C3 | 116 | ○ | 64 | 40 | — | 36.5 | — |
| T115 | S05 | CH2 | 117 | ○ | 88 | 58 | — | 31.6 | 0.42 |
| T116 | S05 | C4 | 113 | ○ | 44 | 30 | — | 37.0 | — |
| T117 | S05 | CH3 | 117 | ○ | 102 | 54 | ○ | 30.4 | 0.45 |
| T121 | S06 | CH1 | 110 | ○ | 128 | 86 | ○ | 23.5 | — |
| T122 | S06 | C1 | 111 | ○ | 26 | 16 | — | 32.5 | 0.09 |
| T123 | S06 | C2 | 115 | ○ | 34 | 24 | — | 31.7 | — |
| T124 | S06 | C3 | 114 | ○ | 62 | 30 | — | 29.4 | — |
| T125 | S06 | CH2 | 116 | ○ | 82 | 52 | — | 25.7 | — |
| T126 | S06 | C4 | 112 | ○ | 42 | 28 | — | 30.8 | — |
| T127 | S06 | CH3 | 115 | ○ | 96 | 54 | ○ | 24.6 | 0.40 |

TABLE 27-continued

| Test No. | Alloy No. | Step No. | Wear Resistance: Amsler Abrasion Test | Wear Resistance: Ball-on-disk Abrasion Test | Solidification Temperature Range (° C.) | Castability |
|---|---|---|---|---|---|---|
| T121 | S06 | CH1 | | | 33 | |
| T122 | S06 | C1 | | | | |
| T123 | S06 | C2 | | | | |
| T124 | S06 | C3 | | | | |
| T125 | S06 | CH2 | | | | |
| T126 | S06 | C4 | ◎ | ◎ | | |
| T127 | S06 | CH3 | | | | |

TABLE 28

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T201 | S11 | AH1 | 33.5 | 4.2 | 0 | 0 | 95.8 | 100 | 4.2 | 45.8 | 124 | 0 | X | 0.14 | 0.12 |
| T202 | S11 | A1 | 38.7 | 0.2 | 0 | 0 | 99.8 | 100 | 0.2 | 41.5 | 20 | 0 | ○ | 0.21 | 0.12 |
| T203 | S11 | A8 | 38.2 | 0.3 | 0 | 0 | 99.7 | 100 | 0.3 | 41.5 | 32 | 0 | ○ | 0.21 | 0.12 |
| T204 | S11 | A9 | 38.7 | 0.4 | 0 | 0 | 99.6 | 100 | 0.4 | 42.5 | 36 | 0 | ○ | 0.21 | 0.12 |
| T205 | S11 | BH1 | 34.2 | 3.5 | 0 | 0 | 96.5 | 100 | 3.5 | 45.4 | 110 | 0 | X | 0.15 | 0.12 |
| T206 | S11 | B1 | 35.0 | 1.6 | 0 | 0 | 98.4 | 100 | 1.6 | 42.6 | 46 | 0 | Δ | 0.19 | 0.12 |
| T207 | S11 | B2 | 37.8 | 0.6 | 0 | 0 | 99.4 | 100 | 0.6 | 42.4 | 40 | 0 | ○ | 0.21 | 0.12 |
| T208 | S12 | AH1 | 39.4 | 3.7 | 0 | 0 | 96.3 | 100 | 3.7 | 50.9 | 110 | 0 | X | 0.19 | 0.16 |
| T209 | S12 | A1 | 45.5 | 0.1 | 0 | 0 | 99.9 | 100 | 0.1 | 47.5 | 22 | 0 | ○ | 0.27 | 0.16 |
| T210 | S12 | A8 | 45.3 | 0.3 | 0 | 0 | 99.7 | 100 | 0.3 | 48.6 | 34 | 0 | ○ | 0.26 | 0.16 |
| T211 | S12 | A9 | 44.7 | 0.4 | 0 | 0 | 99.6 | 100 | 0.4 | 48.5 | 38 | 0 | ○ | 0.26 | 0.16 |
| T212 | S12 | BH1 | 40.8 | 2.9 | 0 | 0 | 97.1 | 100 | 2.9 | 51.0 | 100 | 0 | Δ | 0.20 | 0.16 |
| T213 | S12 | B1 | 42.8 | 1.4 | 0 | 0 | 98.6 | 100 | 1.4 | 49.9 | 46 | 0 | ○ | 0.24 | 0.16 |
| T214 | S12 | B2 | 46.2 | 0.6 | 0 | 0 | 99.4 | 100 | 0.6 | 50.8 | 34 | 0 | ○ | 0.26 | 0.15 |
| T215 | S13 | AH1 | 43.7 | 1.5 | 0 | 0 | 98.5 | 100 | 1.5 | 51.0 | 64 | 0 | X | 0.11 | 0.09 |
| T216 | S13 | A1 | 52.5 | 0.1 | 0 | 0 | 99.9 | 100 | 0.1 | 54.4 | 20 | 0 | ○ | 0.12 | 0.09 |
| T217 | S13 | A8 | 52.6 | 0.2 | 0 | 0 | 99.8 | 100 | 0.2 | 55.3 | 22 | 0 | ○ | 0.12 | 0.09 |
| T218 | S13 | A9 | 52.0 | 0.2 | 0 | 0 | 99.8 | 100 | 0.1 | 54.7 | 22 | 0 | ○ | 0.12 | 0.09 |
| T219 | S13 | BH1 | 45.2 | 1.1 | 0 | 0 | 98.9 | 100 | 1.1 | 51.5 | 48 | 0 | Δ | 0.12 | 0.09 |
| T220 | S13 | B1 | 52.0 | 0.6 | 0 | 0 | 99.4 | 100 | 0.9 | 56.6 | 42 | 0 | ○ | 0.12 | 0.09 |
| T221 | S13 | B2 | 52.5 | 0.3 | 0 | 0 | 99.7 | 100 | 0.3 | 55.8 | 32 | 0 | ○ | 0.12 | 0.09 |
| T222 | S14 | AH1 | 46.1 | 2.2 | 0 | 0 | 97.8 | 100 | 2.2 | 55.0 | 72 | 0 | X | 0.23 | 0.11 |
| T223 | S14 | A1 | 56.4 | 0 | 0 | 0 | 100 | 100 | 0 | 57.5 | 0 | 0 | ○ | 0.28 | 0.11 |

TABLE 29

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T201 | S11 | AH1 | 109 | ○ | 120 | 88 | ○ | 23.6 | 0.46 |
| T202 | S11 | A1 | 114 | ○ | 24 | 18 | ○ | 41.9 | 0.09 |
| T203 | S11 | A8 | 114 | ○ | 40 | 28 | — | 41.9 | — |
| T204 | S11 | A9 | 113 | ○ | 48 | 32 | ○ | 41.0 | — |
| T205 | S11 | BH1 | 110 | ○ | 112 | 82 | — | 26.4 | 0.40 |
| T206 | S11 | B1 | 113 | ○ | 84 | 46 | ○ | 36.4 | 0.23 |
| T207 | S11 | B2 | 113 | ○ | 52 | 32 | ○ | 40.6 | 0.13 |
| T208 | S12 | AH1 | 108 | ○ | 122 | 82 | ○ | 19.8 | 0.42 |
| T209 | S12 | A1 | 110 | ○ | 26 | 18 | ○ | 35.2 | 0.08 |
| T210 | S12 | A8 | 113 | ○ | 42 | 28 | — | 34.5 | — |
| T211 | S12 | A9 | 111 | ○ | 48 | 32 | — | 34.5 | — |
| T212 | S12 | BH1 | 110 | ○ | 110 | 80 | — | 22.0 | 0.29 |
| T213 | S12 | B1 | 111 | ○ | 70 | 44 | ○ | 30.2 | 0.21 |
| T214 | S12 | B2 | 113 | ○ | 46 | 28 | — | 32.7 | 0.13 |
| T215 | S13 | AH1 | 110 | ○ | 98 | 64 | — | 26.3 | 0.22 |
| T216 | S13 | A1 | 114 | ○ | 30 | 18 | — | 28.2 | — |
| T217 | S13 | A8 | 117 | ○ | 34 | 22 | — | 27.8 | 0.09 |
| T218 | S13 | A9 | 114 | ○ | 28 | 20 | — | 28.0 | — |
| T219 | S13 | BH1 | 113 | ○ | 76 | 46 | ○ | 28.1 | 0.18 |
| T220 | S13 | B1 | 115 | ○ | 60 | 38 | ○ | 26.6 | — |
| T221 | S13 | B2 | 117 | ○ | 42 | 28 | — | 27.5 | — |

TABLE 29-continued

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T222 | S14 | AH1 | 114 | ○ | 102 | 70 | — | 20.9 | 0.31 |
| T223 | S14 | A1 | 117 | ○ | 30 | 18 | — | 23.9 | — |

TABLE 30

| Test No. | Alloy No. | Step No. | Wear Resistance: Amsler Abrasion Test | Wear Resistance: Ball-on-disk Abrasion Test | Solidification: Temperature Range (° C.) | Cast-ability |
|---|---|---|---|---|---|---|
| T201 | S11 | AH1 | | | 27 | |
| T202 | S11 | A1 | | | 27 | ○ |
| T203 | S11 | A8 | | | | |
| T204 | S11 | A9 | | | | |
| T205 | S11 | BH1 | | | | |
| T206 | S11 | B1 | | | | |
| T207 | S11 | B2 | | | | |
| T208 | S12 | AH1 | | | 29 | |
| T209 | S12 | A1 | ◎ | ◎ | 29 | ○ |
| T210 | S12 | A8 | | | | |
| T211 | S12 | A9 | | | | |
| T212 | S12 | BH1 | | | | |

TABLE 30-continued

| Test No. | Alloy No. | Step No. | Wear Resistance: Amsler Abrasion Test | Wear Resistance: Ball-on-disk Abrasion Test | Solidification: Temperature Range (° C.) | Cast-ability |
|---|---|---|---|---|---|---|
| T213 | S12 | B1 | | | | |
| T214 | S12 | B2 | | | | |
| T215 | S13 | AH1 | | | 29 | |
| T216 | S13 | A1 | ◎ | ○ | 29 | ○ |
| T217 | S13 | A8 | | | | |
| T218 | S13 | A9 | | | | |
| T219 | S13 | BH1 | | | | |
| T220 | S13 | B1 | ◎ | ◎ | | |
| T221 | S13 | B2 | | | | |
| T222 | S14 | AH1 | | | 37 | |
| T223 | S14 | A1 | ◎ | ○ | | Δ |

TABLE 31

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T224 | S15 | AH1 | 45.1 | 2.6 | 0 | 0 | 97.4 | 100 | 2.6 | 54.7 | 90 | 0 | X | 0.20 | 0.13 |
| T225 | S15 | B2 | 54.6 | 0.2 | 0 | 0 | 99.8 | 100 | 0.2 | 57.3 | 22 | 0 | ○ | 0.26 | 0.12 |
| T226 | S16 | AH1 | 34.1 | 4.3 | 0 | 0 | 95.7 | 100 | 4.3 | 46.6 | 110 | 0 | X | 0.20 | 0.15 |
| T227 | S16 | A1 | 45.5 | 0.3 | 0 | 0 | 99.7 | 100 | 0.3 | 48.8 | 28 | 0 | ○ | 0.30 | 0.14 |
| T228 | S17 | AH1 | 42.6 | 1.7 | 0 | 0 | 98.3 | 100 | 1.7 | 50.4 | 62 | 0 | X | 0.12 | 0.09 |
| T229 | S17 | A1 | 51.4 | 0.1 | 0 | 0 | 99.9 | 100 | 0.1 | 53.3 | 20 | 0 | ○ | 0.14 | 0.09 |
| T230 | S17 | BH1 | 45.2 | 1.0 | 0 | 0 | 99.0 | 100 | 1.0 | 51.2 | 44 | 0 | Δ | 0.13 | 0.09 |
| T231 | S17 | B2 | 50.4 | 0.3 | 0 | 0 | 99.7 | 100 | 0.3 | 53.7 | 30 | 0 | ○ | 0.13 | 0.09 |
| T232 | S18 | AH1 | 43.0 | 4.2 | 0 | 0 | 95.8 | 100 | 4.2 | 55.3 | 120 | 0 | X | 0.20 | 0.18 |
| T233 | S18 | A1 | 51.2 | 0.3 | 0 | 0 | 99.7 | 100 | 0.3 | 54.5 | 38 | 0 | ○ | 0.30 | 0.18 |
| T234 | S19 | AH1 | 35.9 | 5.1 | 0 | 0 | 94.9 | 100 | 5.1 | 49.4 | 150 or more | 0 | X | 0.11 | 0.13 |
| T235 | S19 | A1 | 42.4 | 0.6 | 0 | 0 | 99.4 | 100 | 0.6 | 47.1 | 40 | 0 | ○ | 0.17 | 0.13 |
| T236 | S20 | A1 | 25.4 | 0.7 | 0 | 0 | 99.3 | 100 | 0.7 | 30.4 | 44 | 0 | Δ | 0.11 | 0.12 |
| T237 | S21 | AH1 | 30.5 | 3.8 | 0 | 0 | 96.2 | 100 | 3.8 | 42.2 | 120 | 0 | X | 0.09 | 0.10 |
| T238 | S21 | A1 | 33.6 | 0.2 | 0 | 0 | 99.8 | 100 | 0.2 | 36.5 | 22 | 0 | ○ | 0.13 | 0.10 |
| T239 | S22 | AH1 | 25.2 | 5.2 | 0 | 0 | 94.8 | 100 | 5.2 | 38.9 | 122 | 0 | X | 0.06 | 0.10 |
| T240 | S22 | A1 | 29.3 | 0.9 | 0 | 0 | 99.1 | 100 | 0.9 | 35.0 | 46 | 0 | Δ | 0.10 | 0.10 |
| T241 | S23 | AH1 | 31.9 | 2.4 | 0 | 0 | 97.6 | 100 | 2.4 | 41.2 | 92 | 0 | X | 0.08 | 0.10 |
| T242 | S23 | A8 | 34.5 | 0.3 | 0 | 0 | 99.7 | 100 | 0.3 | 37.8 | 34 | 0 | Δ | 0.09 | 0.10 |
| T243 | S23 | A9 | 34.7 | 0.4 | 0 | 0 | 99.6 | 100 | 0.4 | 38.5 | 38 | 0 | ○ | 0.09 | 0.10 |
| T244 | S23 | BH1 | 32.5 | 2.0 | 0 | 0 | 98.0 | 100 | 2.0 | 41.0 | 80 | 0 | X | 0.08 | 0.10 |
| T245 | S23 | B2 | 34.4 | 0.6 | 0 | 0 | 99.4 | 100 | 0.6 | 39.0 | 38 | 0 | ○ | 0.09 | 0.10 |

TABLE 32

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T224 | S15 | AH1 | 113 | ○ | 108 | 82 | — | 18.6 | 0.27 |
| T225 | S15 | B2 | 115 | ○ | 30 | 20 | — | 23.4 | 0.09 |
| T226 | S16 | AH1 | 110 | ○ | 120 | 82 | ○ | 22.7 | 0.44 |
| T227 | S16 | A1 | 115 | ○ | 32 | 20 | ○ | 36.5 | 0.09 |
| T228 | S17 | AH1 | 111 | ○ | 98 | 66 | — | 27.7 | 0.19 |
| T229 | S17 | A1 | 114 | ○ | 30 | 22 | — | 30.5 | — |

TABLE 32-continued

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T230 | S17 | BH1 | 111 | ○ | 74 | 48 | — | 28.9 | — |
| T231 | S17 | B2 | 113 | ○ | 30 | 22 | — | 30.2 | — |
| T232 | S18 | AH1 | 110 | ○ | 114 | 88 | ○ | 15.2 | 0.42 |
| T233 | S18 | A1 | 117 | ○ | 44 | 28 | ○ | 23.0 | 0.13 |
| T234 | S19 | AH1 | 107 | ○ | 142 | 108 | — | 19.3 | 0.48 |
| T235 | S19 | A1 | 111 | ○ | 54 | 36 | — | 36.3 | — |
| T236 | S20 | A1 | 132 | ○ | 78 | 46 | — | 58.6 | — |
| T237 | S21 | AH1 | 115 | ○ | 124 | 90 | — | 29.8 | 0.42 |
| T238 | S21 | A1 | 123 | ○ | 42 | 28 | — | 48.3 | — |
| T239 | S22 | AH1 | 116 | ○ | 122 | 96 | — | 27.9 | 0.47 |
| T240 | S22 | A1 | 125 | ○ | 72 | 44 | — | 50.4 | — |
| T241 | S23 | AH1 | 119 | ○ | 110 | 80 | ○ | 34.9 | — |
| T242 | S23 | A8 | 125 | ○ | 52 | 32 | — | 46.5 | — |
| T243 | S23 | A9 | 124 | ○ | 62 | 36 | ○ | 45.7 | — |
| T244 | S23 | BH1 | 119 | ○ | 106 | 80 | ○ | 36.8 | 0.23 |
| T245 | S23 | B2 | 123 | ○ | 66 | 42 | ○ | 44.8 | 0.12 |

TABLE 33

| Test No. | Alloy No. | Step No. | Wear Resistance: Amsler Abrasion Test | Wear Resistance: Ball-on-disk Abrasion Test | Solidification: Temperature Range (° C.) | Cast-ability |
|---|---|---|---|---|---|---|
| T224 | S15 | AH1 | | | 30 | |
| T225 | S15 | B2 | | | | ○ |
| T226 | S16 | AH1 | | | 33 | |
| T227 | S16 | A1 | ◎ | ◎ | | ○ |
| T228 | S17 | AH1 | | | 29 | |
| T229 | S17 | A1 | | | | ○ |
| T230 | S17 | BH1 | | | 29 | |
| T231 | S17 | B2 | | | | ○ |
| T232 | S18 | AH1 | | | 23 | |
| T233 | S18 | A1 | | | | ○ |
| T234 | S19 | AH1 | | | 20 | |
| T235 | S19 | A1 | | | | |

TABLE 33-continued

| Test No. | Alloy No. | Step No. | Wear Resistance: Amsler Abrasion Test | Wear Resistance: Ball-on-disk Abrasion Test | Solidification: Temperature Range (° C.) | Cast-ability |
|---|---|---|---|---|---|---|
| T236 | S20 | A1 | | | 29 | |
| T237 | S21 | AH1 | | | 33 | |
| T238 | S21 | A1 | | | | Δ |
| T239 | S22 | AH1 | | | 29 | |
| T240 | S22 | A1 | | | | |
| T241 | S23 | AH1 | | | 34 | |
| T242 | S23 | A8 | | | | Δ |
| T243 | S23 | A9 | | | | |
| T244 | S23 | BH1 | | | | |
| T245 | S23 | B2 | | | | |

TABLE 34

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T301 | S51 | AH1 | 28.1 | 6.4 | 0 | 0 | 93.6 | 100 | 6.4 | 43.3 | 150 or more | 0 | X | 0.22 | 0.11 |
| T302 | S51 | A1 | 31.6 | 2.1 | 0 | 0 | 97.9 | 100 | 2.1 | 40.3 | 60 | 0 | ○ | 0.34 | 0.11 |
| T303 | S52 | AH1 | 3.5 | 22.0 | 4.5 | 0 | 73.5 | 95.5 | 22.0 | 31.6 | 150 or more | 0 | X | 0.04 | 0.09 |
| T304 | S52 | A1 | 5.0 | 20.0 | 1.0 | 0 | 79.0 | 99.0 | 20.0 | 31.8 | 64 | 0 | X | 0.04 | 0.09 |
| T305 | S53 | AH1 | 26.9 | 3.2 | 0 | 0 | 96.8 | 100 | 3.2 | 37.6 | 120 | 0 | X | 0.02 | 0.01 |
| T306 | S53 | A1 | 28.2 | 0.2 | 0 | 0 | 99.8 | 100 | 0.2 | 30.9 | 24 | 0 | X | 0.02 | 0.01 |
| T307 | S54 | AH1 | 31.2 | 2.7 | 0 | 0 | 97.3 | 100 | 2.7 | 41.0 | 102 | 0 | X | 0.05 | 0.14 |
| T308 | S54 | B2 | 34.0 | 0.4 | 0 | 0 | 99.6 | 100 | 0.4 | 37.8 | 40 | 0 | Δ | 0.06 | 0.14 |
| T309 | S55 | AH1 | 32.3 | 4.8 | 0 | 0 | 95.2 | 100 | 4.8 | 45.5 | 106 | 0 | X | 0.12 | 0.05 |
| T310 | S55 | A1 | 38.2 | 0.5 | 0 | 0 | 99.5 | 100 | 0.5 | 42.4 | 42 | 0 | ○ | 0.20 | 0.05 |
| T311 | S56 | AH1 | 36.0 | 0.8 | 0 | 0 | 99.2 | 100 | 0.8 | 41.4 | 44 | 0 | X | 0.05 | 0.04 |
| T312 | S56 | A1 | 41.5 | 0.1 | 0 | 0 | 99.9 | 100 | 0.1 | 43.4 | 26 | 0 | ○ | 0.05 | 0.04 |
| T313 | S57 | A1 | 63.9 | 0 | 0 | 0 | 100 | 100 | 0 | 64.4 | 0 | 0 | ○ | 0.15 | 0.09 |
| T314 | S58 | A1 | 21.5 | 1.2 | 0 | 0 | 98.8 | 100 | 1.2 | 28.1 | 54 | 0 | X | 0.09 | 0.14 |
| T315 | S59 | A1 | 28.1 | 2.4 | 0 | 0 | 97.6 | 100 | 2.4 | 37.4 | 90 | 0 | Δ | 0.09 | 0.13 |
| T316 | S60 | A1 | 27.2 | 0.5 | 0 | 0 | 99.5 | 100 | 0.5 | 31.4 | 30 | 0 | Δ | 0.12 | 0.10 |
| T317 | S61 | B2 | 65.6 | 0.2 | 0 | 0 | 99.8 | 100 | 0.2 | 68.3 | 24 | 0 | ○ | 0.19 | 0.14 |
| T318 | S62 | A1 | 53.6 | 0.5 | 0 | 0 | 99.5 | 100 | 0.5 | 57.8 | 40 | 0 | ○ | 0.27 | 0.18 |
| T319 | S63 | AH1 | 28.7 | 1.7 | 0 | 0 | 98.3 | 100 | 1.7 | 36.5 | 92 | 0 | X | 0.13 | 0.14 |
| T320 | S63 | A1 | 33.3 | 0.2 | 0 | 0 | 99.8 | 100 | 0.2 | 35.9 | 36 | 0 | Δ | 0.14 | 0.14 |
| T321 | S64 | AH1 | 25.9 | 3.4 | 0 | 0 | 96.6 | 100 | 3.4 | 36.9 | 110 | 0 | X | 0.15 | 0.10 |
| T322 | S64 | A1 | 26.5 | 0.5 | 0 | 0 | 99.5 | 100 | 0.5 | 30.8 | 48 | 0 | X | 0.22 | 0.10 |

TABLE 35

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T301 | S51 | AH1 | 109 | ○ | 152 | 102 | — | 20.0 | 0.54 |
| T302 | S51 | A1 | 115 | ○ | 90 | 58 | — | 39.7 | 0.31 |
| T303 | S52 | AH1 | 118 | ○ | 220 | 162 | X | — | — |
| T304 | S52 | A1 | 111 | ○ | 178 | 144 | — | — | — |
| T305 | S53 | AH1 | 124 | ○ | 122 | 96 | — | 37.6 | 0.42 |
| T306 | S53 | A1 | 134 | Δ | 102 | 66 | Δ | 57.1 | — |
| T307 | S54 | AH1 | 118 | ○ | 110 | 86 | — | 35.1 | 0.35 |
| T308 | S54 | B2 | 126 | ○ | 92 | 52 | — | 46.6 | — |
| T309 | S55 | AH1 | 110 | ○ | 3 | 94 | — | 23.1 | 0.50 |
| T310 | S55 | A1 | 118 | ○ | 84 | 64 | — | 41.0 | — |
| T311 | S56 | AH1 | 120 | ○ | 96 | 70 | ○ | 40.3 | — |
| T312 | S56 | A1 | 122 | ○ | 90 | 64 | ○ | 39.4 | — |
| T313 | S57 | A1 | 126 | ○ | 28 | 18 | — | 19.1 | — |
| T314 | S58 | A1 | 137 | Δ | 82 | 54 | — | 62.7 | — |
| T315 | S59 | A1 | 121 | ○ | 112 | 84 | — | 42.5 | 0.42 |
| T316 | S60 | A1 | 136 | Δ | 54 | 40 | — | 56.4 | — |
| T317 | S61 | B2 | 130 | ○ | 48 | 22 | — | 18.0 | — |
| T318 | S62 | A1 | 122 | ○ | 66 | 42 | — | 19.0 | — |
| T319 | S63 | AH1 | 127 | ○ | 108 | 84 | — | 44.2 | 0.21 |
| T320 | S63 | A1 | 132 | Δ | 72 | 44 | — | 48.0 | — |
| T321 | S64 | AH1 | 123 | ○ | 122 | 88 | — | 37.6 | 0.38 |
| T322 | S64 | A1 | 136 | Δ | 80 | 52 | — | 57.6 | — |

TABLE 36

| | | | Wear Resistance | | Solidification | |
|---|---|---|---|---|---|---|
| Test No. | Alloy No. | Step No. | Amsler Abrasion Test | Ball-on-disk Abrasion Test | Temperature Range (° C.) | Cast-ability |
| T301 | S51 | AH1 | | | 29 | |
| T302 | S51 | A1 | | | | ○ |
| T303 | S52 | AH1 | ○ | Δ | — | |
| T304 | S52 | A1 | | | | |
| T305 | S53 | AH1 | | | 35 | |
| T306 | S53 | A1 | Δ | Δ | | |
| T307 | S54 | AH1 | | | 27 | |
| T308 | S54 | B2 | | | | ○ |
| T309 | S55 | AH1 | | | 28 | |
| T310 | S55 | A1 | | | | ○ |
| T311 | S56 | AH1 | | | | |
| T312 | S56 | A1 | | | 35 | Δ |

TABLE 36-continued

| | | | Wear Resistance | | Solidification | |
|---|---|---|---|---|---|---|
| Test No. | Alloy No. | Step No. | Amsler Abrasion Test | Ball-on-disk Abrasion Test | Temperature Range (° C.) | Cast-ability |
| T313 | S57 | A1 | ◎ | Δ | 47 | X |
| T314 | S58 | A1 | | | 33 | Δ |
| T315 | S59 | A1 | | | 26 | |
| T316 | S60 | A1 | | | 32 | |
| T317 | S61 | B2 | | | 28 | ○ |
| T318 | S62 | A1 | | | 22 | ○ |
| T319 | S63 | AH1 | | | 52 | X |
| T320 | S63 | A1 | ○ | Δ | | |
| T321 | S64 | AH1 | | | 55 | X |
| T322 | S64 | A1 | Δ | Δ | | |

TABLE 37

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T323 | S65 | AH1 | 19.8 | 12.0 | 0 | 0 | 88.0 | 100 | 12.0 | 40.6 | 150 or more | 0 | X | 0.07 | 0.16 |
| T324 | S65 | A1 | 16.0 | 4.7 | 0 | 0 | 95.3 | 100 | 4.7 | 29.1 | 150 or more | 0 | X | 0.12 | 0.18 |
| T325 | S66 | AH1 | 32.0 | 18.4 | 7.4 | 0 | 74.2 | 92.6 | 18.4 | 57.7 | 150 or more | 0 | X | 0.05 | 0.11 |
| T326 | S66 | A1 | 40.9 | 10.0 | 2.0 | 0 | 88.0 | 98.0 | 10.0 | 59.8 | 150 or more | 0 | ○ | 0.07 | 0.11 |
| T327 | S67 | AH1 | 40.9 | 0.6 | 0 | 0 | 99.4 | 100 | 0.6 | 45.5 | 40 | 0 | X | 0.06 | 0.04 |
| T328 | S67 | A1 | 45.5 | 0 | 0 | 0 | 100 | 100 | 0 | 46.4 | 0 | 0 | ○ | 0.06 | 0.04 |
| T329 | S68 | AH1 | 16.4 | 6.4 | 0 | 0 | 93.6 | 100 | 6.4 | 31.6 | 150 or more | 0 | X | 0.11 | 0.13 |
| T330 | S68 | A1 | 18.0 | 1.6 | 0 | 0 | 98.4 | 100 | 1.6 | 25.6 | 74 | 0 | X | 0.18 | 0.14 |
| T331 | S69 | AH1 | 24.3 | 6.2 | 0 | 0 | 93.8 | 100 | 6.2 | 39.2 | 150 or more | 0 | X | 0.12 | 0.17 |
| T332 | S69 | A1 | 28.5 | 1.8 | 0 | 0 | 98.2 | 100 | 1.8 | 36.6 | 60 | 0 | Δ | 0.20 | 0.17 |
| T333 | S70 | AH1 | 23.4 | 4.6 | 0 | 0 | 95.4 | 100 | 4.6 | 36.3 | 120 | 0 | X | 0.22 | 0.10 |
| T334 | S70 | A1 | 26.4 | 1.5 | 0 | 0 | 98.5 | 100 | 1.5 | 33.7 | 56 | 0 | Δ | 0.31 | 0.10 |

TABLE 37-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T335 | S71 | AH1 | 28.5 | 8.5 | 4.5 | 0 | 87.0 | 95.5 | 8.5 | 46.0 | 120 | 0 | X | 0.10 | 0.13 |
| T336 | S71 | A1 | 38.0 | 6.2 | 1.0 | 0 | 92.8 | 99.0 | 6.2 | 52.9 | 106 | 0 | ○ | 0.14 | 0.13 |
| T337 | S72 | A1 | 80.8 | 0 | 0 | 0 | 100 | 100 | 0 | 80.8 | 0 | 0 | ○ | 0.02 | 0.01 |
| T338 | S73 | AH1 | 23.0 | 4.5 | 0 | 0 | 95.5 | 100 | 4.5 | 35.7 | 150 or more | 0 | X | 0.08 | 0.06 |
| T339 | S73 | A1 | 29.4 | 0.6 | 0 | 0 | 99.4 | 100 | 0.6 | 34.0 | 48 | 0 | Δ | 0.12 | 0.06 |
| T340 | S74 | AH1 | 22.4 | 3.8 | 0 | 0 | 96.2 | 100 | 3.8 | 34.1 | 100 | 0 | X | 0.09 | 0.06 |
| T341 | S74 | A1 | 28.9 | 0.4 | 0 | 0 | 99.6 | 100 | 0.4 | 32.7 | 44 | 0 | X | 0.11 | 0.06 |

TABLE 38

| Test No. | Alloy No. | Step No. | Cutting Resistance (N) | Chip Shape | Corrosion Test 1 (μm) | Corrosion Test 2 (μm) | Corrosion Test 3 (ISO 6509) | Impact Value (J/cm$^2$) | 150° C. Creep Strain (%) |
|---|---|---|---|---|---|---|---|---|---|
| T323 | S65 | AH1 | 108 | ○ | 152 | 118 | Δ | 10.6 | 1.00 |
| T324 | S65 | A1 | 117 | ○ | 142 | 108 | ○ | 39.2 | — |
| T325 | S66 | AH1 | 121 | ○ | 200 | 138 | — | 5.8 | 3.00 |
| T326 | S66 | A1 | 109 | ○ | 164 | 132 | — | 8.6 | 0.85 |
| T327 | S67 | AH1 | 118 | ○ | 88 | 58 | — | 35.1 | 0.09 |
| T328 | S67 | A1 | 119 | ○ | 80 | 52 | ○ | 35.5 | 0.07 |
| T329 | S68 | AH1 | 125 | ○ | 140 | 104 | — | 29.6 | 0.59 |
| T330 | S68 | A1 | 136 | Δ | 100 | 64 | — | 63.3 | 0.31 |
| T331 | S69 | AH1 | 113 | ○ | 146 | 106 | — | 23.9 | 0.56 |
| T332 | S69 | A1 | 122 | ○ | 104 | 68 | — | 45.5 | 0.34 |
| T333 | S70 | AH1 | 118 | ○ | 124 | 84 | — | 33.2 | 0.39 |
| T334 | S70 | A1 | 125 | ○ | 88 | 58 | — | 50.7 | — |
| T335 | S71 | AH1 | 106 | ○ | 184 | 126 | — | 10.8 | 2.39 |
| T336 | S71 | A1 | 107 | ○ | 138 | 102 | — | 13.9 | 1.16 |
| T337 | S72 | A1 | 152 | Δ | — | — | — | — | — |
| T338 | S73 | AH1 | 124 | ○ | 144 | 100 | — | 28.9 | — |
| T339 | S73 | A1 | 132 | Δ | 92 | 56 | — | 34.6 | — |
| T340 | S74 | AH1 | 126 | ○ | 124 | 96 | — | 33.3 | — |
| T341 | S74 | A1 | 134 | Δ | 96 | 54 | — | 36.1 | — |

TABLE 39

| | | | Wear Resistance | | Solidification | |
|---|---|---|---|---|---|---|
| Test No. | Alloy No. | Step No. | Amsler Abrasion Test | Ball-on-disk Abrasion Test | Temperature Range (° C.) | Cast-ability |
| T323 | S65 | AH1 | | | 32 | Δ |
| T324 | S65 | A1 | | | | |
| T325 | S66 | AH1 | | | 35 | |
| T326 | S66 | A1 | | | | |
| T327 | S67 | AH1 | | | 27 | |
| T328 | S67 | A1 | | | | ○ |
| T329 | S68 | AH1 | | | 41 | |
| T330 | S68 | A1 | | | | X |
| T331 | S69 | AH1 | | | 28 | |
| T332 | S69 | A1 | | | | Δ |
| T333 | S70 | AH1 | | | 36 | |
| T334 | S70 | A1 | | | | |
| T335 | S71 | AH1 | | | 22 | |
| T336 | S71 | A1 | | | | ○ |
| T337 | S72 | A1 | | | 82 | X |
| T338 | S73 | AH1 | | | 33 | Δ |
| T339 | S73 | A1 | | | | |
| T340 | S74 | AH1 | | | 29 | |
| T341 | S74 | A1 | | | | |

The above-described experiment results are summarized as follows.

1) It was able to be verified that, by satisfying the composition according to the embodiment, the composition relational expressions f1 and f2, the requirements of the metallographic structure, and the metallographic structure relational expressions f3, f4, f5, and f6, with a small amount of Pb, casting having good machinability and castability, excellent corrosion resistance in a harsh environment, excellent impact resistance, wear resistance, and high temperature properties can be obtained (Alloys No. S01 to S03 and Step No. A1 and some other steps). It was able to be verified that addition of Sb and As further improves corrosion resistance under harsh conditions (Alloys No. S11 to S13). It was able to be verified that the cutting resistance further lowers by addition of Bi (Alloy No. S11 and S12).

It was able to be verified that corrosion resistance, machinability, and wear resistance are improved when 0.08 mass % or higher of Sn and 0.07 mass % or higher of P are contained in κ phase (Alloys No. S01 to S06).

It was able to be verified that, when the composition is within the range of the embodiment, elongated acicular κ phase is present in α phase, and due to the acicular κ phase, machinability, corrosion resistance, and wear resistance improve (Alloys No. S01 to S06).

2) When the Cu content was low, the amount of γ phase increased, and machinability was excellent. However, corrosion resistance, impact resistance, and high temperature properties deteriorated. Conversely, when the Cu content was high, machinability and impact resistance deteriorated (for example, Alloys No. S52, S57, and S72).

When the Si content was low, machinability was low. When the Si content was high, the impact value was low (Alloys No. S58, S57, S61, and S68).

When the Sn content was higher than 0.3 mass %, the area ratio of γ phase was higher than 2.0%. Therefore, machinability was excellent, but corrosion resistance, impact resistance, and high temperature properties deteriorated (Alloy No. S51).

When the Sn content was lower than 0.07 mass %, the dezincification corrosion depth in a harsh environment was large. When the Sn content was lower than 0.07 mass %, there was also a case where the effect of cooling or the heat treatment was not exhibited even when the amount of γ phase or μ phase was small (Alloys No. S53, S54, S56, and S67). When the Sn content was 0.1 mass % or higher, the properties were further improved (Alloys No. S01 to S06).

When the P content was high, impact resistance deteriorated. In addition, cutting resistance was slightly high. On the other hand, when the P content was low, the dezincification corrosion depth in a harsh environment was large (Alloys No. S62, S18, S53, S55, and S56).

It was able to be verified that, even if inevitable impurities are contained to the extent contained in alloys manufactured in the actual production, there is not much influence on the properties (Alloys No. S01 to S06).

It is presumed that, when Fe or Cr was added such that the content thereof was higher than the preferable concentration of the inevitable impurities, an intermetallic compound of Fe and Si or an intermetallic compound of Fe and P was formed, and thus the Si concentration in the effective ranges decreased, corrosion resistance deteriorated, and machinability slightly deteriorated due to the formation of the intermetallic compound (Alloys No. S73 and S74).

3) In the case the value of the composition relational expression f1 was low, even when the content of each of the elements was in the composition range, the dezincification corrosion depth in a harsh environment was large, and high temperature properties deteriorated (Alloys No. S69 and S70).

When the value of the composition relational expression f1 was low, the amount of γ phase increased, and even when the average cooling rate after casting was appropriate or the heat treatment was performed, β phase may remain. Therefore, machinability was excellent, but corrosion resistance, impact resistance, and high temperature properties deteriorated. When the value of the composition relational expression f1 was high, the amount of κ phase increased, and machinability and impact resistance deteriorated (Alloys No. S69, S66, S52, S57, and S72).

When the value of the composition relational expression f2 was low, machinability was excellent, but β phase was likely to remain. Therefore, corrosion resistance, impact resistance, and high temperature properties deteriorated. In addition, when the value of the composition relational expression f2 was high, coarse α phase was formed. Therefore, cutting resistance was high, and it was difficult to part chips. f2 has a relation with the solidification temperature range and castability have a relation. When f2 was low, the solidification temperature range was widened, and castability deteriorated. On main reason for the deterioration of castability was presumed to be that the solidification temperature range was higher than 40° C. (Alloys No. S71, S66, S52, S63, S64, and S72).

4) When the proportion of γ phase in the metallographic structure was higher than 2.0%, machinability was excellent, but corrosion resistance, impact resistance, and high temperature properties deteriorated (for example, Alloys No. S01 to S03, S69, S65 and Step No. AH1). Even if the proportion of γ phase was 2.0% or lower, when the length of the long side of γ phase was 50 μm or less, corrosion resistance, impact resistance, and high temperature properties were excellent (Alloys No. S13 and S17 and Step No. AH1). In the case the proportion of γ phase was 1.2% or lower and the length of the long side of γ phase was 40 μm or less, corrosion resistance, impact resistance, and high temperature properties were excellent (for example, Alloy No. S01).

When the area ratio of μ phase was higher than 2%, corrosion resistance, impact resistance, high temperature properties, and strength index deteriorated. In the dezincification corrosion test in a harsh environment, grain boundary corrosion or selective corrosion of μ phase occurred (Alloy No. S01 and Steps No. AH3 and BH2). In the case μ phase was present at a grain boundary, even when the proportion of μ phase decreased along with an increase in the length of the long side of β phase, impact resistance, high temperature properties, and corrosion resistance deteriorated. In addition, when the length of the long side of μ phase was more than 25 μm, impact resistance, high temperature properties, and corrosion resistance further deteriorated. When the proportion of μ phase was 1% or lower and the length of the long side of γ phase was 15 μm or less, corrosion resistance, impact resistance, and high temperature properties were excellent (Alloy No. S01 and Steps No. A1, A4, AH2, and AH3).

When the area ratio of κ phase was higher than 65%, machinability and impact resistance deteriorated. On the other hand, when the area ratio of κ phase was lower than 25%, machinability deteriorated. When the proportion of κ phase was 30% to 56%, corrosion resistance, machinability, impact resistance, and wear resistance were improved, and a casting having a good balance between the properties was obtained (Alloys No. S01, S61, S72, and S58).

5) When the value of the metallographic structure relational expression $f5=(\gamma)+(\mu)$ was higher than 3.0%, or when the value of $f3=(\alpha)+(\kappa)$ was lower than 96.5%, corrosion resistance, impact resistance, and high temperature properties deteriorated. When the value of the metallographic structure relational expression f5 was 1.5% or lower, that of f3 was 98.0 or higher, and that of f4 was 99.5 or higher, corrosion resistance, impact resistance, and high temperature properties were further improved (Alloys No. NO. S01 to S06 and S13).

6) When the value of the metallographic structure relational expression $f6=(\kappa)+6\times(\gamma)^{1/2}+0.5\times(\mu)$ was higher than 66 or was lower than 29, machinability deteriorated (Alloys No. S58, S61, S68, and S72). When the value of f6 was 32 to 58, machinability was further improved (for example, Alloys No. S01 and S11). Even in the case f6 was 29 or higher, when acicular κ phase was not present in α phase, machinability was poor. In addition, in some alloys, impact resistance was higher than 60 J/cm$^2$ (Alloys No. S53 and S64). When the value of f6 was higher than 58 and further higher than 66, impact resistance deteriorated (Alloys No. S14, S57, and S61).

7) When the amount of Sn in κ phase is lower than 0.08 mass %, the dezincification corrosion depth in a harsh environment was large, and the corrosion of κ phase occurred. In addition, cutting resistance was slightly high, and chip partibility deteriorated (Alloys No. S53, S54, and S56). When the amount of Sn in κ phase was 0.11 mass % or higher, corrosion resistance and machinability were further improved (Alloys No. S01 to S06).

When the amount of P in κ phase was lower than 0.07 mass %, the dezincification corrosion depth in a harsh environment was large (Alloys No. S53, S55, and S56).

When the amount of P in κ phase was 0.08 mass % or higher, corrosion resistance was improved (for example, Alloys No. S01 to S06 and S13).

When the amount of Sn in κ phase was lower than 0.08% and the amount of P in κ phase was lower than 0.07%, even when the area ratio of γ phase was sufficiently satisfied, the dezincification corrosion depth in a harsh environment was large (Alloys No. S53, S67, and S56).

When the amount of γ phase was small, the amount of Sn distributed in κ phase was about 1.2 times the Sn content in the alloy. As a result, it is presumed that corrosion resistance of κ phase was improved, which contributed to improvement of corrosion resistance of the alloy. When the amount of γ phase is large, for example, the proportion of γ phase was about 10%, the amount of Sn distributed in κ phase was merely ½ of the Sn content in the alloy (Alloys No. S01, S02, S65, and S66).

The example of Alloy No. S01 will be described. In Alloy No. S01, the proportion of γ phase decreased from 4.2% to 0.2%, the Sn concentration in κ phase increased from 0.13 mass % to 0.18 mass % due to the decrease in the proportion of γ phase, and a large amount of acicular κ phase was present in α phase. As a result, the cutting resistance increased by 4 N, but excellent machinability was maintained, the corrosion depth in the corrosion test performed assuming a harsh environment decreased to about ¼, the impact value as one measure of toughness increased to about 1.8 times, and deformation caused by high temperature creep decreased to about ¼.

When the requirements of the composition and the requirements of the metallographic structure were satisfied, the impact resistance was 23 J/cm$^2$ or higher, and the creep strain after holding the casting at 150° C. for 100 hours in a state where 0.2% proof stress at room temperature was applied was 0.4% or lower and mostly 0.3% or lower (for example, Alloys No. S01 to S06).

When the amount of Si was about 2.95%, acicular phase started to be present in α phase, and when the amount of Si was about 3.1%, acicular κ phase significantly increased. The relational expression f2 affected the presence/absence and the amount of acicular κ phase (for example, Alloys No. S64, S20, S53, S21, and S23).

When the amount of acicular κ phase increased, machinability, high temperature properties, and wear resistance were improved. It is also presumed that an increase in the amount of acicular κ phase leads to strengthening of α phase and improvement of chip partibility (for example, Alloys No. S01, S12, S13, and S16 and Step No. A1).

As a result, acicular κ phase was present in α phase and the Sn concentration in α phase and κ phase increased. Thus, even if the amount of γ phase was 0.8% or lower, machinability was substantially equivalent to that of a sample including 3% to 5% of γ phase. That is, it is presumed that the presence of acicular κ phase and the increase in the Sn concentration in α phase and κ phase compensated for a decrease in the amount of γ phase.

In an ISO 6509 test of the corrosion test method 3, even if the amount of γ phase or μ phase was a predetermined amount or more, it was difficult to determine superiority or inferiority. However, in the corrosion test methods 1 and 2 adopted in the embodiment, it was able to determine superiority or inferiority based on the amount of γ phase or μ phase, or the like. (Alloys No. S01 and S02)

When the proportion of κ phase was about 30% to 55% and acicular κ phase was present in α phase, the abrasion loss was small both in an abrasion test under lubrication and in an abrasion test under non-lubrication. In addition, in the tested sample, there were substantially no damages to a stainless steel ball as an opposite material (Alloys No. S16 and S02).

8) In the evaluation of the materials using the mass-production facility and the materials prepared in the laboratory, substantially the same results were obtained (Alloys No. S01 and S02 and Steps No. C1 and C2).

Regarding Manufacturing Conditions:

When the casting was held in a temperature range of 510° C. to 575° C. for 20 minutes, or was cooled in a temperature range of 510° C. to 575° C. at an average cooling rate of 2.5° C./min or lower and subsequently was cooled in a temperature range from 480° C. to 370° C. at an average cooling rate of higher than 2.5° C./min in the continuous furnace, the amount of γ phase significantly decreased, and a metallographic structure in which substantially no μ phase was present was obtained. A material having excellent corrosion resistance, high temperature properties, and impact resistance was obtained (Alloys No. S01 to S03 and Steps No. A1 to A3).

When, after casting, cooling was performed in a temperature range of 510° C. to 575° C. at an average cooling rate of 2.5° C./min or lower and was performed in a temperature range from 480° C. to 370° C. at an average cooling rate of higher than 2.5° C./min, the amount of γ phase significantly decreased, a metallographic structure in which substantially no μ phase was present was obtained, and corrosion resistance, impact resistance, high temperature properties, and wear resistance were improved (Alloys No. S01 to S03 and Steps No. B1 and B3).

When the heat treatment temperature was high, crystal grains were coarsened, and a decrease in the amount of γ phase was small. Therefore, corrosion resistance, impact resistance, and machinability were poor. In addition, even if the casting was heated and held at a low heat treatment temperature of 500° C. for a long period of time, a decrease in the amount of γ phase was small (Alloys No. S01 to S03 and Steps No. AH4 and AH5).

In the case the heat treatment temperature was 520° C., when the holding time was short, a decrease in the amount of γ phase was smaller than that in another heat treatment method. When the value of the expression (T−500)×t (wherein when T is 540° C. or higher, T was set as 540) representing the relation between the heat treatment time (t) and the heat treatment temperature (T) was 800 or higher, a decrease in the amount of γ phase was larger, and the performance was improved (Steps No. A5 and A1).

When the average cooling rate in a temperature range from 470° C. to 380° C. during cooling after the heat treatment was lower than 2.5° C./min, μ phase was present, and corrosion resistance, impact resistance, and high temperature properties deteriorated. The formation of μ phase was affected by the average cooling rate (Alloys No. S01, S02, and S03 and Steps No. A1 to A4, AH2, AH3, and AH8).

As the heat treatment method, by increasing the temperature in a temperature range of 550° C. to 620° C. and adjusting the average cooling rate in a temperature range from 575° C. to 510° C. in the process of cooling, excellent corrosion resistance, impact resistance, and high temperature properties were obtained. That is, it was able to be verified that, even with the continuous heat treatment method, the properties were improved (Steps No. A1, A7, A8, A9, and A10).

Even in the case a continuously cast rod satisfying the composition of the embodiment was used as the material, excellent properties were obtained as in the case of the casting by performing the heat treatment including the continuous heat treatment method (Steps No. C1, C3, and C4).

When the amount of γ phase decreased, the amount of κ phase increased, and the amount of Sn in κ phase increased. In addition, it was verified that γ phase decreased but excellent machinability was able to be secured (Alloys No. S01 and S02 and Steps No. AH1, A1, and B4).

When the average cooling rate after casting was controlled or the heat treatment was performed on the casting, acicular κ phase was present in α phase (Alloys No. S01, S02, and S03 and Steps No. AH1 and A1). It is presumed that, due to the presence of acicular κ phase in α phase, wear resistance was improved, machinability was excellent, and a significant decrease in the amount of γ phase was compensated for.

As described above, in the alloy casting according to the embodiment in which the contents of the respective additive elements, the respective composition relational expressions, the metallographic structure, and the respective metallographic structure relational expressions are in the appropriate ranges, castability is excellent, and corrosion resistance, machinability, and wear resistance are also excellent. In addition, in the alloy casting according to the embodiment, more excellent properties can be obtained by adjusting the manufacturing conditions in casting and the conditions in the heat treatment so that they fall in the appropriate ranges.

Example 2

Regarding an alloy casting according to Comparative Example of the embodiment, a Cu—Zn—Si copper alloy casting (Test No. T401/Alloy No. S101) which had been used in a harsh water environment for 8 years was prepared. There was no detailed data on the water quality of the environment where the casting had been used and the like. Using the same method as in Example 1, the composition and the metallographic structure of Test No. T401 were analyzed. In addition, a corroded state of a cross-section was observed using the metallographic microscope. Specifically, the sample was embedded in a phenol resin material such that the exposed surface was maintained to be perpendicular to the longitudinal direction. Next, the sample was cut such that a cross-section of a corroded portion was obtained as the longest cut portion. Next, the sample was polished. The cross-section was observed using the metallographic microscope. In addition, the maximum corrosion depth was measured.

Next, a similar alloy casting was prepared with the same composition and under the same preparation conditions of Test No. T401 (Test No. T402/Alloy No. S102). Regarding the similar alloy casting (Test No. T402), the analysis of the composition and the metallographic structure, the evaluation (measurement) of the mechanical properties and the like, and the dezincification corrosion tests 1 to 3 were performed as described in Example 1. By comparing the corrosion of Test No. T401 which developed in actual water environment and that of Test No. T402 in the accelerated tests of the dezincification corrosion tests 1 to 3 to each other, the appropriateness of the accelerated tests of the dezincification corrosion tests 1 to 3 was verified.

In addition, by comparing the evaluation result (corroded state) of the dezincification corrosion test 1 of the alloy according to the embodiment described in Example 1 (Test No. T03/Alloy No. S01/Step No. A2) and the corroded state of Test No. T401 or the evaluation result (corroded state) of the dezincification corrosion test 1 of Test No. T402 to each other, the corrosion resistance of Test No. T03 was examined.

Test No. T402 was prepared using the following method.

Raw materials were dissolved to obtain substantially the same composition as that of Test No. T401 (Alloy No. S101), and the melt was cast into a mold having an inner diameterϕ of 40 mm at a casting temperature of 1000° C. to prepare a casting. Next, the casting was cooled in the temperature range of 575° C. to 510° C. at an average cooling rate of about 20° C./min, and subsequently was cooled in the temperature range from 470° C. to 380° C. at an average cooling rate of about 15° C./min. These preparation conditions correspond to Step No. AH1 of Example 1. As a result, a sample of Test No. T402 was prepared.

The analysis method of the composition and the metallographic structure, the measurement method of the mechanical properties and the like, and the methods of the dezincification corrosion tests 1 to 3 were as described in Example 1.

The obtained results are shown in Tables 40 to 42 and FIGS. 5A to 5C.

TABLE 40

| Alloy | Component Composition (mass %) | | | | | | | Composition Relational Expression | |
|---|---|---|---|---|---|---|---|---|---|
| No. | Cu | Si | Pb | Sn | P | Others | Zn | f1 | f2 |
| S101 | 75.4 | 3.01 | 0.037 | 0.01 | 0.04 | Fe: 0.02, Ni: 0.01, Ag: 0.02 | Balance | 77.8 | 62.1 |
| S102 | 75.4 | 3.01 | 0.033 | 0.01 | 0.04 | Fe: 0.02, Ni: 0.02, Ag: 0.02 | Balance | 77.8 | 62.1 |

TABLE 41

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T401 | S101 | | 27.4 | 3.9 | 0 | 0 | 96.1 | 100 | 3.9 | 39.2 | 110 | 0 | X | 0.01 | 0.06 |
| T402 | S102 | AH1 | 28.0 | 3.8 | 0 | 0 | 96.2 | 100 | 3.8 | 39.7 | 120 | 0 | X | 0.01 | 0.06 |

TABLE 42

| Test No. | Alloy No. | Step No. | Maximum Corrosion Depth (μm) | Corrosion Test 1 (μm) | Corrosion Test 2 (μm) | Corrosion Test 3 (ISO 6509) | Impact Value (J/cm$^2$) | Solidification Temperature Range (° C.) | Castability |
|---|---|---|---|---|---|---|---|---|---|
| T401 | S101 | | 138 | | | | | | |
| T402 | S102 | AH1 | | 146 | 98 | 0 | 31.5 | 37 | Δ |

FIG. 5A shows a metallographic micrograph of the cross-section of Test No. T401.

Test No. T401 was used in a harsh water environment for 8 years, and the maximum corrosion depth of corrosion caused by the use environment was 138 μm.

In a surface of a corroded portion, dezincification corrosion occurred irrespective of whether it was α phase or κ phase (average depth of about 100 μm from the surface).

In the corroded portion where α phase and κ phase were corroded, more solid α phase was present at deeper locations.

The corrosion depth of α phase and κ phase was uneven without being uniform. Roughly, corrosion occurred only in γ phase from a boundary portion of α phase and κ phase to the inside (a depth of about 40 μm from the corroded boundary between α phase and κ phase towards the inside: local corrosion of only γ phase).

FIG. 5B shows a metallographic micrograph of a cross-section of Test No. T402 after the dezincification corrosion test 1.

The maximum corrosion depth was 146 μm

In a surface of a corroded portion, dezincification corrosion occurred irrespective of whether it was α phase or κ phase (average depth of about 100 μm from the surface).

In the corroded portion, more solid α phase was present at deeper locations.

The corrosion depth of α phase and κ phase was uneven without being uniform. Roughly, corrosion occurred only in γ phase from a boundary portion of α phase and κ phase to the inside (the length of corrosion that locally occurred only to γ phase from the corroded boundary between α phase and κ phase was about 45 μm).

It was found that the corrosion shown in FIG. 5A occurred in the harsh water environment for 8 years and the corrosion shown in FIG. 5B occurred in the dezincification corrosion test 1 were substantially the same in terms of corrosion form. In addition, because the amount of Sn and the amount of P did not fall within the ranges of the embodiment, both α phase and κ phase were corroded in a portion in contact with water or the test solution, and γ phase was selectively corroded here and there at deepest point of the corroded portion. The Sn concentration and the P concentration in κ phase were low.

The maximum corrosion depth of Test No. T401 was slightly less than the maximum corrosion depth of Test No. T402 in the dezincification corrosion test 1. However, the maximum corrosion depth of Test No. T401 was slightly more than the maximum corrosion depth of Test No. T402 in the dezincification corrosion test 2. Although the degree of corrosion in the actual water environment is affected by the water quality, the results of the dezincification corrosion tests 1 and 2 substantially matched the corrosion result in the actual water environment regarding both corrosion form and corrosion depth. Accordingly, it was found that the conditions of the dezincification corrosion tests 1 and 2 are appropriate and the evaluation results obtained in the dezincification corrosion tests 1 and 2 are substantially the same as the corrosion result in the actual water environment.

In addition, the acceleration rates of the accelerated tests of the dezincification corrosion tests 1 and 2 substantially matched that of the corrosion in the actual harsh water environment. This presumably shows that the dezincification corrosion tests 1 and 2 simulated a harsh environment.

The result of Test No. T402 in the dezincification corrosion test 3 (the dezincification corrosion test according to ISO6509) was "O" (good). Therefore, the result of the dezincification corrosion test 3 did not match the corrosion result in the actual water environment.

The test time of the dezincification corrosion test 1 was 2 months, and the dezincification corrosion test 1 was an about 60 to 90 times accelerated test. The test time of the dezincification corrosion test 2 was 3 months, and the dezincification corrosion test 2 was an about 30 to 50 times accelerated test. On the other hand, the test time of the dezincification corrosion test 3 (dezincification corrosion test according to ISO 6509) was 24 hours, and the dezincification corrosion test 3 was an about 1000 times or more accelerated test.

It is presumed that, by performing the test for a long period of time of 2 or 3 months using the test solution close to the actual water environment as in the dezincification corrosion tests 1 and 2, substantially the same evaluation results as the corrosion result in the actual water environment were obtained.

In particular, in the corrosion result of Test No. T401 in the harsh water environment for 8 years, or in the corrosion results of Test No. T402 in the dezincification corrosion tests 1 and 2, not only α phase and κ phase on the surface but also γ phase were corroded. However, in the corrosion result of the dezincification corrosion test 3 (dezincification corrosion test according to ISO 6509), substantially no γ phase was corroded. Therefore, it is presumed that, in the dezincification corrosion test 3 (dezincification corrosion test according to ISO 6509), the corrosion of α phase and κ phase on the surface and the corrosion of γ phase were not able to be appropriately evaluated, and the evaluation result did not match the corrosion result in the actual water environment.

Figure 5:
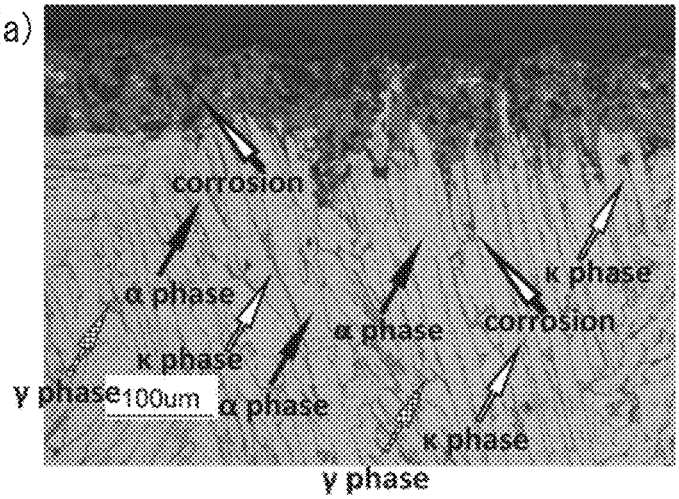
FIG. 5(*a*) is a metallographic micrograph of a cross-section of Test No. T401 according to Example 2 after use in a harsh water environment for 8 years.
Figure 5:
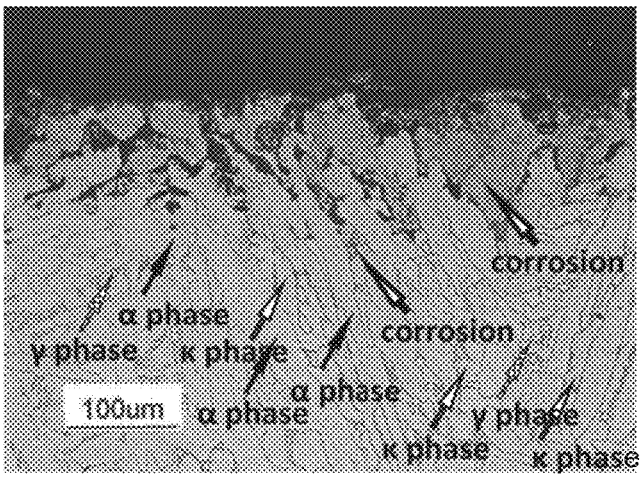
Figure 5:
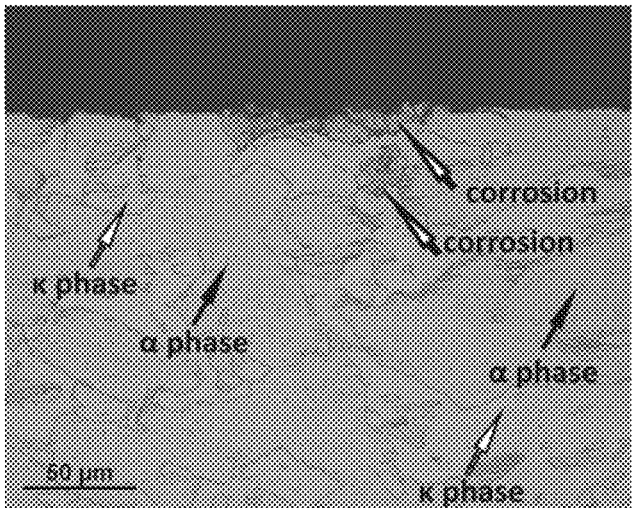

FIG. 5(*c*) shows a metallographic micrograph of a cross-section of Test No. T03 (Alloy No. S01/Step No. A2) after the dezincification corrosion test 1.

A part of γ phase and κ phase exposed to the surface were corroded. The corrosion depth was about 10 μm Selective corrosion of γ phase rapidly propagated toward the inside (selective corrosion of γ phase propagated to a further inside portion). Probably, it is presumed that the corroded portion of the surface part was connected to the inside. It is presumed that the length of the long side of γ phase is one of the large factors that determine the corrosion depth.

In can be seen that, in Test No. T03 according to the embodiment shown in FIG. 5(*c*), the corrosion of α phase and κ phase in the vicinity of the surface was significantly suppressed as compared to Tests No. T401 and T402 shown in FIGS. 5(*a*) and 5(*b*). It is presumed that the progress of the corrosion was delayed by the aforementioned suppression. The main reasons why the corrosion of α phase and κ phase in the vicinity of the surface was significantly suppressed are presumed to be as follows.

(Main Reasons)

The corrosion resistance of κ phase was improved due to addition of Sn to κ phase.

The amount of γ phase was suppressed.

INDUSTRIAL APPLICABILITY

The free-cutting copper alloy according to the present invention has excellent castability and excellent corrosion resistance and machinability. Therefore, the free-cutting copper alloy according to the present invention is suitable for devices such as faucets, valves, or fittings for drinking water consumed by a person or an animal every day, in members for electrical uses, automobiles, machines and industrial plumbing such as valves, or fittings, or in devices and components that come in contact with liquid.

Specifically, the free-cutting copper alloy according to the present invention is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the present invention is suitable for various valves, radiator components, and cylinders used as automobile components, and is suitable for pipe fittings, valves, valve stems, heat exchanger components, water supply and drainage cocks, cylinders, or pumps used as mechanical members, and is suitable for pipe fittings, valves, or valve stems used as industrial plumbing members.

The invention claimed is:

1. A free-cutting copper alloy casting comprising:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.20 mass % of Pb; and a balance including Zn and inevitable impurities, wherein a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.2 \leq f1=[Cu]+0.8\times[Si]-8.5\times[Sn]+[P]+0.5\times[Pb] \leq 80.3$$

and $$61.2 \leq f2=[Cu]-4.4\times[Si]-0.8\times[Sn]-[P]+0.5\times[Pb] \leq 62.8$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$25 \leq (\kappa) \leq 65,$$

$$0 \leq (\gamma) \leq 2.0,$$

$$0 \leq (\beta) \leq 0.3,$$

$$0 \leq (\mu) \leq 2.0,$$

$$96.5 \leq f3=(\alpha)+(\kappa),$$

$$99.2 \leq f4=(\alpha)+(\kappa)+(\gamma)\pm(\mu),$$

$$0 \leq f5=(\gamma)+(\mu) \leq 3.0, \text{ and}$$

$$29 \leq f6=(\kappa)+6\times(\gamma)^{1/2}+0.5\times(\mu) \leq 66$$

are satisfied, the length of the long side of γ phase is 40 μm or less, the length of the long side of μ phase is 25 μm or less, and κ phase is present in α phase.

2. The free-cutting copper alloy casting according to claim 1, further comprising:

one or more element(s) selected from the group consisting of 0.02 mass % to 0.08 mass % of Sb, 0.02 mass % to 0.08 mass % of As, and 0.02 mass % to 0.30 mass % of Bi.

3. A free-cutting copper alloy casting comprising:

75.5 mass % to 77.8 mass % of Cu;

3.1 mass % to 3.4 mass % of Si;

0.10 mass % to 0.27 mass % of Sn;

0.06 mass % to 0.13 mass % of P;

0.024 mass % to 0.15 mass % of Pb; and a balance including Zn and inevitable impurities, wherein a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.6 \leq f1=[Cu]+0.8\times[Si]-8.5\times[Sn]+[P]+0.5\times[Pb] \leq 79.6$$

and $$61.4 \leq f2=[Cu]-4.4\times[Si]-0.8\times[Sn]-[P]+0.5\times[Pb] \leq 62.6$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \leq (\kappa) \leq 56,$$

$$0 \leq (\gamma) \leq 1.2,$$

$$(\beta)=0,$$

$$0 \leq (\mu) \leq 1.0,$$

$$98.0 \leq f3=(\alpha)+(\kappa),$$

$$99.5 \leq f4=(\alpha)+(\kappa)+(\gamma)+(\mu),$$

$0 \leq f5=(\gamma)+(\mu) \leq 1.5$, and $32 \leq f6=(\kappa)+6\times(\gamma)^{1/2}+0.5\times(\mu) \leq 58$ are satisfied, the length of the long side of γ phase is 40 μm or less, the length of the long side of μ phase is 15 μm or less, and κ phase is present in α phase.

4. The free-cutting copper alloy casting according to claim 3, further comprising:

one or more element(s) selected from the group consisting of higher than 0.02 mass % and 0.07 mass % or lower of Sb, higher than 0.02 mass % and 0.07 mass % or lower of As, and 0.02 mass % to 0.20 mass % of Bi.

5. A free-cutting copper alloy casting comprising:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.20 mass % of Pb; and a balance including Zn and inevitable impurities, wherein a total amount of Fe, Mn, Co, and Cr as the inevitable impurities is lower than 0.08 mass %, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $76.2 \leq f1=[Cu]+0.8\times[Si]-8.5\times[Sn]+[P]+0.5\times[Pb] \leq 80.3$ and $61.2 \leq f2=[Cu]-4.4\times[Si]-0.8\times[Sn]-[P]+0.5\times[Pb]62.8$ are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $25 \leq (\kappa) \leq 65$, $0 \leq (\gamma) \leq 2.0$, $0 \leq (\beta) \leq 0.3$, $0 \leq (\mu) \leq 2.0$, $96.5 \leq f3=(\alpha)+(\kappa)$, $99.2 \leq f4=(\alpha)+(\kappa)+(\gamma)+(\mu)$, $0 \leq f5=(\gamma)+(\mu) \leq 3.0$, and $29 \leq f6=(\kappa)+6\times(\gamma)^{1/2}+0.5\times(\mu) \leq 66$ are satisfied, the length of the long side of γ phase is 40 μm or less, the length of the long side of μ phase is 25 μm or less, and κ phase is present in α phase;

wherein an amount of Sn in κ phase is 0.08 mass % to 0.40 mass %, and an amount of P in κ phase is 0.07 mass % to 0.22 mass %.

6. A free-cutting copper alloy casting comprising:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.20 mass % of Pb; and a balance including Zn and inevitable impurities, wherein a total amount of Fe, Mn, Co, and Cr as the inevitable impurities is lower than 0.08 mass %, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $76.2 \leq f1=[Cu]+0.8\times[Si]-8.5\times[Sn]+[P]+0.5\times[Pb] \leq 80.3$ and $61.2 \leq f2=[Cu]-4.4\times[Si]-0.8\times[Sn]-[P]+0.5\times[Pb]62.8$ are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $25 \leq (\kappa) \leq 65$, $0 \leq (\gamma) \leq 2.0$, $0 \leq (\beta) \leq 0.3$, $0 \leq (\mu) \leq 2.0$, $96.5 \leq f3=(\alpha)+(\kappa)$, $99.2 \leq f4=(\alpha)+(\kappa)+(\gamma)+(\mu)$, $0 \leq f5=(\gamma)+(\mu) \leq 3.0$, and $29 \leq f6=(\kappa)+6\times(\gamma)^{1/2}+0.5\times(\mu) \leq 66$ are satisfied, the length of the long side of γ phase is 50 μm or less, the length of the long side of μ phase is 25 μm or less, and κ phase is present in α phase;

wherein a Charpy impact test value is 23 J/cm$^2$ to 60 J/cm$^2$, and a creep strain after holding the casting at 150° C. for 100 hours in a state where a load corresponding to 0.2% proof stress at room temperature is applied is 0.4% or lower.

7. The free-cutting copper alloy casting according to claim 1, wherein a solidification temperature range is 40° C. or lower.

8. The free-cutting copper alloy casting according to claim 1, that is used in a device for water supply, an industrial plumbing member, a device that comes in contact with liquid, an automobile component, or an electrical appliance component.

9. A method of manufacturing a free-cutting copper alloy casting, the free-cutting copper alloy casting comprising:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.20 mass % of Pb; and a balance including Zn and inevitable impurities, wherein a total amount of Fe, Mn, Co and Cr as the inevitable impurities is lower than 0.09 mass %, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of, $$76.2 \leq f1 = [Cu] + 0.8 \times [Si] - 8.5 \times [Sn] + [P] + 0.5 \times [Pb] \leq 80.3$$

and $$61.2 \leq f2 = [Cu] - 4.4 \times [Si] - 0.8 \times [Sn] - [P] + 0.5 \times [Pb] 62.8$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$25 \leq (\kappa) \leq 65,$$

$$0 \leq (\gamma) \leq 2.0,$$

$$0 \leq (\beta) \leq 0.3,$$

$$0 \leq (\mu) \leq 2.0,$$

$$96.5 \leq f3 = (\alpha) + (\kappa),$$

$$99.2 \leq f4 = (\alpha) + (\kappa) + (\gamma) + (\mu),$$

$$0 \leq f5 = (\gamma) + (\mu) \leq 3.0, \text{ and}$$

$$29 \leq f6 = (\kappa) + 6 \times (\gamma)^{1/2} + 0.5 \times (\mu) \leq 66$$

are satisfied, the length of the long side of γ phase is 40 μm or less, the length of the long side of μ phase is 25 μm or less, and κ phase is present in α phase:

the method comprising:

a melting and casting step, wherein the copper alloy casting is cooled in a temperature range from 575° C. to 510° C. at an average cooling rate of 0.1° C./min to 2.5° C./min and subsequently is cooled in a temperature range from 470° C. to 380° C. at an average cooling rate of higher than 2.5° C./min and lower than 500° C./min in the process of cooling after the casting.

10. A method of manufacturing a free-cutting copper alloy casting, the free-cutting copper alloy casting comprising:

75.0 mass % to 78.5 mass % of Cu;

2.95 mass % to 3.55 mass % of Si;

0.07 mass % to 0.28 mass % of Sn;

0.06 mass % to 0.14 mass % of P;

0.022 mass % to 0.20 mass % of Pb; and a balance including Zn and inevitable impurities, wherein a total amount of Fe, Mn, Co and Cr as the inevitable impurities is lower than 0.08 mass %, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$76.2 \leq f1 = [Cu] + 0.8 \times [Si] - 8.5 \times [Sn] + [P] + 0.5 \times [Pb] \leq 80.3$$

and $$61.2 \leq f2 = [Cu] - 4.4 \times [Si] - 0.8 \times [Sn] - [P] + 0.5 \times [Pb] \leq 62.8$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$25 \leq (\kappa) \leq 65,$$

$$0 \leq (\gamma) \leq 2.0,$$

$$0 \leq (\beta) \leq 0.3,$$

$$0 \leq (\mu) \leq 2.0,$$

$$96.5 \leq f3 = (\alpha) + (\kappa),$$

$$99.2 \leq f4 = (\alpha) + (\kappa) + (\gamma) + (\mu),$$

$$0 \leq f5 = (\gamma) + (\mu) \leq 3.0, \text{ and}$$

$$29 \leq f6 = (\kappa) + 6 \times (\gamma)^{1/2} + 0.5 \times (\mu) \leq 66$$

are satisfied, the length of the long side of γ phase is 40 μm or less, the length of the long side of μ phase is 25 μm or less, and κ phase is present in α phase;

the method comprising:

a melting and casting step; and a heat treatment step that is performed after the melting and casting step, wherein in the melting and casting step, a casting is cooled to lower than 380° C. or to a normal temperature, in the heat treatment step, (i) the casting is held at a temperature of 510° C. to 575° C. for 20 minutes to 8 hours or (ii) the casting is heated under the condition where a maximum reaching temperature is 620° C. to 550° C. and is cooled in a temperature range from 575° C. to 510° C. at an average cooling rate of 0.1° C./min to 2.5° C./min, and subsequently the casting is cooled in a temperature range from 470° C. to 380° C. at an average cooling rate of higher than 2.5° C./min and lower than 500° C./min.

11. The method of manufacturing the free-cutting copper alloy casting according to claim 10, wherein in the heat treatment step, the casting is heated under the condition (i), and a heat treatment temperature and a heat treatment time satisfy the following relational expression, $$800 \leq f7 = (T - 500) \times t,$$

wherein T represents a heat treatment temperature (° C.), and when T is 540° C. or higher, T is set as 540, and t represents a heat treatment time (min) in a temperature range of 510° C. to 575° C.

12. The free-cutting copper alloy casting according to claim 5, further comprising:

one or more element(s) selected from the group consisting of 0.02 mass % to 0.08 mass % of Sb, 0.02 mass % to 0.08 mass % of As, and 0.02 mass % to 0.30 mass % of Bi.

13. The free-cutting copper alloy casting according to claim 6, further comprising, one or more element(s) selected from the group consisting of 0.02 mass % to 0.08 mass % of Sb, 0.02 mass % to 0.08 mass % of As, and 0.02 mass % to 0.30 mass % of Bi.

14. The free-cutting copper alloy casting according to claim 2, wherein a solidification temperature range is 40° C. or lower.

15. The free-cutting copper alloy casting according to claim 2, that is used in a device for water supply, an industrial plumbing member, a device that comes in contact with liquid, an automobile component, or an electrical appliance component.

16. The method of manufacturing a free-cutting copper alloy casting according to claim 9, wherein the manufactured free-cutting copper alloy casting further comprises:

one or more element(s) selected from the group consisting of 0.02 mass % to 0.08 mass % of Sb, 0.02 mass % to 0.08 mass % of As, and 0.02 mass % to 0.30 mass % of Bi.

17. The method of manufacturing a free-cutting copper alloy casting according to claim 10, wherein the manufactured free-cutting copper alloy casting further comprises:

one or more element(s) selected from the group consisting of 0.02 mass % to 0.08 mass % of Sb, 0.02 mass % to 0.08 mass % of As, and 0.02 mass % to 0.30 mass % of Bi.

18. The method of manufacturing a free-cutting copper alloy casting according to claim 11, wherein the manufactured free-cutting copper alloy casting further comprises:

one or more element(s) selected from the group consisting of 0.02 mass % to 0.08 mass % of Sb, 0.02 mass % to 0.08 mass % of As, and 0.02 mass % to 0.30 mass % of Bi.

* * * * *